US006257782B1

(12) United States Patent
Maruyama et al.

(10) Patent No.: US 6,257,782 B1
(45) Date of Patent: Jul. 10, 2001

(54) KEY SWITCH WITH SLIDING MECHANISM AND KEYBOARD

(75) Inventors: Junichi Maruyama; Toshiaki Tanaka; Kazutoshi Hayashi, all of Tokyo; Goro Watanabe, Kawasaki, all of (JP)

(73) Assignees: Fujitsu Limited; Fujitsu Takamisawa Component Ltd., both of Kawasaki (JP)

( * ) Notice: Subject to any disclaimer, the term of this patent is extended or adjusted under 35 U.S.C. 154(b) by 0 days.

(21) Appl. No.: 09/335,477

(22) Filed: Jun. 18, 1999

(30) Foreign Application Priority Data

Jun. 18, 1998 (JP) ..... 10-171727
Dec. 28, 1998 (JP) ..... 10-374470

(51) Int. Cl.[7] ..... B41J 7/32; H01H 13/70; H01H 13/705

(52) U.S. Cl. ..... 400/495.1; 400/495; 400/490; 200/345

(58) Field of Search ..... 400/496, 491.2, 400/490, 491, 495.1, 495; 200/344, 345

(56) References Cited

U.S. PATENT DOCUMENTS

| | | | | |
|---|---|---|---|---|
| 4,479,111 | * | 10/1984 | Madsen et al. | 200/340 |
| 4,918,270 | * | 4/1990 | Orrico | 200/345 |
| 5,268,545 | * | 12/1993 | Bruner | 400/491.2 |
| 5,287,245 | | 2/1994 | Lucente et al. | 361/680 |
| 5,382,762 | | 1/1995 | Mochizuki | 200/5 |
| 5,466,901 | * | 11/1995 | Mochizuki | 200/344 |
| 5,594,618 | | 1/1997 | Sellers | 361/680 |
| 5,635,928 | | 6/1997 | Takagi et al. | 341/22 |
| 5,657,860 | | 8/1997 | Koike et al. | 200/344 |
| 5,746,308 | | 5/1998 | Lin | 200/344 |
| 5,971,637 | * | 10/1999 | Malhi et al. | 400/491.2 |

FOREIGN PATENT DOCUMENTS

| | | |
|---|---|---|
| 5-66832 | 9/1993 | (JP) . |
| 9-27235 | 1/1997 | (JP) . |
| 9-45182 | 2/1997 | (JP) . |
| 9-63402 | 3/1997 | (JP) . |
| 9-190735 | 7/1997 | (JP) . |

* cited by examiner

*Primary Examiner*—Daniel J. Colilla
(74) *Attorney, Agent, or Firm*—Staas & Halsey LLP

(57) ABSTRACT

A key switch comprising a base, a key top arranged above the base, a pair of link members interlocked to each other and operatively engaged with the base and the key top to support the key top above the base and direct the key top in a vertical direction, a switching mechanism for selectively opening and closing an electric circuit in connection with a vertical movement of the key top. Each of the link members includes a sliding portion slidably and shiftably engaged with either one of the base and the key top. At least one elastic member is disposed between at least one of the link members and either one of the base and the key top with which the sliding portion of each link member is engaged. The elastic member exerts biasing force, relative to a displacement or shifting amount of the sliding portion, onto at least one of the link members in a direction different from, e.g., substantially orthogonal to, the vertical shifting direction of the key top. Preferably, the biasing force assumes a linear relationship with the shifting amount of the sliding portion.

40 Claims, 32 Drawing Sheets

292
292a
292b
XXXI
302
302a
302b
298
332
318
320
316
310
296
326
324
312
328
322
290
314
330
308a
336
294b
294c
334
294
306
308
294a
306a
304
42
300
338
344
340
342
A
22
20

KEY SWITCH WITH SLIDING MECHANISM AND KEYBOARD

BACKGROUND OF THE INVENTION

1. Field of the Invention

The present invention relates generally to a switch mechanism for a key-entry use and, more particularly, to a key-entry switch (hereinafter referred to as a key switch) preferably used for a relatively thin keyboard incorporated in a portable electronic equipment, such as a notebook-size personal computer or word processor. The present invention also relates to a relatively thin keyboard provided with a plurality of key switches having such structures.

2. Description of the Related Art

In the technical field of portable electronic equipment, such as notebook-size personal computers or word processors, etc., various techniques have been provided, which can facilitate the reduction of height or thickness of an equipment housing including a keyboard, to improve the portability of the equipment. Particularly, when the height of a keyboard provided with a plurality of key switches is reduced, it has been generally required to maintain the stroke of each key switch at a predetermined distance to ensure a constant operational properties thereof and, simultaneously, to reduce the entire height of the key switch upon both the non-operated (or switched-off) and operated (or pushed down and switched-on) conditions thereof.

Japanese Unexamined Utility Model Publication (Kokai) No. 5-66832 (JP-U-5-66832) discloses one example of a key switch for use in such a relatively thin keyboard, which includes a key top adapted to be keyed or pushed down by an operator's finger, a base disposed beneath the key top, a pair of link members for supporting the key top above the major surface of the base and directing it in the vertical or up-and-down direction, a sheet-like switch arranged beneath the base, and an elastic actuating member located between the key top and the sheet-like switch so as to open and close the sheet-like switch corresponding to the vertical or up-and-down movement of the key top.

The pair of link members are pivotably connected with each other, so as to be provided with a generally X-shape in a side view. A first link member is engaged slidably at one end thereof with the base and rotatably at the other end with the key top. A second link member is engaged rotatably at one end thereof with the base and slidably at the other end with the key top. In this manner, the key top is subjected to a parallel displacement in a substantially vertical direction in relation to the major surface of the base, while keeping a predetermined posture of the key top.

The elastic actuating member is a dome-like member integrally formed from a rubber material. The elastic actuating member is placed on the sheet-like switch through an opening formed in the base at a position beneath the key top, with the upper end of the dome facing toward the key top. The sheet-like switch is structured as a pair of conductive contacts opposed to each other and respectively carried on two film-like printed circuit boards. The sheet-like switch is positioned beneath the elastic actuating member normally in an opened state. In this specification, such a contact pair is referred to as a membrane switch, and a pair of film-like boards provided with a membrane switch is referred to as a membrane sheet.

When no external force is applied to the key top, the elastic actuating member supports the key top on the outer surface of the dome upper end, and urges the key top toward an initial position vertically upwardly away from the base. When the key top is pushed downward by a key-entry operation, the elastic actuating member is elastically deformed while exerting a biasing or an elastic restoring force to the key top in an opposite or upward direction. In this condition, a projection formed on the interior surface of the dome upper end serves to push the outer surface of the membrane sheet, so as to close or turn-on the membrane switch. When the downward pushing force applied to the key top is released, the elastic actuating member is elastically restored, so as to return the key top to the initial position and to open or turn-off the membrane switch.

In the above-mentioned conventional key switch, including a pair of link members used as means for supporting/directing the key top, it is possible to fold the link members and put them within a space between the key top and the base as the key top is downwardly displaced. Accordingly, in comparison with other conventional structures including, as means for supporting/directing the key top, a telescopic shaft assembly using a shaft and a bearing which can be slidingly moved relative to each other in a vertical or going up and down direction of the key top, it is possible to further reduce the entire height of the key switch upon both the inoperated and operated conditions thereof, while maintaining the stroke of the key switch at a predetermined distance.

Japanese Unexamined Patent Publication (Kokai) No. 9-27235 (JP-A-9-27235) discloses another example of a key switch also including a pair of link members used as means for supporting/directing a key top. In this key switch, the link members are assembled into a generally X-shape in a side view and are slidably connected with each other at an intersection thereof. Both link members are engaged slidably at one ends thereof with the base and rotatably at the other ends with the key top. In this structure, the key top is also permitted to be subjected to a parallel displacement in a substantially vertical direction in relation to the major surface of the base, and it is also possible to reduce the entire height of the key switch upon both the non-operated and operated conditions thereof, while maintaining a predetermined distance of the stroke of the key switch.

Japanese Unexamined Patent Publication (Kokai) No. 9-190735 (JP-A-9-190735) discloses a further example of a key switch also including a pair of link members used as means for supporting/directing a key top. In this key switch, the link members are assembled into a generally reverse V-shape in a side view and meshed with each other at the toothed ends thereof. Both link members are engaged slidably at one free ends thereof with the base and rotatably at the other toothed ends with the key top. In this structure, the key top is also permitted to be subjected to a parallel displacement in a substantially vertical direction in relation to the major surface of the base, and it is also possible to reduce the entire height of the key switch upon both the inoperated and operated conditions thereof, while maintaining a predetermined distance of the stroke of the key switch.

In a relatively thin keyboard provided with a plurality of key switches each having the above-mentioned pair of link members, a structure is known in which the key top of each key switch is held in an initial projecting position for a key-entry operation during the operating state of the keyboard, while the key top is positively displaced to a retracted position lower than the initial position during the inoperating (or carrying) state of the keyboard, in order to improve the portability of the keyboard.

For example, Japanese Unexamined Patent Publication (Kokai) No. 9-63402 (JP-A-9-63402) discloses a yet further example of a key switch including a dome-shaped elastic actuating member fixedly mounted on a membrane sheet. The elastic actuating member of this key switch can be shifted in a lateral direction together with the membrane sheet in an integral manner under the key top. In the operating state of the keyboard, the elastic actuating member of each key switch is located at a position for supporting the key top thereof in an initial projecting position. On the other hand, during the non-operating state of the keyboard, the elastic actuating member of each key switch is laterally shifted and located at a position where the key top thereof is not supported on the actuating member, and thereby the key top is displaced into a retracted position which corresponds to a pushed-down position in the key-entry operation.

As disclosed in each of the above prior-art documents, the conventional key switch generally utilizes a dome-shaped elastic actuating member as means for opening/closing a membrane switch. The elastic actuating member also serves as means for elastically upwardly biasing the key top away from the base. Therefore, when the actuating member is elastically deformed by a key-entry operation of the key top, the actuating member exerts biasing or elastic restoring force to the key top, which assumes non-linear relationship with a displacement of the key top, due to the dome-shaped profile of the actuating member.

That is, the key switch can establish such a key-entry operating properties that, at the instant when the pushed-down displacement of the key top exceeds a predetermined value, the biasing force, which has been gradually increased until that time, is sharply reduced. As a result, an operator can recognize that the key switch has been correctly and appropriately operated by the finger, even when the keyboard is one adapted to be incorporated in a portable electronic equipment, in which the key switch generally has a relatively short keying stroke.

The dome-shaped elastic actuating member is, however, kept in a location between the key top and the membrane sheet and interposed therebetween in relation to the height of the key switch, regardless of the degree of the deformation of the actuating member. Therefore, the dome-shaped elastic actuating member in itself affects the entire height of the key switch upon both the inoperated and operated conditions thereof. Accordingly, even if the use of the link members as means for supporting/directing the key top could reduce the entire height of the key switch, there is a difficulty in reducing the height or thickness of the key switch and thus of the keyboard, due to the provision of the dome-shaped elastic actuating member.

Further, in the conventional key switch wherein the key top can be displaced into the retracted position by shifting the elastic actuating member in a lateral direction during the inoperating state of the keyboard, it is necessary to define a sufficient space to accommodate not only the link members but also the dome-shaped elastic actuating member not deformed, between the retracted key top and the base. Consequently, the dimension of the key top tends to be increased particularly in the height direction.

SUMMARY OF THE INVENTION

It is therefore an object of the present invention to provide a key switch for a key-entry operation, which can significantly reduce the entire height of the key switch upon both the inoperated and operated conditions thereof, by a relatively simple and low-cost structure.

It is another object of the present invention to provide a key switch for a key-entry operation, which can eliminate a dome-shaped elastic actuating member while maintaining the non-linear feeling of the key-entry operation of the key switch.

It is further object of the present invention to provide a keyboard including a plurality of key switches, which can significantly reduce the entire height or thickness of the keyboard and can improve the portability thereof.

In accordance with the present invention, there is provided a key switch comprising a base; a key top arranged above the base; a pair of link members interlocked to each other and operatively engaged with the base and the key top to support the key top above the base and direct the key top in a vertical direction, each of the link members including a sliding portion slidably and shiftably engaged with either one of the base and the key top; at least one elastic member disposed between at least one of the link members and either one of the base and the key top with which the sliding portion is engaged, to exert biasing force, relative to a shifting amount of the sliding portion, onto the at least one of the link members in a direction different from the vertical direction; and a switching mechanism for selectively opening and closing an electric circuit in connection with a vertical movement of the key top.

It is preferred that at least one elastic member exerts biasing force assuming a linear relationship with the shifting amount of the sliding portion, onto at least one of the link members.

It is also preferred that at least one elastic member exerts biasing force in a direction substantially orthogonal to the vertical direction, onto at least one of the link members.

It is also preferred that at least one of the link members is provided with a loading portion separately from the sliding portion, the biasing force being applied onto the loading portion.

In this arrangement, the loading portion may be shifted in a motion different from the sliding portion when the sliding portion is shifted.

At least one elastic member may be fixedly joined to the base and abutted with the at least one of the link members.

Alternatively, at least one elastic member may be fixedly joined to the at least one of the link members and abutted with the base.

The elastic member may comprise a compression spring.

Preferably, the elastic member comprises a plate spring.

It is preferred that the pair of link members are arranged to mutually intersect and are pivotably connected relative to each other at an intersection thereof, that a first one of the link members is engaged slidably at one end thereof with the base and rotatably at another end thereof with the key top, the sliding portion being provided on the one end of the first link member, and that a second one of the link members is engaged rotatably at one end thereof with the base and slidably at another end thereof with the key top, the sliding portion being provided on the other end of the second link member.

It is also preferred that the pair of link members are arranged to mutually intersect and are pivotably and slidably connected relative to each other at an intersection thereof, and that each of the link members is engaged slidably at one end thereof with the base and rotatably at another end thereof with the key top, the sliding portion being provided on the one end of the each link member.

It is also preferred that the pair of link members are meshed with each other at a toothed end of each of the link members, and that each of the link members is engaged slidably at one end thereof with the base and rotatably at another end thereof with the key top, the sliding portion being provided on the one end of the each link member, the toothed end being provided adjacent to the other end of the each link member.

In this arrangement, the link members may be arranged to intersect with each other.

The switching mechanism may comprise a membrane switch arranged in an opening formed in the base beneath the key top, and an actuating member for pushing the membrane switch to close the electric circuit when the key top goes down and is located at a predetermined position above the base.

In this arrangement, the actuating member may be provided on the key top and may enter into the opening of the base to elastically push the membrane switch when the key top is located at the predetermined position.

Alternatively, the actuating member may be provided on at least one of the link members and may enter into the opening of the base to elastically push the membrane switch when the key top is located at the predetermined position.

In this arrangement, the key switch may further comprise an assist member movable between a first position where the assist member comes into engagement with the actuating member and a second position where the assist member is away from the actuating member, during a time when the key top is located at the predetermined position, and the actuating member may come into engagement with the assist member to push the membrane switch.

Alternatively, the actuating member may be disposed above the membrane switch, and a part of the link members may enter into the opening of the base to push the actuating member when the key top is located at the predetermined position, whereby the actuating member pushes the membrane switch.

In this arrangement, the actuating member may be movable between a first position where the actuating member is pushed by the part of the link members and a second position where the actuating member is away from the part of the link members, during a time when the key top is located at the predetermined position.

Alternatively, the membrane switch may be movable between a first position where the membrane switch is pushed by the actuating member to close the electric circuit and a second position where the membrane switch is away from the actuating member to keep the electric circuit open, during a time when the key top is located at the predetermined position.

The key switch may further comprise means for selectively securing the sliding portion of the at least one of the link members in relation to either one of the base and the key top with which the sliding portion is engaged, to hold the key top at a desired lowered position.

The base may include a fixed base element engaged with the pair of link members and a movable base element disposed under the fixed base element in such a manner as to be movable with relation to the fixed base element.

In this arrangement, at least one elastic member may be fixedly connected to the movable base element and abutted onto the at least one of the link members.

Alternatively, at least one elastic member may be fixedly connected to at least one of the link members and abutted onto at least one vertical wall fixedly joined to the movable base element.

The movable base element may be moved in a direction generally parallel to a shifting direction of the sliding portion of the each link member.

Alternatively, the movable base element may be moved in a direction generally orthogonal to a shifting direction of the sliding portion of the each link member.

The present invention further provides a key switch comprising a base; a key top arranged above the base; a guide member operatively engaged with the base and the key top to support the key top above the base and direct the key top in a vertical direction, the guide member including a sliding portion slidably and shiftably engaged with either one of the base and the key top; an elastic member disposed between the guide member and either one of the base and the key top with which the sliding portion is engaged, to exert a biasing force, relative to a shifting amount of the sliding portion, onto the guide member in a direction different from the vertical direction; and a switching mechanism for selectively opening and closing an electric circuit in connection with a vertical movement of the key top.

It is preferred that the guide member is structured from a plurality of link members interlocked to one another, each of the link members being operatively engaged with the base and the key top and including the sliding portion, and that at least one of the link members is associated with at least one the elastic member.

The present invention yet further provides a keyboard comprising a plurality of key switches, each of the key switches being one as defined above.

The present invention yet further provides a keyboard comprising a plurality of key switches, each of the key switches being one as defined above, wherein the movable base element of the each key switch is formed as a single large plate extending over the plurality of key switches, the single large plate being movably disposed under a plurality of fixed base elements of the key switches.

BRIEF DESCRIPTION OF THE DRAWINGS

The above and other objects, features, and advantages of the present invention will become more apparent from the following description of preferred embodiments in connection with the accompanying drawings, in which.

DESCRIPTION OF THE PREFERRED EMBODIMENT

First Embodiment

Figure 1:
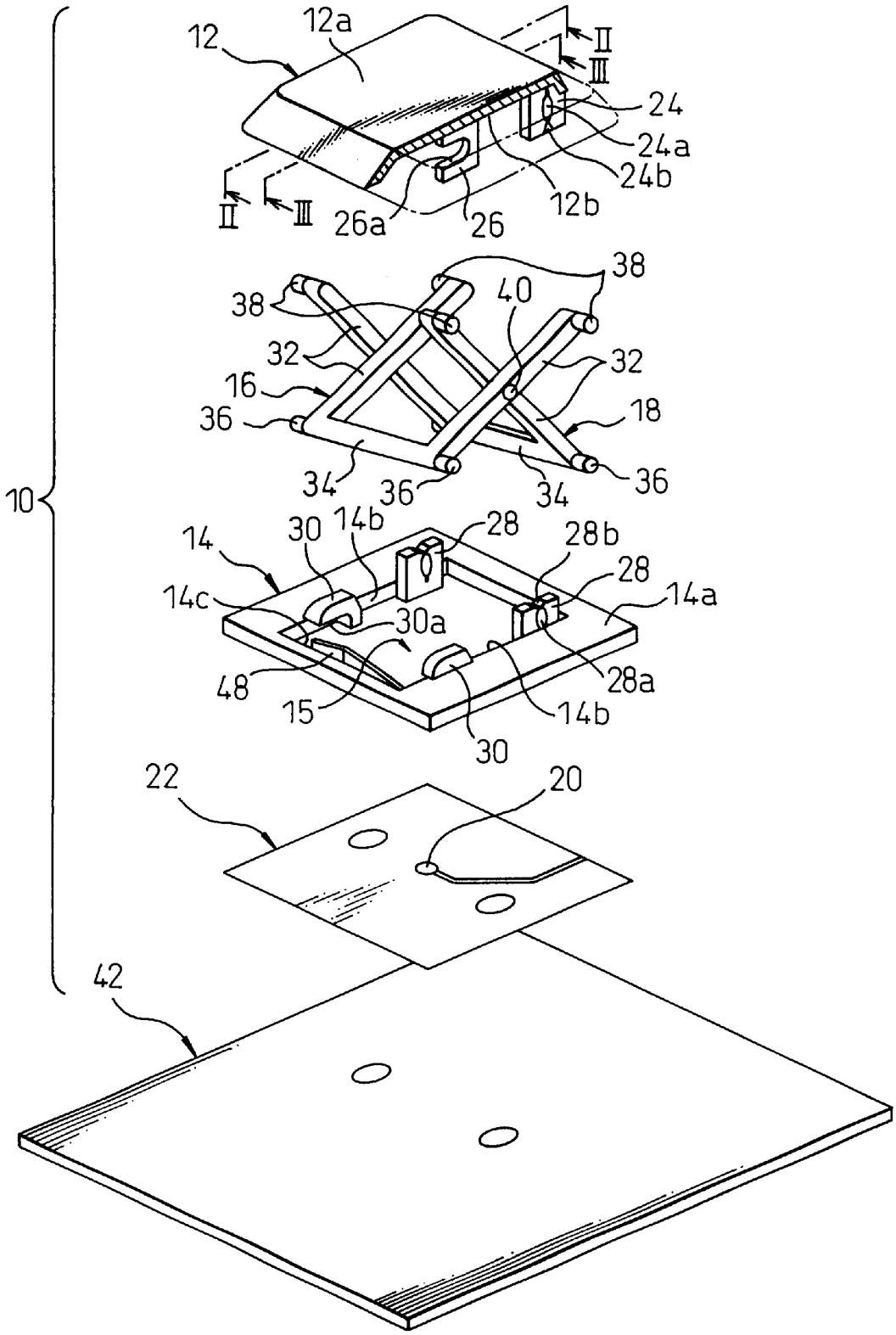
FIG. 1 is an exploded perspective view showing a first embodiment of a key switch according to the present invention.
Figure 2:
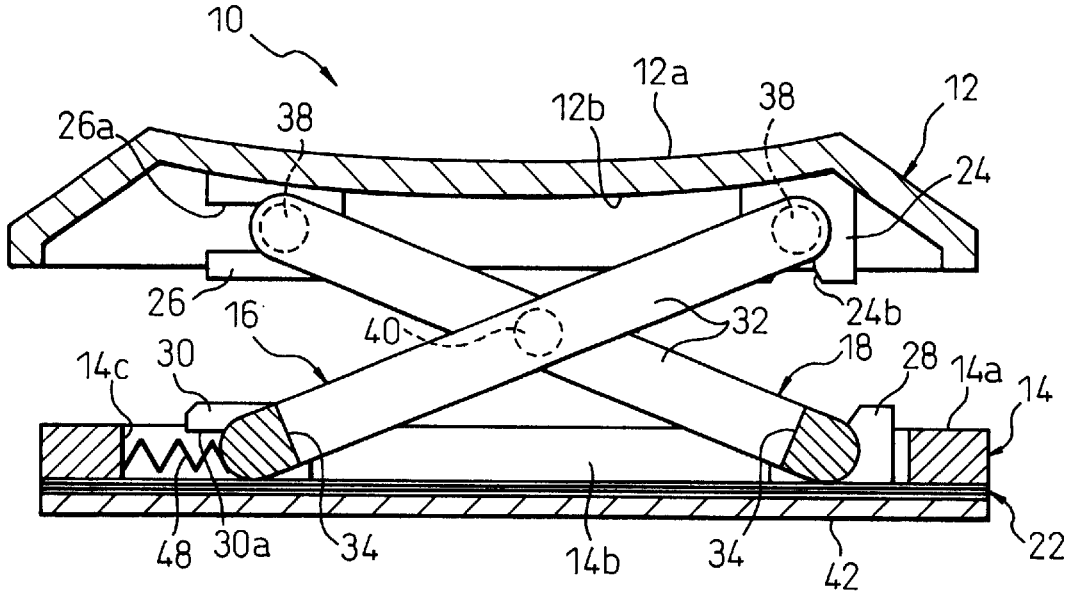
FIG. 2 is a sectional view of the key switch of FIG. 1 in an assembled state, taken along line II—II of FIG. 1.
Figure 3:
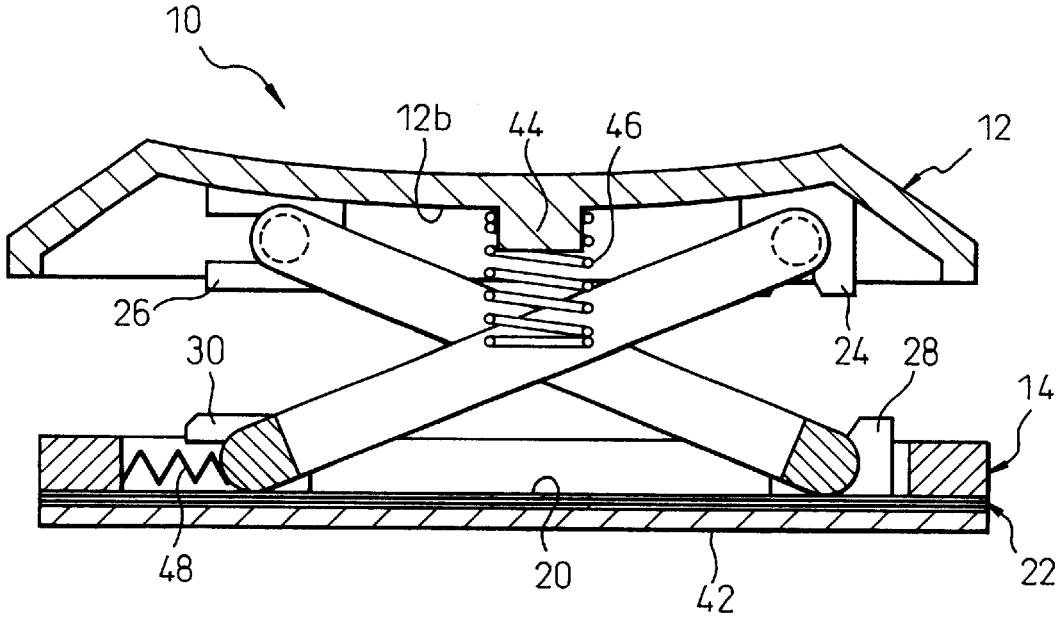
FIG. 3 is a sectional view of the key switch of FIG. 1 in an assembled state, taken along line III—III of FIG. 1.

Referring now to the drawings, in which same or similar components are denoted by common reference numerals, FIG. 1 shows a key switch 10 according to a first embodiment of the present invention in an exploded perspective view, FIG. 2 shows the key switch 10 in an assembled state in section, and FIG. 3 shows the assembled key switch 10 in another section. The key switch 10 includes a key top 12 with an operation surface 12*a* adapted to be keyed by an operator's finger, a base 14 shaped as a rectangular frame and arranged beneath the key top 12, a pair of link members 16, 18 for supporting the key top 12 above a major surface 14*a* of the base 14 and directing or guiding the key top 12 in a vertical or an up-and-down direction, and a membrane sheet 22 provided with a membrane switch 20 and disposed under the base 14.

The key top 12 is a dish-like member having a generally rectangular profile, and includes a pair of pivot supports 24 and a pair of slide supports 26 spaced from the pivot supports 24, both provided on an inner surface 12*b* of the key top 12 opposite to the operation surface 12*a* (only one pivot support 24 and only one slide support 26 are shown). The pivot supports 24 are located at a rear end side (a right end side in FIG. 2) of the key top 12 and spaced from each other, and the slide supports 26 are located at a front end side (a left end side in FIG. 2) of the key top 12 and spaced from each other. Please note that the "front" and the "rear" of the key switch 10 are hereinafter defined in a manner as described above in convenience, but, of course, the "front" and the "rear" in an actual use are not restricted in this definition.

Each of the pivot supports 24 is formed as a small plate uprightly projecting from the inner surface 12*b* of the key top 12, and includes a bearing hole 24*a* penetrating through the thickness of the plate and a slit 24*b* extending generally perpendicularly to the inner surface 12*b* to communicate with the bearing hole 24*a*. The pivot supports 24 are positioned on the inner surface 12*b* of the key top 12 in such a manner that the bearing holes 24*a* of respective pivot supports 24 are aligned with each other in a penetrating direction thereof.

Each of the slide supports 26 is also formed as a small plate uprightly projecting from the inner surface 12*b* of the key top 12, and includes a bearing slot 26*a* penetrating through the thickness of the plate and extending generally parallel to the inner surface 12*b* to open to a front side facing away from the pivot support 24. The slide supports 24 are positioned on the inner surface 12*b* of the key top 12 in such a manner that the bearing slots 26*a* of respective slide supports 26 are aligned with each other in a penetrating direction thereof. The pivot support 24 and the slide support 26 in a corresponding location are substantially aligned with each other in a longitudinal or forward/backward direction on the inner surface 12*b* of the key top 12.

The base 14 is a frame-like member having a generally rectangular profile, and includes a generally rectangular center opening 15 covered with the key top 12. The base 14 is provided, along opposed inner edges 14*b* thereof defining the center opening 15, with a pair of pivot supports 28 and a pair of slide supports 30 spaced from the pivot supports 28 in a longitudinal or forward/backward direction. More particularly, the pivot supports 28 are located at a rear end side of the base 14 and spaced from each other, and the slide supports 30 are located at a front end side of the base 14 and spaced from each other.

Each of the pivot supports 28 is formed as a small plate a part of which projects from the major surface 14*a* of the base 14, and includes a bearing hole 28*a* penetrating through the thickness of the plate and a slit 28*b* extending generally perpendicularly to the major surface 14*a* to communicate with the bearing hole 28*a*. The pivot supports 28 are positioned on the inner edges 14*b* of the base 14 in such a manner that the bearing holes 28*a* of respective pivot supports 28 are aligned with each other in a penetrating direction thereof.

Each of the slide supports 30 includes an L-shaped wall part projecting from the major surface 14*a* and the inner edge 14*b* of the base 14, and a bearing slot 30*a* extending generally parallel to the major surface 14*a* is formed inside the wall part. Each bearing slot 30*a* opens to a front side, away from the pivot support 28, and to a bottom side of the base 14. The slide supports 30 are positioned on the opposed inner edges 14*b* of the base 14 in such a manner that the bearing slots 30*a* of respective slide supports 30 are aligned and faced with each other. The pivot support 28 and the slide support 30 in a corresponding location are substantially aligned with each other in a longitudinal or forward/backward direction on the inner edges 14*b* of the base 14.

The pair of link members 16, 18 are structured as a first link member 16 and a second link member 18, which have a mutually substantially identical shape, and which are assembled together so as to be provided with a generally X-shape in a side view. Each of the link members 16, 18 includes two arms 32 extending parallel to each other, and a bar 34 mutually connecting the ends of the arms 32. Axles 36 are provided on one ends of the arms 32 to mutually coaxially project on the opposite sides to the bar 34. Axles 38 are provided on the other ends of the arms 32 to mutually coaxially project on the same sides as the axles 36.

The first and second link members 16, 18 are arranged to mutually intersect and are pivotably connected relative to each other at an intersection thereof. More particularly, the first and second link members 16, 18 are pivotably connected with each other by pivots 40 provided at generally longitudinal centers of the respective pair of arms 32.

The axles 36 formed on one ends of the arms 32 of the first link member 16 are slidably fitted or received in the respective bearing slots 30*a* of the slide supports 30 on the base 14, and the axles 38 formed on the other ends of the arms 32 of the first link member 16 are pivotably fitted or received in the respective bearing holes 24*a* of the pivot supports 24 on the key top 12, whereby the first link member 16 is arranged between the key top 12 and the base 14 in such a manner as to be pivotable about the axles 38 on the key top 12.

The axles 36 formed on the ends of the arms 32 of the second link member 18 are pivotably fitted or received in the respective bearing holes 28*a* of the pivot supports 28 on the base 14, and the axles 38 formed on the other ends of the arms 32 of the second link member 18 are slidably fitted or received in the respective bearing slots 26*a* of the slide supports 26 on the key top 12, whereby the second link member 18 is arranged between the key top 12 and the base 14 in such a manner as to be pivotable about the axles 36 on the base 14.

Therefore, in this embodiment, the axles 36 of the first link member 16 and the axles 38 of the second link member 18 constitute sliding portions of the respective link members 16, 18. The first and second link members 16, 18 are interlocked to each other through the pivots 40 so as to be synchronously pivotable, so that the key top 12 is permitted to be subjected to a parallel displacement in a substantially vertical direction in relation to the major surface 14*a* of the base 14, while keeping a predetermined posture of the key top 12 wherein the operation surface 12*a* thereof is generally parallel to the major surface 14*a*.

The membrane sheet 22 includes two film-shaped circuit boards stacked one on the other with a spacer interposed therebetween, and the membrane switch 20 is structured by conductive contacts formed oppositely on the respective circuit boards. The membrane sheet 22 is stationarily supported on a support plate 42 under the base 14, and locates the membrane switch 20 at the generally center position in the opening 15 of the base 14.

On the other hand, as shown in FIG. 3, the key top 12 is provided at the generally center position of the inner surface 12*b* thereof, to which the membrane switch 20 of the membrane sheet 22 is substantially aligned in a height direction, with a projection 44 on which a compression coil spring 46 is mounted. The compression coil spring 46 acts as an actuating member or means for selectively opening and closing the membrane switch 20 in connection with a vertical or up-and-down movement of the key top 12.

The membrane switch 20 is normally kept in a condition where the contacts thereof are opened. When the key top 12 is pushed down by a key-entry operation while being directed by the first and second link members 16, 18, the free end of the compression coil spring 46 enters into the center opening 15 of the base 14 and is abutted to the membrane sheet 22, at a predetermined pushed-down position of the key top 12, and thus the membrane switch 20 is closed due to an elastic pushing applied through the compression coil spring 46. When a pushing-down force to the key top 12 is released, the key top 12 returns to an initial position as described later, and thus the compression coil spring 46 clears the membrane sheet 22 to open the membrane switch 20.

It should be noted that various elastic members, such as a cylindrical rubber block, can be used as an actuating member or means for opening/closing the membrane switch 20, instead of the compression coil spring 46. In any case, it is preferred that the actuating member has an elasticity, so as to absorb an impact caused due to the key top 12 upon being pushed down, as far as the easy closure of the membrane switch 20 is not hampered.

The key switch 10 further includes a plate spring 48 or an elastic member, disposed between the base 14 and the first link member 16, which acts as biasing means for elastically urging upward the key top 12 away from the base 14. As diagrammatically shown in FIG. 2, the plate spring 48 is integrally joined at one end thereof to a front inner edge 14*c* of the base 14 opposite to the bearing slots 30*a* of the slide supports 30, and is abutted at the other free end thereof to the bar 34 of the first link member 16. The plate spring 48 acts as a compression spring between the inner edge 14*c* of the base 14 and the bar 34 of the first link member 16.

When no external force is applied to the key top 12, the plate spring 48 urges or biases the bar 34 of the first link member 16 toward a backward position spaced from the front inner edge 14*c* of the base 14 and supports the bar 34 in this position, as well as, through the first link member 16 and the second link member 18 interlocked thereto, urges or biases the key top 12 toward the initial position vertically upwardly away from the base 14 and supports the key top 12 in this position (see FIG. 2).

When the key top 12 is pushed down by a key-entry operation, the axles 36 of the first link member 16 slidingly move frontward along the bearing slots 30*a* of the slide supports 30 of the base 14 and, simultaneously, the bar 34 shifts toward the front inner edge 14*c* of the base 14. During this operation, the plate spring 48 is deformed while exerting biasing or elastic restoring force to the bar 34 (i.e., a loading portion) of the first link member 16 in a direction substantially orthogonal to the pushing-down direction of the key top 12. When the pushing-down force to the key top 12 is released, the plate spring 48 elastically restores to return the key top 12 to the initial position through the first and second link members 16, 18. In this respect, the plate spring 48 is a linear characteristics spring of a simple structure, and thus exerts the biasing force onto the bar 34, which assumes a linear relationship with the shifting amount or displacement of the bar 34.

According to the key switch 10, it is possible to establish key-entry operating properties with non-linear characteristics, similar to that established by a dome-shaped elastic actuating member in the conventional key switch, by using the plate spring 48 with linear characteristics. This is caused by the unique arrangement of the plate spring 48 which applies the biasing force to the first link member 16 in a direction substantially orthogonal to the pushing-down direction of the key top 12. The operational principle of the plate spring 48 is described below with reference to FIGS. 4A to 4C.

Figure 4A:
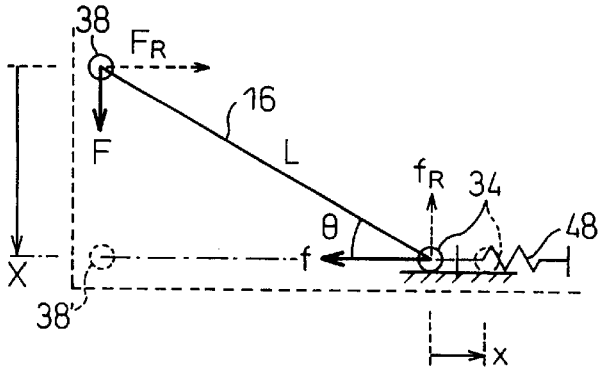
FIGS. 4A to 4C illustrate the principle of the key-entry operation properties of the key switch of FIG. 1.

FIG. 4A diagrammatically shows a constitution in which a link having a length "L" (the first link member 16) is obliquely arranged and a compression spring (the plate spring 48) is joined to the bottom end (the bar 34) of the link, and in which the top end (the axles 38) of the link is pushed down in a vertical downward direction. In this constitution, the reaction force "f" of the compression spring is applied to the bottom end of the link in a horizontal direction, in connection with the pushing-down force "F" applied to the top end of the link in the vertical downward direction. Please note here that:

$F=f\cdot\tan\theta$ ($\theta$ is a link angle);

$f=k\cdot x$ (k is a spring constant, x is a horizontal displacement of link bottom end);

$X=L(\sin\theta_0-\sin\theta)$ (X is a vertical displacement of link top end, $\theta_0$ is a link angle at f=0); and $x=-L\cdot(\cos\theta_0-\cos\theta)$.

Figure 4B:
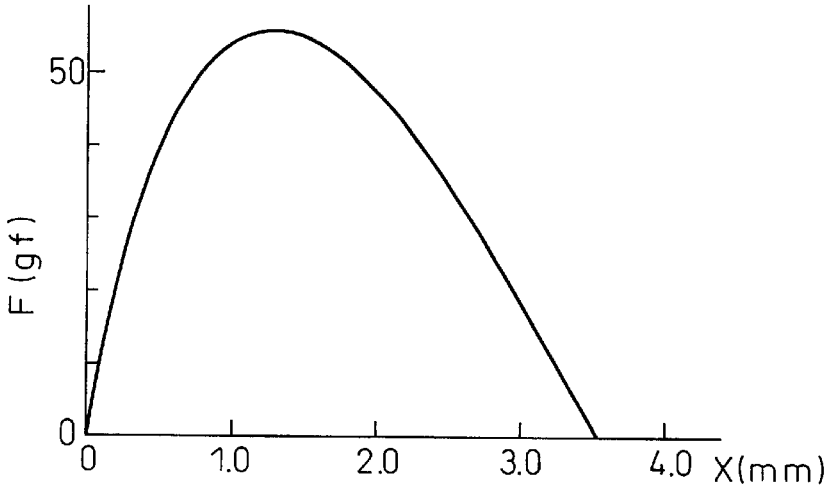
Figure 4C:
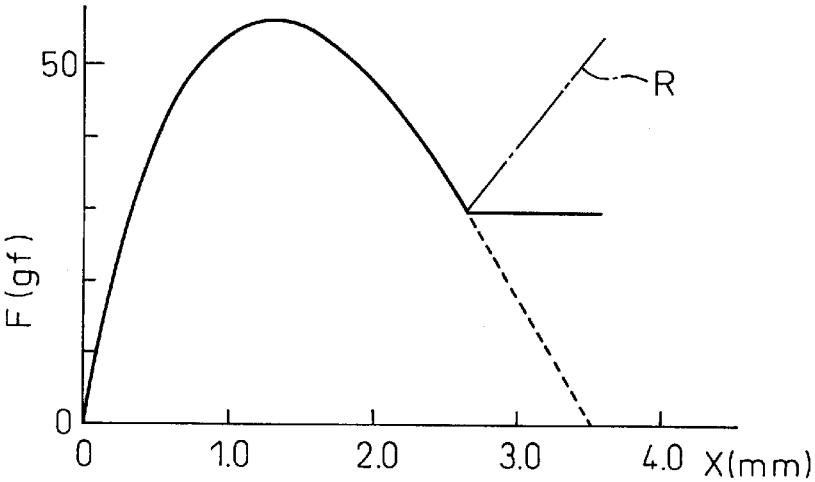

The inventors of the present application numerically analyzed the parameter $0\leqq\theta\leqq45°$ in accordance with the above principles, supposing that $\theta_0=45°$, L=5 mm, k=120 gf/mm, and determined the relationship between the vertical displacement of the link top end and the pushing-down force. The results thereof is shown in FIG. 4B. As illustrated, a characteristic curve was obtained, wherein, at the instant when the vertical displacement "X" of the link top end exceeds a predetermined value, the pushing-down force "F", which has been gradually increased until that time, is reduced to the contrary.

Consequently, according to the key switch 10, it is possible to establish a key-entry operating properties similar to that established in the conventional key switch using a dome-shaped elastic actuating member, wherein, at the instant when the pushed-down displacement of the key top 12 exceeds a predetermined value, the biasing force, which has been gradually increased until that time, is sharply reduced. In an actual operation, the synthetic characteristic curve is obtained, as shown by a solid line in FIG. 4C, since the reaction force "R" due to the compression coil spring 46 acting as the actuating member for the membrane switch 20 is additionally exerted, after the key top 12 passes the predetermined pushed-down position.

As described above, in the key switch 10, the key-top biasing function and the membrane-switch actuating function, both included in the conventional dome-shaped elastic actuating member, are assigned to the plate spring 48 and the compression coil spring 46, respectively, so that the dome-shaped elastic actuating member is omitted. The plate spring 48 is not placed between the key top 12 and the membrane sheet 22 in the height direction of the key switch 10, which is different from the conventional dome-shaped elastic actuating member, and which makes it possible to further reduce the entire height of the key switch 10 upon both the inoperated and operated conditions thereof.

In this respect, it is only necessary for the compression coil spring 46 to come into contact with the membrane switch 20 when the key top 12 reaches the predetermined position, so that the compression coil spring 46 hardly affects in itself the height of the key switch 10. Further, the plate spring 48 can establish the key-entry operating properties with non-linear characteristics, similar to that established by the conventional dome-shaped elastic actuating member, due to the arrangement of the plate spring 48, despite the plate spring 48 having a simple, linear characteristic spring, and therefore it is possible to reduce the production cost for the key switch 10 without deteriorating the operational feeling thereof.

Figure 5:
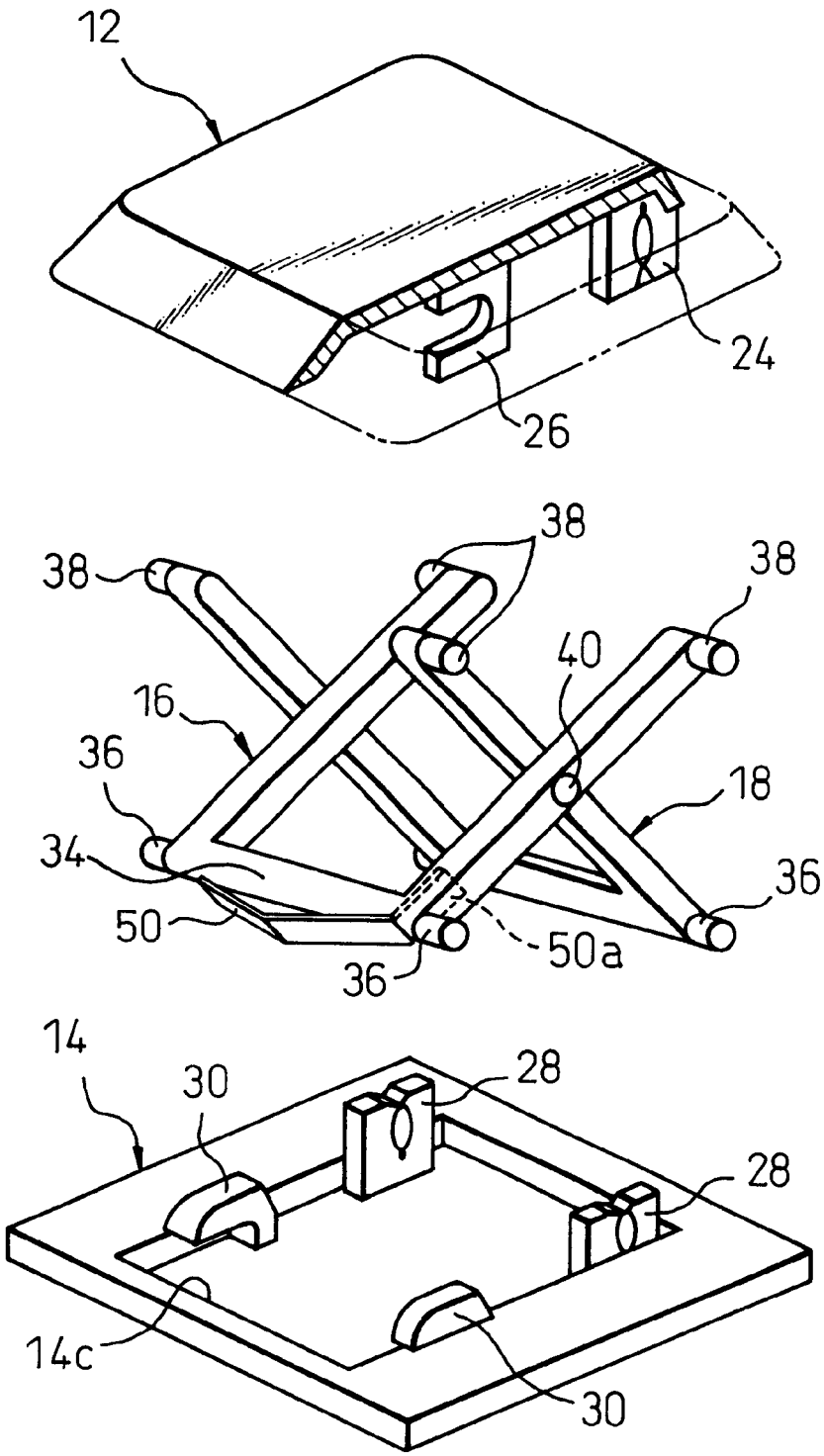
FIG. 5 is an exploded perspective view of a modification of the key switch shown in FIG. 1.

In the above embodiment, the plate spring 48 is integrally joined to the inner edge 14*c* defining the center opening 15 of the base 14, but a plate spring 50 may be used as a modification, which is integrally joined to the first link member 16, as shown in FIG. 5. In this modification, the plate spring 50 is integrally joined at one end thereof to the neighborhood of the bar 34 of the first link member 16, and is abutted at the other free end thereof to the inner edge 14*c* of the base 14. It will be understood that this structure can also provide effects equivalent to those of the first embodiment.

The plate spring 48 may be formed integrally with the base 14, both made from the same resinous material or the same metal. Alternatively, the metal plate spring 48 may be integrally joined to the resinous base 14 through an insert molding process. Also, the plate spring 50 may be formed integrally with the first link member 16, both made from the same resinous material or the same metal. Alternatively, the metal plate spring 50 may be integrally joined to the resinous first link member 16 through an insert molding process. FIG. 5 shows, by a broken line, an embedded portion 50*a* of the plate spring 50 joined to the first link member 16 through the insert molding process.

The other elastic members having linear characteristics, such as a compression coil spring, an extension coil spring, etc., may be used instead of the plate spring 48, 50. Further, in the above embodiment, the plate spring 48, 50 is arranged between the base 14 and the loading portion or bar 34 of the first link member 16, but, in addition or instead, the elastic member having linear characteristics, such as a plate spring, may be disposed between the key top 12 and, e.g., the sliding portion or axle 38 of the second link member 18.

Second Embodiment

Figure 6:
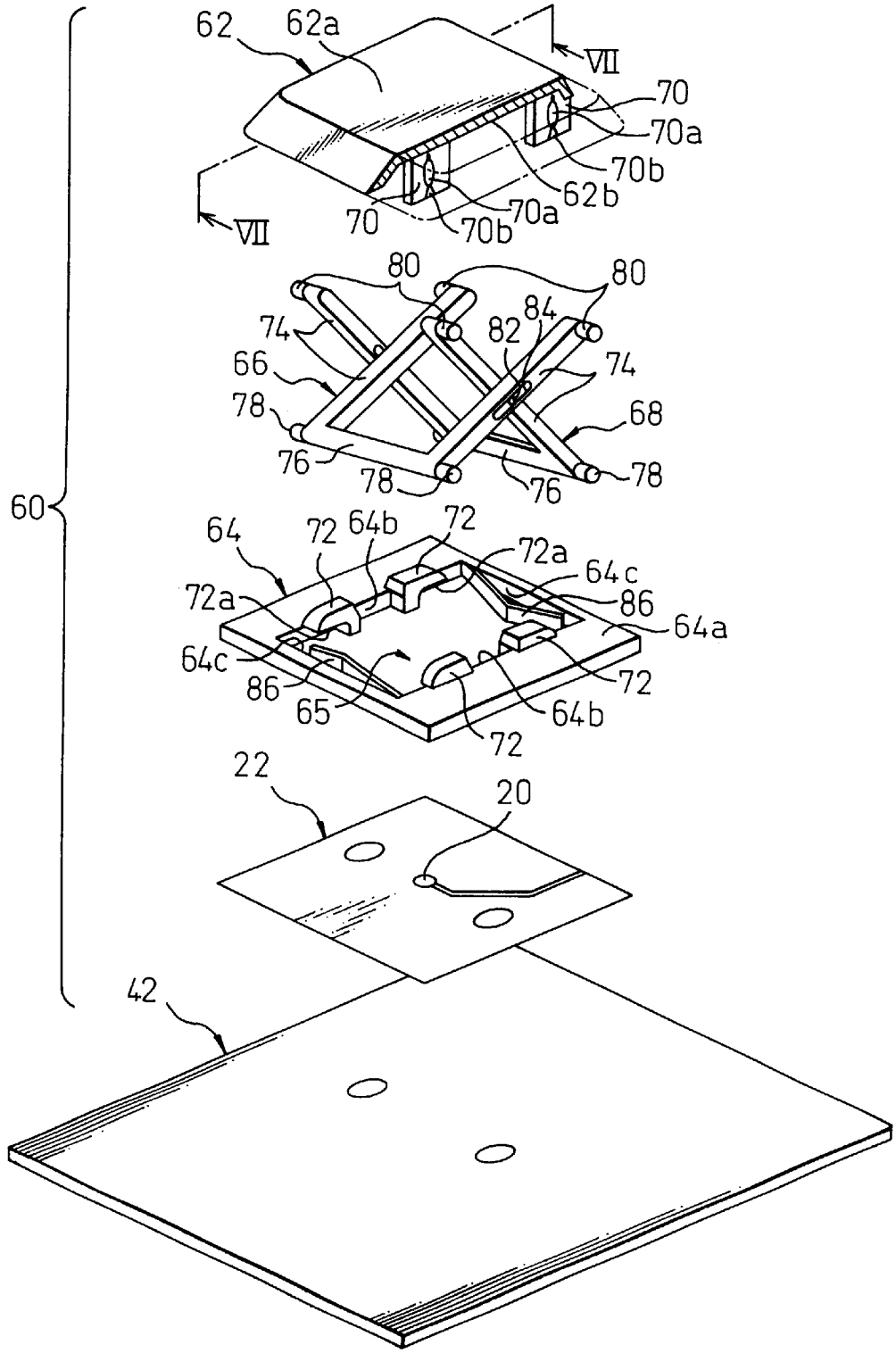
FIG. 6 is an exploded perspective view showing a second embodiment of a key switch according to the present invention.
Figure 7:
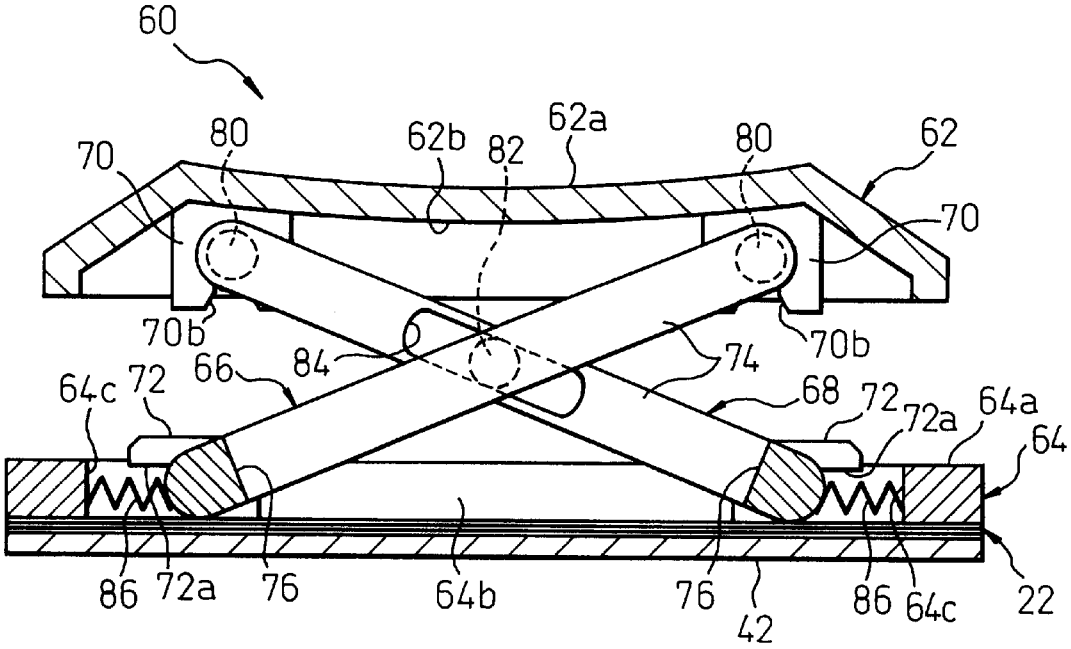
FIG. 7 is a sectional view of the key switch of FIG. 6 in an assembled state, taken along line VII—VII of FIG. 6.

FIGS. 6 and 7 show a key switch 60 according to a second embodiment of the present invention. The key switch 60 includes a key top 62 with an operation surface 62*a* adapted to be keyed by an operator's finger, a base 64 shaped as a rectangular frame and arranged beneath the key top 62, a pair of link members 66, 68 for supporting the key top 62 above a major surface 64*a* of the base 64 and directing or guiding the key top 62 in a vertical or going up and down direction, a membrane sheet 22 provided with a membrane switch 20 and disposed under the base 64, and a support plate 42 for stationarily supporting the membrane sheet 22. The membrane switch 20, the membrane sheet 22 and the support plate 42 have the same structures as those in the key switch 10 of the first embodiment, and thus a detailed description thereof is not repeated.

The key top 62 is a dish-like member having a generally rectangular profile, and includes two pairs of pivot supports 70, one pair being spaced from the other, on an inner surface 62*b* of the key top 62 opposite to the operation surface 62*a* (only two pivot supports 70 are shown). The pivot supports 70 of respective pairs are located at a front end side (a left end side in FIG. 7) and a rear end side (a right end side in FIG. 7) of the key top 62 and spaced from each other in each pair. Please note that the "front" and the "rear" of the key switch 60 are hereinafter defined in a manner as described above in convenience, but, of course, the "front" and the "rear" in an actual use are not restricted in this definition.

Each of the pivot supports 70 is formed as a small plate uprightly projecting from the inner surface 62*b* of the key top 62, and includes a bearing hole 70*a* penetrating through the thickness of the plate and a slit 70*b* extending generally perpendicularly to the inner surface 62*b* to communicate with the bearing hole 70*a*. Two pivot supports 70 of each pair are positioned on the inner surface 62*b* of the key top 62 in such a manner that the bearing holes 70*a* of these pivot supports 70 are aligned with each other in a penetrating direction thereof. The pivot supports 70 in a corresponding location between two pairs are substantially aligned with each other in a longitudinal or forward/backward direction on the inner surface 62*b* of the key top 62.

The key top 62 is also provided generally at the center position of the inner surface 62*b* thereof, to which the membrane switch 20 of the membrane sheet 22 is substantially aligned, in a height direction, with a projection and a compression coil spring mounted thereon (not shown), which are respectively similar to the projection 44 and the compression coil spring 46 in the first embodiment. The compression coil spring acts as an elastic actuating member for selectively opening and closing the membrane switch 20 in connection with a vertical or up-and-down movement of the key top 62.

The base 64 is a frame-like member having a generally rectangular profile, and includes a generally rectangular center opening 65 covered by the key top 62. The base 64 is provided, along opposed inner edges 64*b* thereof defining the center opening 65, with two pairs of slide supports 72, one pair being spaced from the other in a longitudinal or forward/backward direction, and two slide supports 72 in each pair being spaced from each other.

Each of the slide supports 72 disposed adjacent to the front end of the base 64 includes an L-shaped wall part projecting from the major surface 64*a* and the inner edge 64*b* of the base 64, and a bearing slot 72*a* extending generally parallel to the major surface 64*a* is formed inside the wall part. These front bearing slots 72*a* open to a front side, away from the rear slide supports 72, and to a bottom side of the base 64. Each of the slide supports 72 disposed adjacent to the rear end of the base 64 also includes an L-shaped wall part projecting from the major surface 64*a* and the inner edge 64*b* of the base 64, and a bearing slot 72*a* extending generally parallel to the major surface 64*a* is formed inside the wall part. These rear bearing slots 72*a* open to a rear side, away from the front slide supports 72, and to a bottom side of the base 64.

Two slide supports 72 of each pair are positioned on the opposed inner edges 64*b* of the base 64 in such a manner that the bearing slots 72*a* of respective slide supports 72 are aligned and faced with each other. Also, the slide supports 72 in a corresponding location between two pairs are substantially aligned with each other in a longitudinal or forward/backward direction on the inner edges 64*b* of the base 64.

The pair of link members 66, 68 are structured as a first link member 66 and a second link member 68, which have a mutually substantially identical shape, and which are assembled together so as to be provided with a generally X-shape in a side view. Each of the link members 66, 68 includes two arms 74 extending parallel to each other, and a bar 76 mutually connecting one ends of the arms 74. Axles 78 are provided on one ends of the arms 74 to mutually coaxially project on the opposite sides to the bar 76. Axles 80 are provided on the other ends of the arms 74 to mutually coaxially project on the same sides as the axles 78.

The first and second link members 66, 68 are arranged to mutually intersect, and are pivotably and slidably connected relative to each other at an intersection thereof. More particularly, the first and second link members 66, 68 are pivotably and slidably connected with each other by respective interengagements between pivots 82 provided at generally longitudinal centers of one arms 74 of respective link members and elliptic holes 84 provided at generally longitudinal centers of the other arms 74 of respective link members.

The axles 78 formed on one ends of the arms 74 of the first link member 66 are slidably fitted or received in the respective bearing slots 72*a* of the front slide supports 72 on the base 64, and the axles 80 formed on the other ends of the arms 74 of the first link member 66 are pivotably fitted or received in the respective bearing holes 70*a* of the rear pivot supports 70 on the key top 62, whereby the first link member 66 is arranged between the key top 62 and the base 64 in such a manner as to be pivotable about the axles 80 on the key top 62.

The axles 78 formed on one ends of the arms 74 of the second link member 68 are slidably fitted or received in the respective bearing slots 72*a* of the rear slide supports 72 on the base 64, and the axles 80 formed on the other ends of the arms 74 of the second link member 68 are pivotably fitted or received in the respective bearing holes 70*a* of the front pivot supports 70 on the key top 62, whereby the second link member 68 is arranged between the key top 62 and the base 64 in such a manner as to be pivotable about the axles 80 on the key top 62.

Therefore, in this embodiment, the axles 78 of the first link member 66 and the axles 78 of the second link member 68 constitute sliding portions of the respective link members 66, 68. The first and second link members 66, 68 are interlocked to each other through the slidable interengagements between the pivots 82 and the elliptic holes 84 so as to be synchronously pivotable, so that the key top 62 is permitted to be subjected to a parallel displacement in a substantially vertical direction in relation to the major surface 64*a* of the base 64, while keeping a predetermined posture of the key top 62 wherein the operation surface 62*a* thereof is generally parallel to the major surface 64*a*.

The key switch 60 further includes a pair of plate springs 86 or elastic members, disposed between the base 64 and the first and second link members 66, 68, which act as biasing means for elastically urging upward the key top 62 away from the base 64. As diagrammatically shown in FIG. 7, one plate spring 86 is integrally joined at one end thereof to a front inner edge 64*c* of the base 64 opposite to the bearing slots 72*a* of the front slide supports 72, and is abutted at the other free end thereof to the bar 76 of the first link member 66. The other plate spring 86 is integrally joined at one end thereof to a rear inner edge 64*c* of the base 64 opposite to the bearing slots 72*a* of the rear slide supports 72, and is abutted at the other free end thereof to the bar 76 of the second link member 68. The plate springs 86 act as compression springs between the inner edges 64*c* of the base 64 and the bars 76 of the first and second link members 66, 68, respectively.

When no external force is applied to the key top 62, the plate springs 86 urge or bias the bars 76 of the first and second link members 66, 68 toward backward and forward positions spaced from the front and rear inner edges 64*c* of the base 64, respectively, and support the bars 76 in these positions, as well as, through the mutually interlocked first and second link members 66, 68, urging or biasing the key top 62 toward the initial position vertically upwardly away from the base 64 and supporting the key top 62 in this position (see FIG. 7).

When the key top 62 is pushed down by a key-entry operation, the axles 78 of the first and second link members 66, 68 slidingly move frontward and rearward along the bearing slots 72*a* of the front and rear slide supports 72 of the base 64, respectively, and, simultaneously, the bars 76 shift toward the front and rear inner edges 64*c* of the base 64. During this operation, the plate springs 86 are deformed while exerting biasing or elastic restoring force to the respective bars 76 (i.e., loading portions) of the first and second link members 66, 68 in a direction substantially orthogonal to the pushing-down direction of the key top 62.

When the pushing-down force to the key top 62 is released, the plate springs 86 elastically restore to return the key top 62 to the initial position through the first and second link members 66, 68. In this respect, each of the plate springs 86 is a linear characteristic spring of a simple structure, and thus exerts the biasing force, assuming a linear relationship with the shifting amount or displacement of the bar 76, onto each of the bars 76 of the first and second link members 66, 68. Preferably, the plate springs 86 have shapes and characteristics identical to each other.

According to the key switch 60, it is possible to establish a key-entry operating properties with non-linear characteristics, similar to that established by a dome-shaped elastic actuating member in the conventional key switch, by using two plate springs 86 with linear characteristics. This is caused by the unique arrangements of these plate springs 86 which apply the biasing force to the first and second link members 66, 68 in a direction substantially orthogonal to the pushing-down direction of the key top 62. The operational principle of the key switch 60 is substantially the same as that described concerning the first embodiment and is not repeated.

As described above, in the key switch 60, a dome-shaped elastic actuating member in the conventional key switch is omitted, and instead, two plate springs 86, which are not placed between the key top 62 and the membrane sheet 22 in the height direction of the key switch 60, are used as key top biasing means, so that it is made possible to significantly reduce the entire height of the key switch 60 upon both the non-operated and operated conditions thereof. Further, each plate spring 86 can establish the key-entry operating properties with non-linear characteristics, similar to that established by the conventional dome-shaped elastic actuating member, due to the arrangement of the plate spring 86, despite that the plate spring 86 being a simple, linear characteristic spring, and therefore it is possible to reduce the production cost for the key switch 60 without deteriorating the operational feeling thereof.

Moreover, in the key switch 60, two plate springs 86 cooperate to bear the pushing-down force applied to the key top 62, so that the stress applied to each plate spring 86 can be attenuated. Accordingly, it is possible to prevent the plate spring 86 from being damaged, and to ease the design of the plate spring 86.

Figure 8:
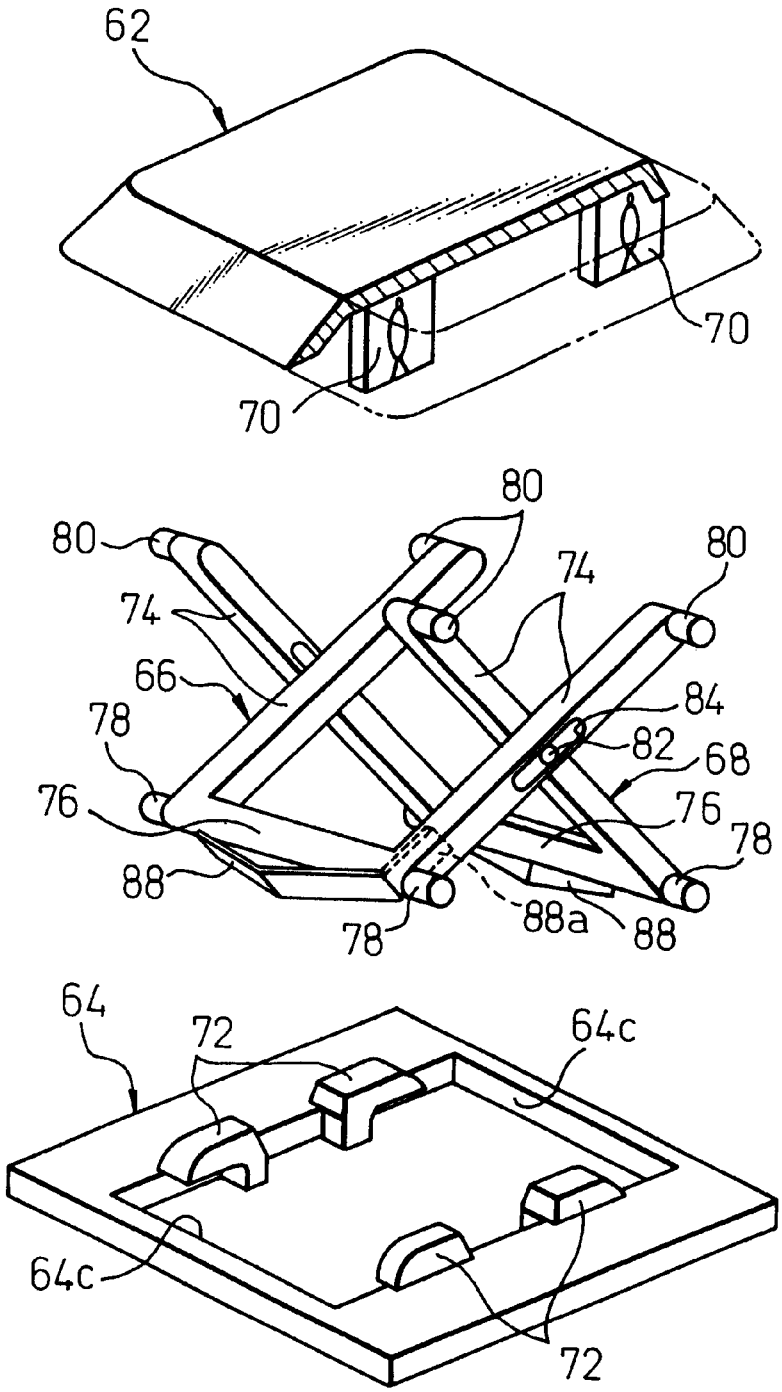
FIG. 8 is an exploded perspective view of a modification of the key switch shown in FIG. 6.

In the above second embodiment, the plate springs 86 are integrally joined to the inner edges 64*c* defining the center opening 65 of the base 64, but plate springs 88 may be used as a modification which are integrally joined to the first and second link members 66, 68, as shown in FIG. 8. In this modification, the plate springs 88 are integrally joined at one ends thereof to the neighborhood of the respective bars 76 of the first and second link members 66, 68, and are abutted at the other free ends thereof to the front and rear inner edges 64*c* of the base 64. It will be understood that this structure can also provide the effects equivalent to those of the embodiment shown in FIG. 6. Also, in this modification, the first and second link members 66, 68 may have a mutually identical structure, and thus it is possible to prevent the number of parts from being increased.

Figure 9:
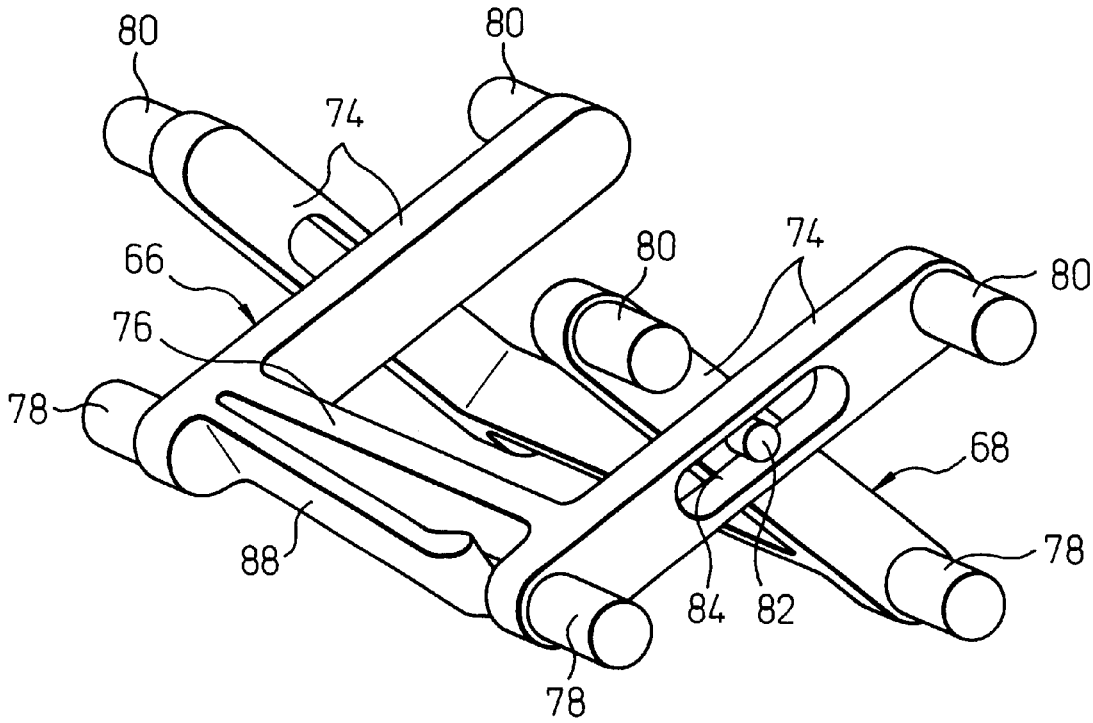
FIG. 9 is a perspective view of a modification of link members used in the key switch shown in FIG. 6.

The plate springs 86 may be formed integrally with the base 64, both made from the same resinous material or the same metal. Alternatively, the metal plate springs 86 may be integrally joined to the resinous base 64 through an insert molding process. Also, the plate springs 88 may be formed integrally with the first and second link members 66, 68, both made from the same resinous material or the same metal. Alternatively, the metal plate springs 88 may be integrally joined to the resinous first and second link members 66, 68 through an insert molding process. FIG. 8 shows, by a broken line, an embedded portion 88*a* of the plate spring 88 joined to the first link member 66 through the insert molding process. Further, FIG. 9 shows one example of first and second link members 66, 68 both provided with plate springs 88 integrally formed therewith from resinous material.

The other elastic members having linear characteristics, such as a compression coil spring, an extension coil spring, etc., may be used instead of the plate springs 86, 88. Further, in the above embodiment, two plate springs 86, 88 are arranged, one for each, between the base 64 and the respective loading portions or bars 76 of the first and second link members 66, 68, but instead, the elastic member having linear characteristics, such as a plate spring, may be disposed only between the base 64 and either one of the bars 76 of the first and second link members 66, 68. Alternatively, both the plate spring 86 joined to the base 64 and the plate spring 88 joined to the first or second link member 66, 68 may be incorporated together in the key switch 60.

Third Embodiment

Figure 10:
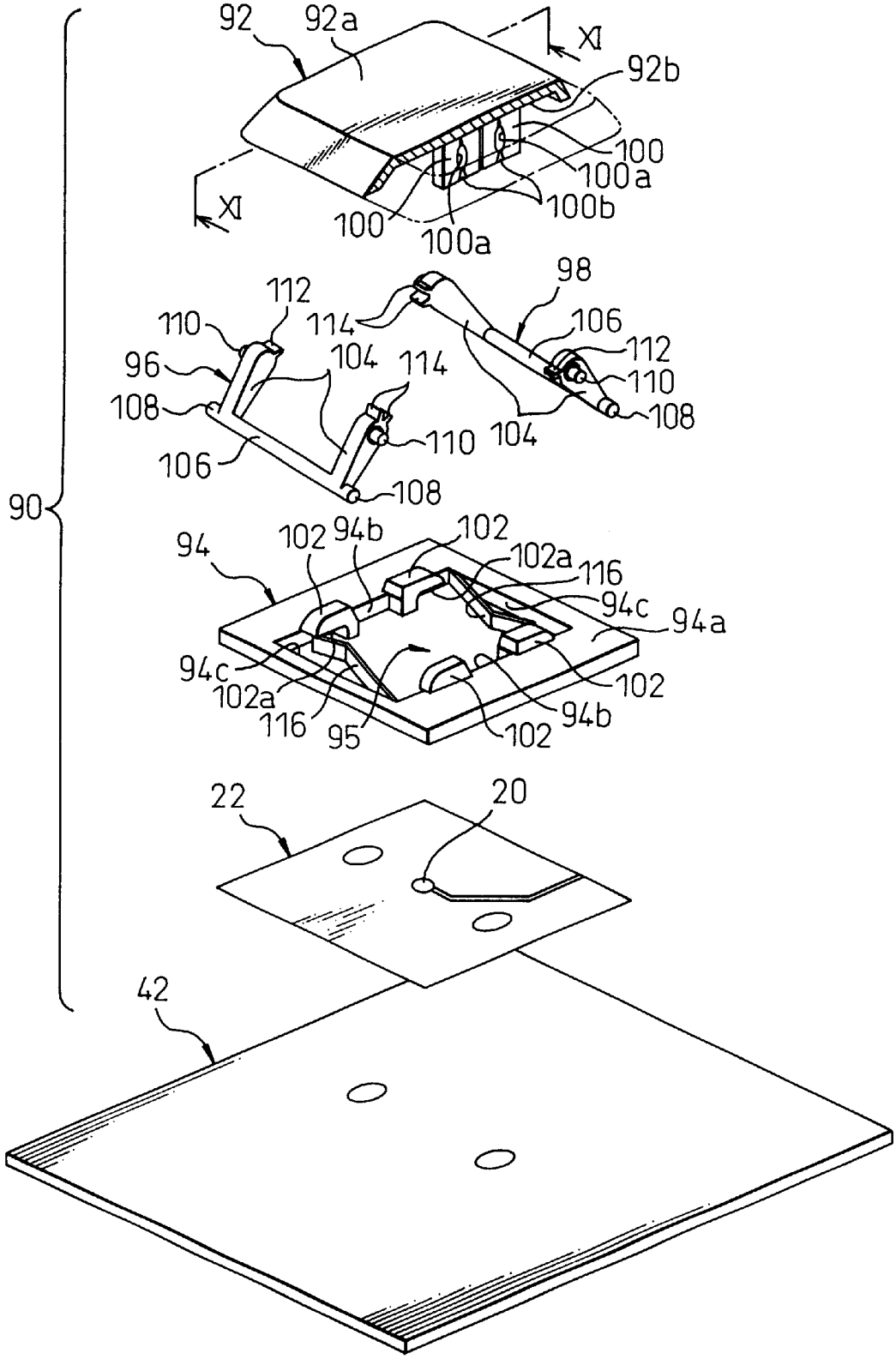
FIG. 10 is an exploded perspective view showing a third embodiment of a key switch according to the present invention.
Figure 11:
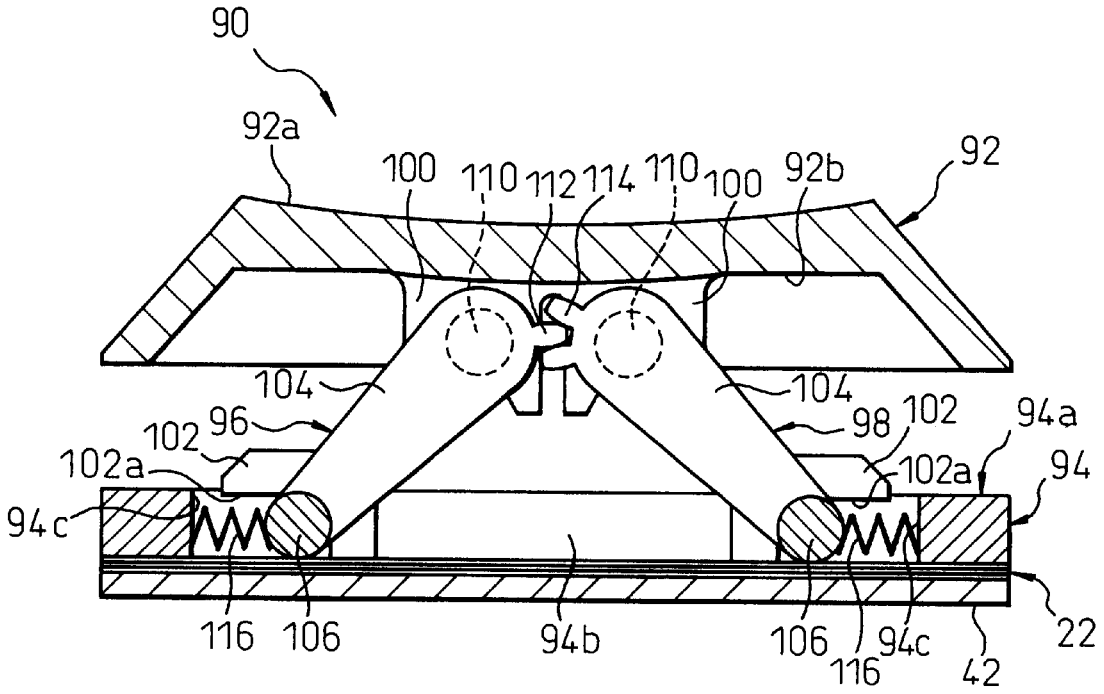
FIG. 11 is a sectional view of the key switch of FIG. 10 in an assembled state, taken along line XI—XI of FIG. 10.

FIGS. 10 and 11 show a key switch 90 according to a third embodiment of the present invention. The key switch 90 includes a key top 92 with an operation surface 92*a* adapted to be keyed by an operator's finger, a base 94 shaped as a rectangular frame and arranged beneath the key top 92, a pair of link members 96, 98 for supporting the key top 92 above a major surface 94*a* of the base 94 and directing or guiding the key top 92 in a vertical or going up and down direction, a membrane sheet 22 provided with a membrane switch 20 and disposed under the base 94, and a support plate 42 for stationarily supporting the membrane sheet 22. The membrane switch 20, the membrane sheet 22 and the support plate 42 have the same structures as those in the key switch 10 of the first embodiment, and thus a detailed description thereof is not repeated.

The key top 92 is a dish-like member having a generally rectangular profile, and includes two pairs of pivot supports 100, both pairs being disposed side-by-side in a forward/ backward direction (a leftward/rightward direction in FIG. 11) on an inner surface 92*b* of the key top 92 opposite to the operation surface 92*a* (only two pivot supports 100 are shown). The pivot supports 100 of respective pairs are located at a generally center of the key top 92 and spaced from each other in each pair. Please note that the "front" and the "rear" of the key switch 90 are hereinafter defined in a manner as described above in convenience, but, of course, the "front" and the "rear" in an actual use are not restricted in this definition.

Each of the pivot supports 100 is formed as a small plate uprightly projecting from the inner surface 92*b* of the key top 92, and includes a bearing hole 100*a* penetrating through the thickness of the plate and a slit 100*b* extending generally perpendicularly to the inner surface 92*b* to communicate. with the bearing hole 100*a*. Two pivot supports 100 of each pair are positioned on the inner surface 92*b* of the key top 92 in such a manner that the bearing holes 100*a* of these pivot supports 100 are aligned with each other in a penetrating direction thereof. The pivot supports 100 in a corresponding location between two pairs are substantially aligned with each other in a longitudinal or forward/backward direction on the inner surface 92*b* of the key top 92.

The key top 92 is also provided at the generally center position of the inner surface 92*b* thereof, to which the membrane switch 20 of the membrane sheet 22 is substantially aligned in a height direction, with a projection and a compression coil spring mounted thereon (not shown), which are respectively similar to the projection 44 and the compression coil spring 46 in the first embodiment. The compression coil spring acts as an elastic actuating member for selectively opening and closing the membrane switch 20 in connection with a vertical or going up and down movement of the key top 92.

The base 94 is a frame-like member having a generally rectangular profile, and includes a generally rectangular center opening 95 covered with the key top 92. The base 94 is provided, along opposed inner edges 94*b* thereof defining the center opening 95, with two pairs of slide supports 102, one pair being spaced from the other in a longitudinal or forward/backward direction, and two slide supports 102 in each pair being spaced from each other.

Each of the slide supports 102 disposed adjacent to the front end of the base 94 includes an L-shaped wall part projecting from the major surface 94*a* and the inner edge 94*b* of the base 94, and a bearing slot 102*a* extending generally parallel to the major surface 94*a* is formed inside the wall part. These front bearing slots 102*a* open to a front side, away from the rear slide supports 102, and to a bottom side of the base 94. Each of the slide supports 102 disposed adjacent to the rear end of the base 94 also includes an L-shaped wall part projecting from the major surface 94*a* and the inner edge 94*b* of the base 94, and a bearing slot 102*a* extending generally parallel to the major surface 94*a* is formed inside the wall part. These rear bearing slots 102*a* open to a rear side, away from the front slide supports 102, and to a bottom side of the base 94.

Two slide supports 102 of each pair are positioned on the opposed inner edges 94*b* of the base 94 in such a manner that the bearing slots 102*a* of respective slide supports 102 are aligned and faced with each other. Also, the slide supports 102 in a corresponding location between two pairs are substantially aligned with each other in a longitudinal or forward/backward direction on the inner edges 94*b* of the base 94.

The pair of link members 96, 98 are structured as a first link member 96 and a second link member 98, which have a mutually substantially identical shape, and which are assembled together so as to be provided with a generally reverse V-shape in a side view. Each of the link members 96, 98 includes two arms 104 extending parallel to each other, and a bar 106 mutually connecting the ends of the arms 104. Axles 108 are provided on the ends of the arms 104 to mutually coaxially project on the opposite sides to the bar 106. Axles 110 are provided on the other ends of the arms 104 to mutually coaxially project on the same sides as the axles 108.

The first and second link members 96, 98 are meshed with each other at a toothed end of each link members 96, 98. More particularly, the first and second link members 96, 98 are pivotably connected with each other by intermeshings between one tooth 112 projecting from the distal ends, near the axles 110, of one arms 104 of respective link members and two teeth 114 projecting from the distal ends, near the axles 110, of the other arms 104 of respective link members.

The axles 108 formed on one ends of the arms 104 of the first link member 96 are slidably fitted or received in the respective bearing slots 102*a* of the front slide supports 102 on the base 94, and the axles 110 formed on the other ends of the arms 104 of the first link member 96 are pivotably fitted or received in the respective bearing holes 100*a* of the front pivot supports 100 on the key top 92, whereby the first link member 96 is arranged between the key top 92 and the base 94 in such a manner as to be pivotable about the axles 110 on the key top 92.

The axles 108 formed on one ends of the arms 104 of the second link member 98 are slidably fitted or received in the respective bearing slots 102*a* of the rear slide supports 102 on the base 94, and the axles 110 formed on the other ends of the arms 104 of the second link member 98 are pivotably fitted or received in the respective bearing holes 100*a* of the rear pivot supports 100 on the key top 92, whereby the second link member 98 is arranged between the key top 92 and the base 94 in such a manner as to be pivotable about the axles 110 on the key top 92.

Therefore, in this embodiment, the axles 108 of the first link member 96 and the axles 108 of the second link member 98 constitute sliding portions of the respective link members 96, 98. The first and second link members 96, 98 are interlocked to each other through the intermeshings between the one tooth 112 and the two teeth 114 so as to be synchronously pivotable, so that the key top 92 is permitted to be subjected to a parallel displacement in a substantially vertical direction in relation to the major surface 94*a* of the base 94, while keeping a predetermined posture of the key top 92 wherein the operation surface 92*a* thereof is generally parallel to the major surface 94*a*.

The key switch 90 further includes a pair of plate springs 116 or elastic members, disposed between the base 94 and the first and second link members 96, 98, which act as biasing means for elastically urging upward the key top 92 away from the base 94. As diagrammatically shown in FIG. 11, one plate spring 116 is integrally joined at one end thereof to a front inner edge 94*c* of the base 94 opposite to the bearing slots 102*a* of the front slide supports 102, and is abutted at the other free end thereof to the bar 106 of the first link member 96. The other plate spring 116 is integrally joined at one end thereof to a rear inner edge 94*c* of the base 94 opposite to the bearing slots 102*a* of the rear slide supports 102, and is abutted at the other free end thereof to the bar 106 of the second link member 98. The plate springs 116 act as compression springs between the inner edges 94*c* of the base 94 and the bars 106 of the first and second link members 96, 98, respectively.

When no external force is applied to the key top 92, the plate springs 116 urge or bias the bars 106 of the first and second link members 96, 98 toward backward and forward positions spaced from the front and rear inner edges 94*c* of the base 94, respectively, and support the bars 106 in these positions, as well as, through the mutually interlocked first and second link members 96, 98, urging or biasing the key top 92 toward the initial position vertically upwardly away from the base 94 and supporting the key top 92 in this position (see FIG. 11).

When the key top 92 is pushed down by a key-entry operation, the axles 108 of the first and second link members 96, 98 slidingly move frontward and rearward along the bearing slots 102*a* of the front and rear slide supports 102 of the base 94, respectively, and, simultaneously, the bars 106 shift toward the front and rear inner edges 94*c* of the base 94. During this operation, the plate springs 116 are deformed while exerting biasing or elastic restoring force to the respective bars 106 (i.e., loading portions) of the first and second link members 96, 98 in a direction substantially orthogonal to the pushing-down direction of the key top 92.

When the pushing-down force to the key top 92 is released, the plate springs 116 elastically restore to return the key top 92 to the initial position through the first and second link members 96, 98. In this respect, each of the plate springs 116 is a linear characteristic spring of a simple structure, and thus exerts the biasing force, assuming a linear relationship with the shifting amount or displacement of the bar 106, onto each of the bars 106 of the first and second link members 96, 98. Preferably, the plate springs 116 have shapes and characteristics identical to each other.

According to the key switch 90, it is possible to establish a key-entry operating properties with non-linear characteristics, similar to that established by a dome-shaped elastic actuating member in the conventional key switch, by using two plate springs 116 with linear characteristics. This is caused by the unique arrangements of these plate springs 116 which apply the biasing force to the first and second link members 96, 98 in a direction substantially orthogonal to the pushing-down direction of the key top 92. The operational principle of the key switch 90 is substantially the same as that described concerning the first embodiment, and thus is not repeated.

As described above, in the key switch 90, a dome-shaped elastic actuating member in the conventional key switch is omitted, and instead, two plate springs 116, which are not placed between the key top 92 and the membrane sheet 22 in the height direction of the key switch 90, are used as key top biasing means, so that it is made possible to significantly reduce the entire height of the key switch 90 upon both the inoperated and operated conditions thereof. Further, each plate spring 116 can establish the key-entry operating properties with non-linear characteristics, similar to that established by the conventional dome-shaped elastic actuating member, due to the arrangement of the plate spring 116, despite the plate spring 116 being a simple, linear characteristic spring, and therefore it is possible to reduce the production cost for the key switch 90 without deteriorating the operational feeling thereof.

Moreover, in the key switch 90, two plate springs 116 cooperate to bear the pushing-down force applied to the key top 92, so that the stress applied to each plate spring 116 can be attenuated. Accordingly, it is possible to prevent the plate spring 116 from being damaged, and to ease the design of the plate spring 116.

Figure 12:
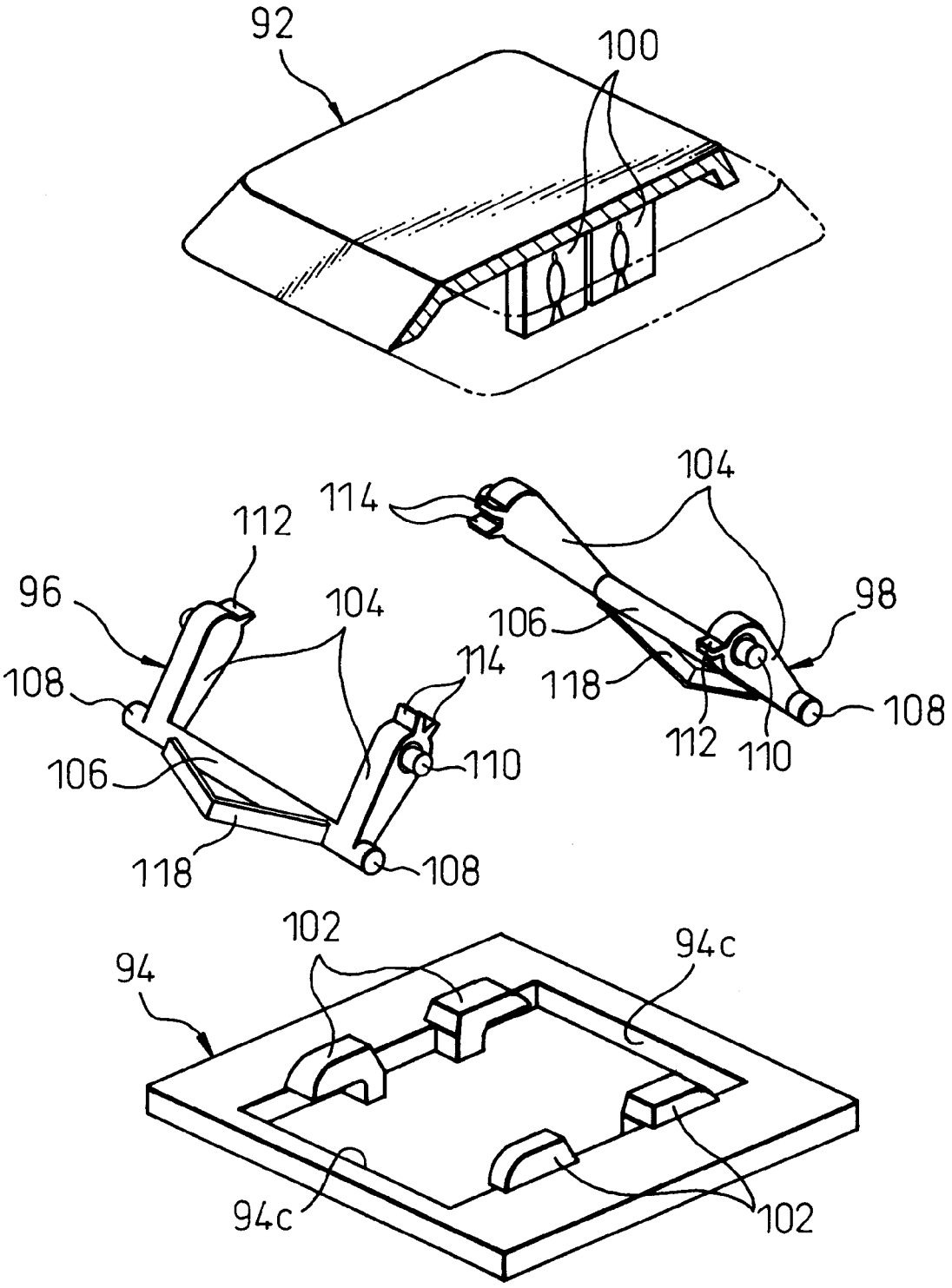
FIG. 12 is an exploded perspective view of a modification of the key switch shown in FIG. 10.

In the above third embodiment, the plate springs 116 are integrally joined to the inner edges 94*c* defining the center opening 95 of the base 94, but plate springs 118 may be modified and integrally joined to the first and second link members 96, 98, as shown in FIG. 12. In this modification, the plate springs 118 are integrally joined at one ends thereof in the neighborhood of the respective bars 106 of the first and second link members 96, 98, and are abutted at the other free ends thereof to the front and rear inner edges 94*c* of the base 94. It will be understood that this structure can also provide the effects equivalent to those of the embodiment shown in FIG. 10. Also, in this modification, the first and second link members 96, 98 may have a mutually identical structure, and thus it is possible to prevent the number of parts from being increased.

The plate springs 116 may be formed integrally with the base 94, both made from the same resinous material or the same metal. Alternatively, the metal plate springs 116 may be integrally joined to the resinous base 94 through an insert molding process. Also, the plate springs 118 may be formed integrally with the first and second link members 96, 98, both made from the same resinous material or the same metal. Alternatively, the metal plate springs 118 may be integrally joined to the resinous first and second link members 96, 98 through an insert molding process.

The other elastic members having linear characteristics, such as a compression coil spring, an extension coil spring, etc., may be used instead of the plate springs 116, 118. Further, in the above embodiment, two plate springs 116, 118 are arranged, one for each, between the base 94 and the respective loading portions or bars 106 of the first and second link members 96, 98, but instead, the elastic member having linear characteristics, such as a plate spring, may be disposed only between the base 94 and either one of the bars 106 of the first and second link members 96, 98. Alternatively, both the plate spring 116 joined to the base 94 and the plate spring 118 joined to the first or second link member 96, 98 may be incorporated together in the key switch 90.

Fourth Embodiment

Figure 13:
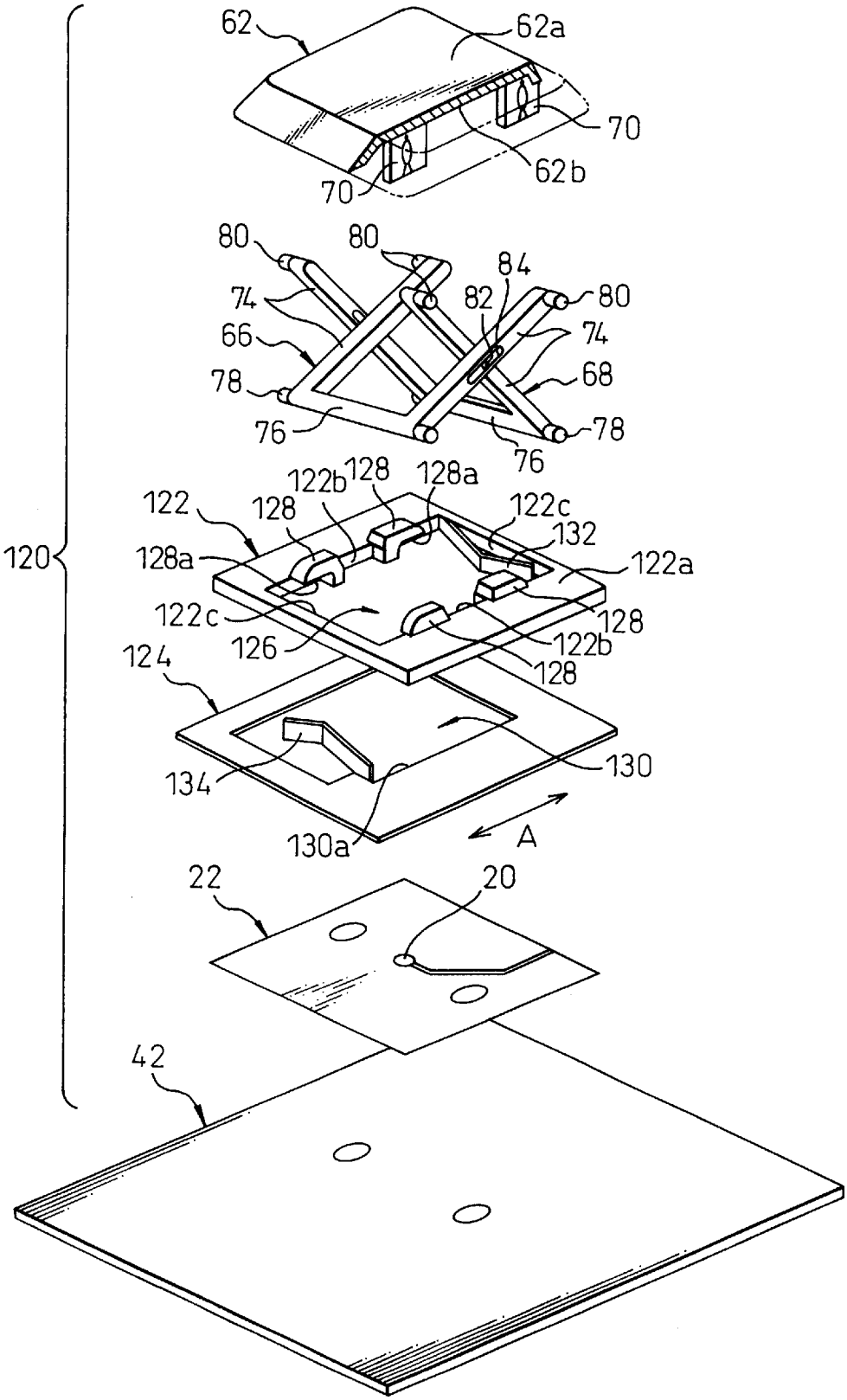
FIG. 13 is an exploded perspective view showing a fourth embodiment of a key switch according to the present invention.

FIG. 13 shows a key switch 120 according to a fourth embodiment of the present invention. The key switch 120 is preferably used in a relatively thin keyboard having an improved portability, in which the key top of each key switch is held in an initial projecting position for a key-entry operation during the operating state of the keyboard, while the key top is positively displaced to a retracted position lower than the initial position during the non-operating (or carrying) state of the keyboard.

The key switch 120 includes a key top 62 with an operation surface 62*a* adapted to be keyed by an operator's finger, a fixed base element 122 shaped as a rectangular frame and arranged beneath the key top 62, a pair of link members 66, 68 for supporting the key top 62 above a major surface 122*a* of the base element 122 and directing or guiding the key top 62 in a vertical or up-and-down direction, a movable base element 124 shaped as a rectangular frame and arranged under the fixed base element 122, a membrane sheet 22 provided with a membrane switch 20 and disposed under the movable base element 124, and a support plate 42 for stationary supporting the membrane sheet 22. The key top 62, the link members 66, 68, the membrane switch 20, the membrane sheet 22 and the support plate 42 have the same structures as those in the key switch 60 of the second embodiment shown in FIG. 6, and thus the detailed description thereof is not repeated.

The fixed base element 122 is a frame-like member having a generally rectangular profile, and includes a generally rectangular center opening 126 covered with the key top 62. The fixed base element 122 is provided, along opposed inner edges 122*b* thereof defining the center opening 126, with two pairs of slide supports 128, one pair being spaced from the other in a longitudinal or forward/backward direction, and two slide supports 128 in each pair being spaced from each other.

Each of the slide supports 128 disposed adjacent to the front end of the fixed base element 122 includes an L-shaped wall part projecting from the major surface 122*a* and the inner edge 122*b* of the fixed base element 122, and a bearing slot 128*a* extending generally parallel to the major surface 122*a* is formed inside the wall part. These front bearing slots 128*a* open to a front side, away from the rear slide supports 128, and to a bottom side of the fixed base element 122. Each of the slide supports 128 disposed adjacent to the rear end of the fixed base element 122 also includes an L-shaped wall part projecting from the major surface 122*a* and the inner edge 122*b* of the fixed base element 122, and a bearing slot 128*a* extending generally parallel to the major surface 122*a* is formed inside the wall part. These rear bearing slots 128*a* open to a rear side, away from the front slide supports 128, and to a bottom side of the fixed base element 122.

Two slide supports 128 of each pair are positioned on the opposed inner edges 122*b* of the fixed base element 122 in such a manner that the bearing slots 128*a* of respective slide supports 128 are aligned and faced with each other. Also, the slide supports 128 in a corresponding location between two pairs are substantially aligned with each other in a longitudinal or forward/backward direction on the inner edges 122*b* of the fixed base element 122.

The movable base element 124 is a frame-like member having a generally rectangular profile, and includes a generally rectangular center opening 130 substantially corresponding to the center opening 126 of the fixed base element 122. The movable base element 124 cooperates with the fixed base element 122 to serve as a base of the key switch 120. The movable base element 124 can be shifted in a forward/backward direction (shown by an arrow A) of the key switch 120 between the fixed base element 122 and the membrane sheet 22.

The key switch 120 further includes a pair of plate springs 132, 134 or elastic members, disposed between the fixed base element 122 and the first and second link members 66, 68, which act as biasing means for elastically urging upward the key top 62 away from the fixed base element 122. One plate spring 132 is integrally joined at one end thereof to a rear inner edge 122*c* of the fixed base element 122 opposite to the bearing slots 128*a* of the rear slide supports 128, and is abutted at the other free end thereof to the bar 76 of the second link member 68. The other plate spring 134 is integrally joined at one end thereof to an inner edge 130*a* of the movable base element 124 defining the center opening 130, and is abutted at the other free end thereof to the bar 76 of the first link member 66 while extending through the center opening 126 of the fixed base element 122.

The plate spring 134 joined to the movable base element 124 is located close to the front inner edge 122*c* of the fixed base element 122 opposite to the bearing slots 128*a* of the front slide supports 128. The plate springs 132, 134 act as compression springs between the inner edges 122*c* of the fixed base element 122 and the bars 76 of the first and second link members 66, 68, respectively.

As described above, in the fourth embodiment, the plate spring 134 disposed at the front side of the key switch 120 can be shifted together with the movable base element 124 in the forward/backward direction in relation to the fixed base element 122, which is a different structure from the key switch 60 of the second embodiment shown in FIG. 6. Consequently, in the key switch 120, it is possible to change the distance between the plate springs 132, 134, and thereby to displace the key top 62 between an initial projecting position and a retracted position during a non-operating condition, as described below.

When the movable base element 124 is located at the rear limit of movement thereof, the plate springs 132, 134 act in the same manner as the plate springs 86 shown in FIG. 7 to maintain the key switch 120 in a condition for a key-entry operation. That is, when no external force is applied to the key top 62, the plate springs 132, 134 urge or bias the bars 76 of the first and second link members 66, 68 toward backward and forward positions spaced from the front and rear inner edges 122*c* of the fixed base element 122, respectively, and support the bars 106 in these positions, as well as, through the mutually interlocked first and second link members 66, 68, urge or bias the key top 62 toward the initial position vertically upwardly away from the fixed base element 122 and support the key top 62 in this position.

Also, when the key top 62 is pushed down by a key-entry operation, the axles 78 of the first and second link members 66, 68 slidingly move frontward and rearward along the bearing slots 128*a* of the front and rear slide supports 128 of the fixed base element 122, respectively, and, simultaneously, the bars 76 shift toward the front and rear inner edges 122*c* of the fixed base element 122. During this operation, the plate springs 132, 134 are deformed while exerting biasing or elastic restoring force to the respective bars 76 (i.e., loading portions) of the first and second link members 66, 68 in a direction substantially orthogonal to the pushing-down direction of the key top 62.

When the pushing-down force to the key top 62 is released, the plate springs 132, 134 elastically restore to return the key top 62 to the initial position through the first and second link members 66, 68. In this respect, each of the plate springs 132, 134 is a linear characteristic spring of a simple structure, and thus exerts the biasing force, assuming a linear relationship with the shifting amount or displacement of the bar 76, onto each of the bars 76 of the first and second link members 66, 68. Preferably, the plate springs 132, 134 have shapes and characteristics identical to each other.

According to the key switch 120, it is possible to establish a key-entry operating properties with non-linear characteristics, similar to that established by a dome-shaped elastic actuating member in the conventional key switch, by using two plate springs 132, 134 with linear characteristics. This is caused by the unique arrangements of these plate springs 132, 134 which apply the biasing force to the first and second link members 66, 68 in a direction substantially orthogonal to the pushing-down direction of the key top 62. The operational principle of the key switch 120 is substantially the same as that described concerning the first embodiment, and thus is not repeated.

Then, the plate spring 134 is shifted frontward, by an actuating mechanism (not shown), together with the movable base element 124 to be located at the front limit of movement thereof. When the plate spring 134, which serves to support the first link member 66, is shifted frontward, the first and second link members 66, 68 are automatically folded-up due to their weight and of key top 62. As a result, the key top 62 is displaced to the retracted position lower than the initial position. In the retracted position, both the plate springs 132, 134 are kept free of any substantial elastic deformation.

The height of the key top 62 at the retracted position depends on the location of the front limit of movement of the movable base element 124. Therefore, in order to sufficiently lower the height of the key top 62 at the retracted position, it is preferred that the components of key switch 120 are dimensioned so that a sufficient gap is defined between the plate spring 134 and the front inner edge 122*c* of the fixed base element 122 when the movable base element 124 is placed at the rear limit of movement. Alternatively, the part of the fixed base element 122 including the front inner edge 122*c* may be removed or cut out, whereby the limit of movement of the movable base element 124 and thus the plate spring 134 can be enlarged frontward. Further, it is desired that, when the key top 62 is in the retracted position, the compression coil spring, provided on the inner surface 62*b* of the key top 62 as a membrane switch actuating member, is positioned so as not to push the membrane sheet 22.

As described above, in the key switch 120, a dome-shaped elastic actuating member in the conventional key switch is omitted, and instead, two plate springs 132, 134, which are not placed between the key top 62 and the membrane sheet 22 in the height direction of the key switch 120, are used as key top biasing means, so that it is made possible to significantly reduce the entire height of the key switch 120 upon both the inoperated and operated conditions thereof. Further, each plate spring 132, 134 can establish the key-entry operating properties with non-linear characteristics, similar to that established by the conventional dome-shaped elastic actuating member, due to the arrangement of the plate spring 132, 134, despite the plate spring 132, 134 being a simple, linear characteristic spring, and therefore it is possible to reduce the production cost for the key switch 120 without deteriorating the operational feeling thereof.

Moreover, in the key switch 120, two plate springs 132, 134 cooperate to bear the pushing-down force applied to the key top 62, so that the stress applied to each plate spring 132, 134 can be attenuated. Accordingly, it is possible to prevent the plate springs 132, 134 from being damaged, and to ease the design of the plate springs 132, 134.

Furthermore, if a keyboard is structured by incorporating therein a plurality of key switches 120, it is possible to hold the key top 62 of each key switch 120 in the initial projecting position for a key-entry operation through the first and second link members 66, 68 when the keyboard is to be used, by shifting the plate spring 134 together with the movable base element 124 to the rear limit of movement, and also to automatically displace the key top 62 of each key switch 120 into the retracted position making the key-entry operation impossible when the keyboard is not to be used, by shifting the plate spring 134 together with the movable base element 124 to the front limit of movement.

When the key top 62 is in the retracted position, only the link members 66, 68 and the compression coil spring are accommodated inside the key top 62, so that the dimension of the key top 62 can be decreased particularly in the height direction, in comparison with the conventional key switch using the dome-shaped elastic actuating member. Consequently, according to the key switch 120, it is possible to significantly reduce the entire height or thickness of the keyboard and can improve the portability thereof.

In the above fourth embodiment, the plate spring 132 may be formed integrally with the fixed base element 122, both made from the same resinous material or the same metal. Alternatively, the metal plate spring 132 may be integrally joined to the resinous fixed base element 122 through an insert molding process. Also, the plate spring 134 may be formed integrally with the movable base element 124 by stamping and bending a sheet metal material. The other elastic members having liner characteristics, such as a compression coil spring, an extension coil spring, etc., may be used instead of the plate springs 132, 134.

Further, in the above embodiment, two plate springs 132, 134 are arranged, one for each, between the fixed base element 122 and the respective loading portions or bars 76 of the first and second link members 66, 68, but instead, the elastic member having liner characteristics, such as a plate spring, may be disposed only between the fixed base element 122 and either one of the bars 76 of the first and second link members 66, 68. For example, if only the plate spring 132 is used, an upright wall for supporting the bar 76 of the first link member 66 may be formed integrally with the movable base element 124, instead of the plate spring 134. Moreover, contrary to the above embodiment, the rear plate spring 132 may be joined to the movable base element 124 and the front plate spring 134 may be joined to the fixed base element 122.

Fifth Embodiment

Figure 14:
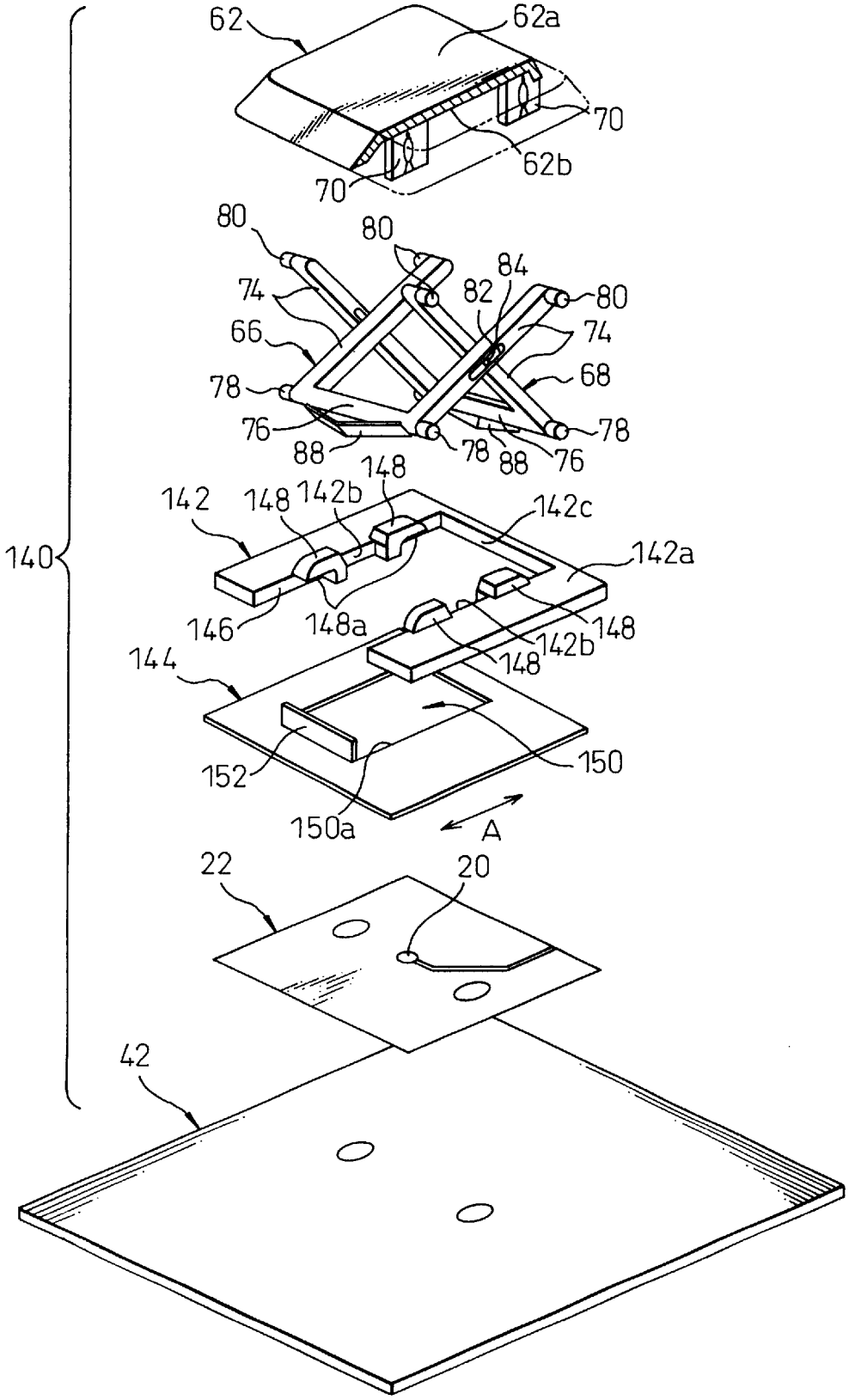
FIG. 14 is an exploded perspective view showing a fifth embodiment of a key switch according to the present invention.

FIG. 14 shows a key switch 140 according to a fifth embodiment of the present invention, which has a structure wherein a key top can be displaced to a retracted position when, e.g., a keyboard incorporating therein a plurality of key switches is not to be used.

The key switch 140 includes a key top 62 with an operation surface 62*a* adapted to be keyed by an operator's finger, a fixed base element 142 shaped as a generally rectangular frame lacking a front part thereof and arranged beneath the key top 62, a pair of link members 66, 68 for supporting the key top 62 above a major surface 142*a* of the base element 142 and directing or guiding the key top 62 in a vertical or going up and down direction, a movable base element 144 shaped as a rectangular frame and arranged under the fixed base element 142, a membrane sheet 22 provided with a membrane switch 20 and disposed under the movable base element 144, and a support plate 42 for stationary supporting the membrane sheet 22. The key top 62, the pair of link members 66, 68, the membrane switch 20, the membrane sheet 22 and the support plate 42 have the same structures as those in the modification of the second embodiment shown in FIG. 8, in which plate springs 88 are respectively joined to the link members 66, 68, and thus the detailed description thereof is not repeated.

The fixed base element 142 is a frame-like member having a generally rectangular profile, a front part of which is cut-out or removed, and includes a generally rectangular center opening 146 covered with the key top 62. The fixed base element 142 is provided, along opposed inner edges 142*b* thereof defining the center opening 146, with two pairs of slide supports 148, one pair being spaced from the other in a longitudinal or forward/backward direction, and two slide supports 148 in each pair being spaced from each other.

Each of the slide supports 148 disposed adjacent to the front end of the fixed base element 142 includes an L-shaped wall part projecting from the major surface 142*a* and the inner edge 142*b* of the fixed base element 142, and a bearing slot 148*a* extending generally parallel to the major surface 142*a* is formed inside the wall part. These front bearing slots 148*a* open to a front side, away from the rear slide supports 148, and to a bottom side of the fixed base element 142. Each of the slide supports 148 disposed adjacent to the rear end of the fixed base element 142 also includes an L-shaped wall part projecting from the major surface 142*a* and the inner edge 142*b* of the fixed base element 142, and a bearing slot 148*a* extending generally parallel to the major surface 142*a* is formed inside the wall part. These rear bearing slots 148*a* open to a rear side, away from the front slide supports 148, and to a bottom side of the fixed base element 142.

Two slide supports 148 of each pair are positioned on the opposed inner edges 142*b* of the fixed base element 142 in such a manner that the bearing slots 148*a* of respective slide supports 148 are aligned with and face each other. Also, the slide supports 148 in a corresponding location between two pairs are substantially aligned with each other in a longitudinal or forward/backward direction on the inner edges 142*b* of the fixed base element 142.

The movable base element 144 is a frame-like member having a generally rectangular profile, and includes a generally rectangular center opening 150 substantially corresponding to the center opening 146 of the fixed base element 142. The movable base element 144 cooperates with the fixed base element 142 to serve as a base of the key switch 140. The movable base element 144 is also provided with an upright wall 152 integrally joined to an inner edge 150*a* of the movable base element 144 defining the center opening 150. The upright wall 152 is located in the center opening 146 of the fixed base element 142 at a front side therein so as to be opposed to the rear inner edge 142*c* of the fixed base element 142.

The movable base element 144 can be shifted together with the upright wall 152 in a forward/backward direction (shown by an arrow A) of the key switch 140 between the fixed base element 142 and the membrane sheet 22. The plate springs 88 joined to the bars 76 of the first and second link members 66, 68 are respectively disposed between the upright wall 152 of the movable base element 144 and the bar 76 of the first link member 66, and between the rear inner edge 142*c* of the fixed base element 142 and the bar 76 of the second link member 68, so as to act as compression springs.

As described above, in the fifth embodiment, the plate spring 88 disposed at the front side of the key switch 140 is abutted to the upright wall 152 which can be shifted together with the movable base element 144 in the forward/backward direction in relation to the fixed base element 142, which is a different structure from the modification shown in FIG. 8. Consequently, in the key switch 140, it is possible to change the distance between front and rear wall surfaces onto which the plate springs 88 are respectively abutted, and thereby to displace the key top 62 between an initial projecting position and a retracted position during inoperating condition, as described below.

When the upright wall 152 is located together with the movable base element 144 at the rear limit of movement thereof, the plate springs 88 act in the same manner as the plate springs 86 shown in FIG. 7 to maintain the key switch 140 in a condition for a key-entry operation. That is, when no external force is applied to the key top 62, the plate springs 88 urge or bias the bars 76 of the first and second link members 66, 68 toward backward and forward positions spaced from the upright wall 152 of the movable base element 144 and the inner edge 142*c* of the fixed base element 142, respectively, and support the bars 106 in these positions, as well as, through the mutually interlocked first and second link members 66, 68, urging or biasing the key top 62 toward the initial position vertically upwardly away from the fixed base element 142 and supporting the key top 62 in this position.

Also, when the key top 62 is pushed down by a key-entry operation, the axles 78 of the first and second link members 66, 68 slidingly move frontward and rearward along the bearing slots 148*a* of the front and rear slide supports 148 of the fixed base element 142, respectively, and, simultaneously, the bars 76 shift toward the upright wall 152 of the movable base element 144 and the inner edge 142*c* of the fixed base element 142. During this operation, the plate springs 88 are deformed while exerting biasing or elastic restoring force to the respective bars 76 (i.e., loading portions) of the first and second link members 66, 68 in a direction substantially orthogonal to the pushing-down direction of the key top 62.

When the pushing-down force to the key top 62 is released, the plate springs 88 elastically restore to return the key top 62 to the initial position through the first and second link members 66, 68. In this respect, each of the plate springs 88 is a linear characteristics spring of a simple structure, and thus exerts the biasing force, assuming a linear relationship with the shifting amount or displacement of the bar 76, onto each of the bars 76 of the first and second link members 66, 68. Preferably, the plate springs 88 have shapes and characteristics, both identical to each other.

According to the key switch 140, it is possible to establish a key-entry operating properties with non-linear characteristics, similar to that established by a dome-shaped elastic actuating member in the conventional key switch, by using two plate springs 88 with linear characteristics. This is caused by the unique arrangements of these plate springs 88 which apply the biasing force to the first and second link members 66, 68 in a direction substantially orthogonal to the pushing-down direction of the key top 62. The operational principle of the key switch 140 is substantially the same as that described concerning the first embodiment, and thus is not repeated.

Then, the upright wall 152 is shifted frontward, by an actuating mechanism (not shown), together with the movable base element 144 to be located at the front limit of movement thereof. When the upright wall 152, which serves to support the plate spring 88 joined to the first link member 66, is shifted frontward, the first and second link members 66, 68 are automatically folded-up due to their weight and of key top 62. As a result, the key top 62 is displaced to the retracted position lower than the initial position. In the retracted position, both the plate springs 88 are kept free of any substantial elastic deformation.

The height of the key top 62 at the retracted position depends on the location of the front limit of movement of the upright wall 152 on the movable base element 144. The front limit of movement of the upright wall 152 may be determined by adding a base part having a front inner edge 142*c* onto the front side of the fixed base element 142. Further, it is desired that, when the key top 62 is in the retracted position, the compression coil spring, provided on the inner surface 62*b* of the key top 62 as a membrane switch actuating member, is positioned so as not yet to push the membrane sheet 22.

As described above, in the key switch 140, a dome-shaped elastic actuating member in the conventional key switch is omitted, and instead, two plate springs 88, which are not placed between the key top 62 and the membrane sheet 22 in the height direction of the key switch 140, are used as key top biasing means, so that it is made possible to significantly reduce the entire height of the key switch 140 upon both the inoperated and operated conditions thereof. Further, each plate spring 88 can establish the key-entry operating properties with non-linear characteristics, similar to that established by the conventional dome-shaped elastic actuating member, due to the arrangement of the plate spring 88, despite that the plate spring 88 is a simple, linear characteristic spring, and therefore it is possible to reduce the production cost for the key switch 140 without deteriorating the operational feeling thereof.

Moreover, in the key switch 140, two plate springs 88 cooperate to bear the pushing-down force applied to the key top 62, so that the stress applied to each plate spring 88 can be attenuated. Accordingly, it is possible to prevent the plate springs 88 from being damaged, and to ease the design of the plate springs 88.

Furthermore, if a keyboard is structured by incorporating therein a plurality of key switches 140, it is possible to hold the key top 62 of each key switch 140 in the initial projecting position for a key-entry operation through the first and second link members 66, 68 when the keyboard is to be used, by shifting the upright wall 152 together with the movable base element 144 to the rear limit of movement, and also to automatically displace the key top 62 of each key switch 140 into the retracted position making the key-entry operation impossible when the keyboard is not to be used, by shifting the upright wall 152 together with the movable base element 144 to the front limit of movement.

When the key top 62 is in the retracted position, only the pair of link members 66, 68 and the compression coil spring are accommodated inside the key top 62, so that the dimension of the key top 62 can be decreased particularly in the height direction, in comparison with the conventional key switch using the dome-shaped elastic actuating member. Consequently, according to the key switch 140, it is possible to significantly reduce the entire height or thickness of the keyboard and to improve the portability thereof.

Keyboard

Figure 15:
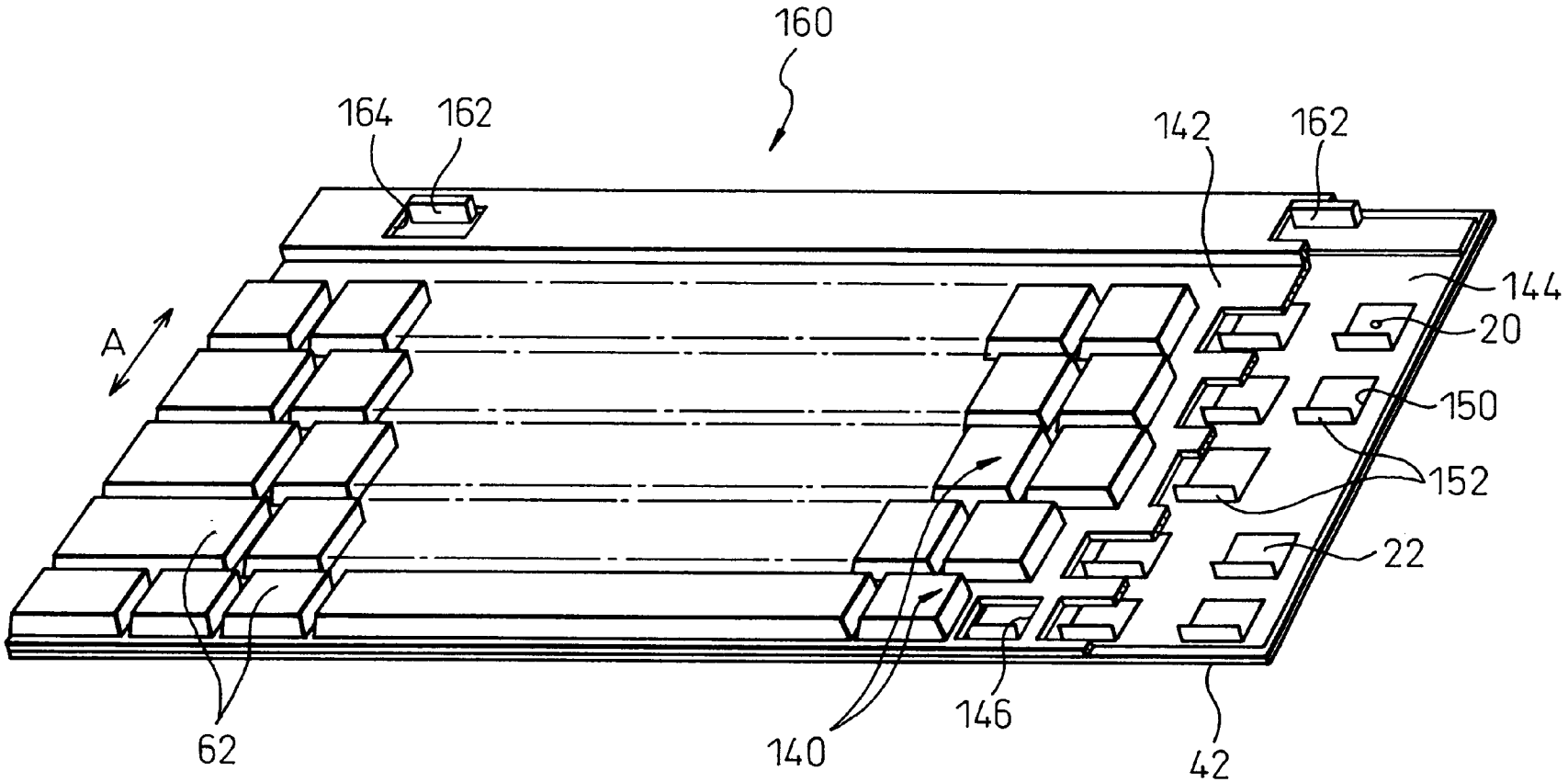
FIG. 15 is a partially cut-away perspective view showing one embodiment of a keyboard according to the present invention, which is provided with a plurality of key switches as shown in FIG. 14.

FIG. 15 shows a keyboard 160, according to one embodiment of the present invention, which incorporates therein a plurality of key switches 140. The keyboard 160 is provided, in a predetermined array, with numbers of key switches 140 including the key tops 62 of various dimensions.

The fixed base elements 142 of the key switches 140 are integrally connected with one another, so as to constitute a common large fixed base element 142' which extends over the generally entire area of the keyboard 160 and serves as an upper cover part of a housing of the keyboard 160. In the same manner, the movable base elements 144, the membrane sheets 22 and the support plates 42 of the key switches 140 are integrally connected respectively with one another, so as to constitute respective common large members 144', 22', 42' extending over the generally entire area of the keyboard 160. The center openings 146 of the fixed base elements 142, the center openings 150 and the upright walls 152 of the movable base elements 144, and the membrane switches 20 are arranged at locations corresponding to the respective key switches 140.

The common large movable base element 144' is provided in the rear end region of the upper surface thereof with two protrusions 162 spaced from each other. Also, the common large fixed base element 142' is provided in the rear end region thereof with two apertures 164 corresponding to the protrusions 162. Each protrusion 162 is inserted into each aperture 164 in such a manner as to be capable of shifting only in a forward/backward direction as shown by an arrow A. When the protrusions 162 are shifted in the apertures 164 in the forward/backward direction, the common large movable base element 144' is shifted together with all of the upright walls 152 in the forward/backward direction. Consequently, in all the key switches 140, the key tops 62 are displaced between the initial projecting positions for a key-entry operation and the retracted positions making the key-entry operation impossible, as former described.

The protrusions 162 of the common large movable base element 144' may be manually operated by an operator. Alternatively, if the keyboard 160 is incorporated in a portable electronic equipment including a foldable display unit, such as a notebook size personal computer, it is possible to design an automatic operation of the protrusions 162, which is interlocked with the open/close motion of the display unit above the keyboard 160. In this arrangement, a known transmission system can be used which transfers the rotation of a shaft caused due to the open/close motion of the display unit into forward/backward movement or linear motion of the common large movable base element 144'.

Modification

In the above fourth and fifth embodiments shown in FIGS. 13 and 14, one of the plate springs (i.e., the plate spring 134) for urging and supporting the key top 62 and the link members 66, 68, or one of the wall surfaces (i.e., the upright wall 152) onto which the one plate spring is abutted, is shifted in the forward/backward direction of the key switch 120, 140, that is, in a direction for changing a distance between the pair of plate springs or the pair of wall surfaces, and thereby the key top 62 is displaced between the initial projecting position and the retracted position.

In this arrangement, it is required to operate the movable base element 124, 144 in such a manner that the plate spring 134 or the upright wall 152 is correctly and repeatably returned to a predetermined operable position in the rear limit of movement, when the key switch is to be used and the key top 62 is to be held in the initial projecting position. This is because, if the plate spring 134 or the upright wall 152 is incorrectly returned to and thus more or less deviated from the predetermined operable position every time the key top 62 is displaced between the initial projecting position and the retracted position, the key-entry operation properties subtlety varies every time, and thus the operator senses incongruity.

Figure 16:
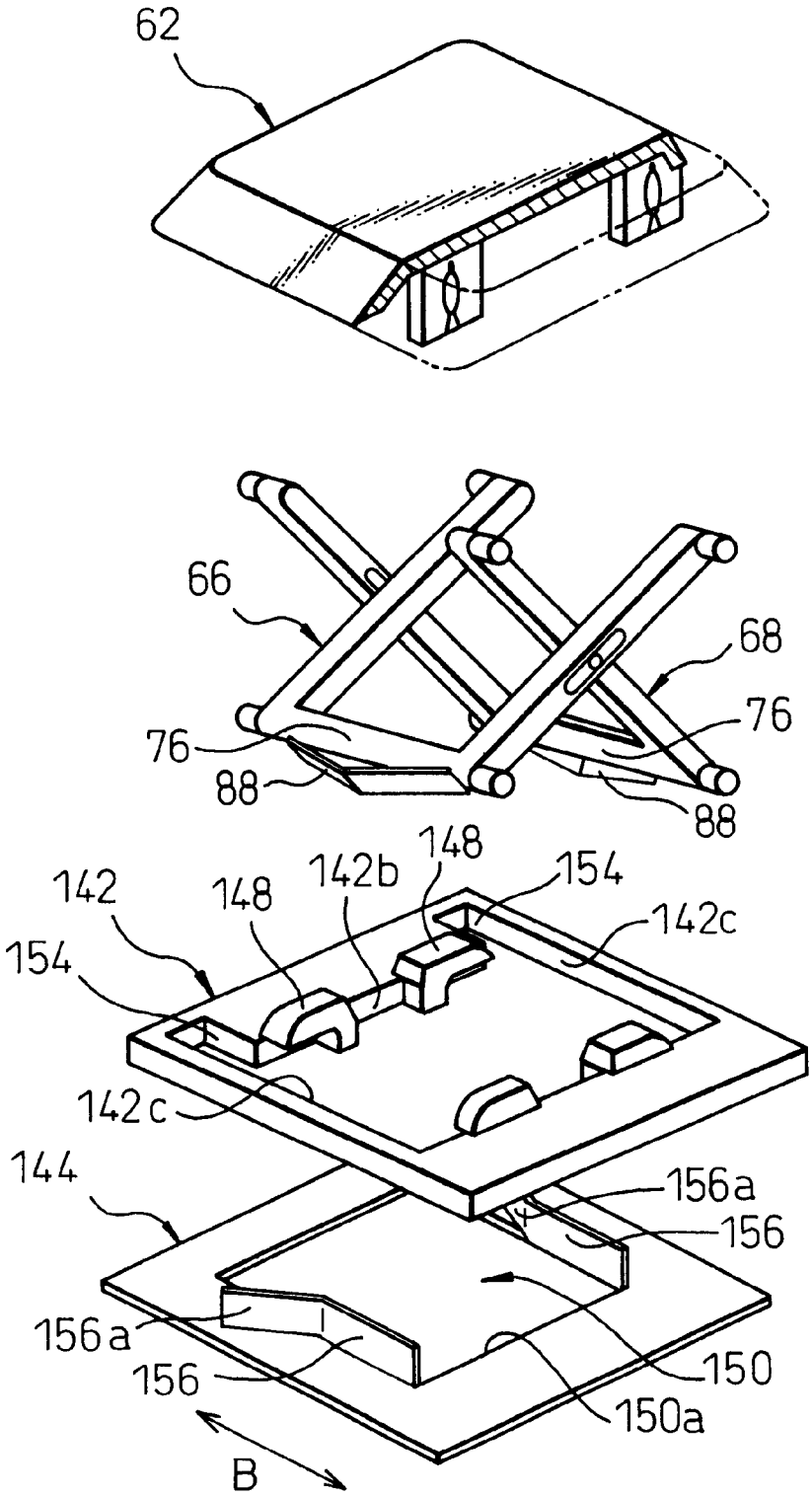
FIG. 16 is an exploded perspective view of a modification of the key switch shown in FIG. 14.

This problem is solved by an alternative arrangement where the plate spring 134 or the upright wall 152 is shifted in a lateral direction of the key switch 120, 140, that is, in a direction wherein the plate springs or the wall surfaces are relatively deviated from a face-to-face aligned state while being kept in parallel to each other, so as to displace the key top 62 between the initial projecting position and the retracted position. According to this alternative arrangement, the plate spring 134 or the upright wall 152 is permitted to be correctly and repeatably returned to the predetermined operable position, by a relatively easy operation. FIG. 16 shows a modification of the key switch 140 shown in FIG. 14, which is provided with this alternative arrangement.

In this modification, the fixed base element 142 is a frame-like member having a generally rectangular profile, and includes a pair of cutouts 154 formed as extensions of the generally rectangular center opening 146 and located adjacent respectively to the bearing slots 148*a* of the slide supports 148 on one inner edge 142*b*. On the other hand, the movable base element 144 is provided with a pair of upright walls 156 integrally joined to the inner edge 150*a* defining the center opening 150, so as to be located close to the front and rear inner edges 142*c* of the fixed base element 142 in the center opening 146. The movable base element 144 can be shifted together with the upright walls 156 in a lateral direction (shown by an arrow B) of the key switch 140 between the fixed base element 142 and the membrane sheet 22 (FIG. 14).

The upright walls 156 include main portions extending parallel to each other, and extensions 156*a* extending obliquely from the ends of the main portions to gradually expand the distance between the extensions 156*a*. Each cutout 154 formed on one inner edge 142*b* of the fixed base element 142 has a dimension and shape for receiving each extension 156*a*.

In the above structure, when the upright walls 156 are located together with the movable base element 144 at one limit of lateral movement thereof, the plate springs 88 joined to the first and second link members 66, 68 are respectively abutted and supported on the main portions of the upright walls 156. In this location, the extensions 156*a* of the upright walls 156 are received respectively in the cutouts 154 of the fixed base element 142. In this state, the plate springs 88 act in the same manner as the plate springs 86 shown in FIG. 7 to maintain the key switch 140 in a condition for a key-entry operation.

That is, when no external force is applied to the key top 62, the plate springs 88 urge or bias the key top 62 toward the initial position vertically upwardly away from the fixed base element 142 and support the key top 62 in this position, through the mutually interlocked first and second link members 66, 68. Also, when the key top 62 is pushed down by a key-entry operation, the bars 76 of the first and second link members 66, 68 shift toward the main portions of the upright walls 156 of the movable base element 144. During this operation, the plate springs 88 are deformed while exerting biasing or elastic restoring force to the respective bars 76 (i.e., loading portions) of the first and second link members 66, 68 in a direction substantially orthogonal to the pushing-down direction of the key top 62. When the pushing-down force to the key top 62 is released, the plate springs 88 elastically restore to return the key top 62 to the initial position through the first and second link members 66, 68.

Then, the upright walls 156 are shifted, by an actuating mechanism (not shown), together with the movable base element 144 to be located at the other limit of lateral movement thereof. Thereby, the plate springs 88 leave the main portions of the upright walls 156 and come into contact with the extensions 156*a* to be supported thereon. Finally, the plate springs 88 come to be out of supports of the upright walls 156. As a result, the first and second link members 66, 68 are automatically folded-up due to their weight and of the key top 62, so that the key top 62 is displaced to the retracted position lower than the initial position.

From this location, the upright walls 156 are shifted in a reverse direction together with the movable base element 144 so as to be relocated at one limit of lateral movement thereof. Thereby, the key top 62 is returned to the initial position through the plate springs 88 and the first and second link members 66, 68, and the key switch 140 recovers a condition for a key-entry operation. During this operation, the distance between the main portions of the upright walls 156 are kept in uniform, which enables the upright walls 156 to be correctly and repeatably positioned to the predetermined operable position in a relatively easy operation. Consequently, it is possible to effectively prevent the fluctuation of the key-entry operation properties of the key switch 140.

Sixth Embodiment

In the key switch 10, 60, 90, 120, 140 of any of the above embodiments, the plate spring 48, 50, 86, 88, 116, 118, 132, 134, as an elastic member for urging upward the key top 12, 62, 92 away from the base 14, 64, 94, 122, 142, exerts biasing force in a generally horizontal direction to the loading portion (the bar 34, 76, 106) which assumes a movement substantially identical to the movement of the sliding portion (the axle 36, 78, 108) of the link member 16, 66, 68, 96, 98 when the key top 12, 62, 92 goes up and down. The present invention is not limited to this construction, but can also provide an alternative construction, as described below, in which a plate spring, as an elastic member for urging upward a key top away from a base, exerts biasing force in a generally horizontal direction to a loading portion of a link member, which assumes a movement different from a movement of a sliding portion of the link member, when the key top goes up and down.

Figure 17:
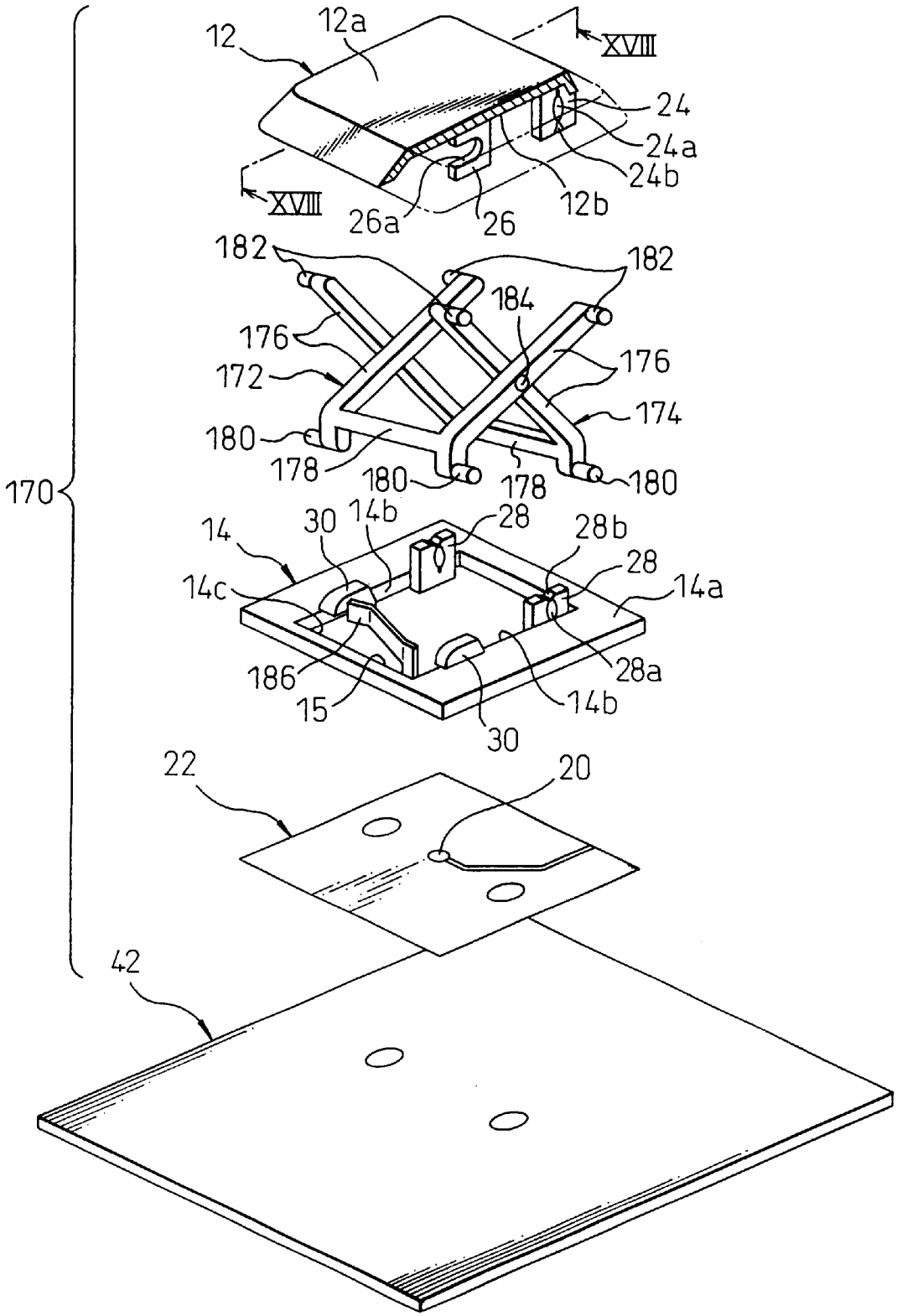
FIG. 17 is an exploded perspective view showing a sixth embodiment of a key switch according to the present invention.
Figure 18:
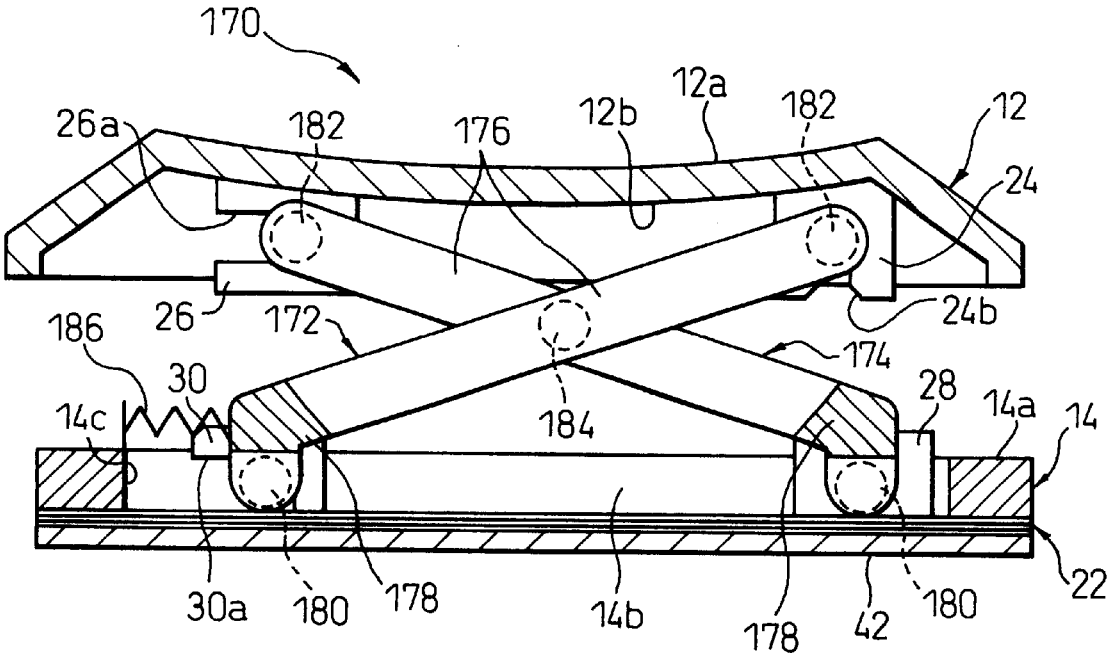
FIG. 18 is a sectional view of the key switch of FIG. 17 in an assembled state, taken along line XVIII—XVIII of FIG. 17.

FIGS. 17 and 18 show a key switch 170 according to a sixth embodiment of the present invention. The key switch 170 is one which includes the above-described alternative construction concerning the loading portion of a link member, and the remaining structure of the key switch 170 is substantially the same as that of the key switch 10 of the first embodiment. Therefore, the same or similar components are denoted by the common reference numerals, and a detailed description thereof is not repeated.

The key switch 170 includes a key top 12, a base 14 shaped as a rectangular frame and arranged beneath the key top 12, a pair of link members 172, 174 for supporting the key top 12 above a major surface 14*a* of the base 14 and directing or guiding the key top 12 in a vertical or up and down direction, a membrane sheet 22 provided with a membrane switch 20 and disposed under the base 14, and a support plate 42 for stationary supporting the membrane sheet 22.

The pair of link members 172, 174 are structured as a first link member 172 and a second link member 174, which have a mutually substantially identical shape, and which are assembled together so as to be provided with a generally X-shape in a side view. Each of the link members 172, 174 includes two arms 176 extending parallel to each other, and a bar 178 mutually connecting the arms 176 near one ends of the arms 176. Axles 180 are provided on one ends of the arms 176 to mutually coaxially project on the opposite sides to the bar 178. Axles 182 are provided on the other ends of the arms 176 to mutually coaxially project on the same sides as the axles 180.

The first and second link members 172, 174 are arranged to mutually intersect, and are pivotably connected relative to each other at an intersection thereof. More particularly, the first and second link members 172, 174 are pivotably connected with each other by pivots 184 provided at generally longitudinal centers of the respective pair of arms 176.

The axles 180 formed on one ends of the arms 176 of the first link member 172 are slidably fitted or received in the respective bearing slots 30*a* of the slide supports 30 on the base 14, and the axles 182 formed on the other ends of the arms 176 of the first link member 172 are pivotably fitted or received in the respective bearing holes 24*a* of the pivot supports 70 on the key top 12, whereby the first link member 172 is arranged between the key top 12 and the base 14 in such a manner as to be pivotable about the axles 182 on the key top 12.

The axles 180 formed on one ends of the arms 176 of the second link member 174 are pivotably fitted or received in the respective bearing holes 28*a* of the pivot supports 28 on the base 14, and the axles 182 formed on the other ends of the arms 176 of the second link member 174 are slidably fitted or received in the respective bearing slots 26*a* of the slide supports 26 on the key top 12, whereby the second link member 174 is arranged between the key top 12 and the base 14 in such a manner as to be pivotable about the axles 180 on the base 14.

The structure of the first and second link members 172, 174 described above substantially corresponds to the structure of the first and second link members 16, 18 of the key switch 10 of the first embodiment, except that, in each link member 172, 174, the bar 178 is formed at a position angularly displaced in certain angle relative to the axles 180 about the pivot 184. Therefore, in this embodiment, the axles 180 of the first link member 172 and the axles 182 of the second link member 174 constitute sliding portions of the respective link members 172, 174. The first and second link members 172, 174 are interlocked to each other through the pivots 184 so as to be synchronously pivotable, so that the key top 12 is permitted to be subjected to a parallel displacement in a substantially vertical direction in relation to the major surface 14*a* of the base 14, while keeping a predetermined posture of the key top 12 wherein the operation surface 12*a* thereof is generally parallel to the major surface 14*a*.

The key switch 170 further includes a plate spring 186 or an elastic member, disposed between the base 14 and the first link member 172, which acts as biasing means for elastically urging upward the key top 12 away from the base 14. As diagrammatically shown in FIG. 18, a plate spring 186 is integrally joined at one end thereof to a front inner edge 14*c* of the base 14 opposite to the bearing slots 30*a* of the slide supports 30, so as to extend above the major surface 14*a* of the base 14, and is abutted at the other free end thereof to the bar 178 of the first link member 172. The plate spring 186 acts as a compression spring between the base 14 and the bar 178 of the first link member 172.

When no external force is applied to the key top 12, the plate spring 186 urges or biases the bar 178 of the first link member 172 toward a backward position spaced from the front inner edge 14*c* of the base 14 and supports the bar 178 in this position, as well as, through the mutually interlocked first and second link members 172, 174, urges or biases the key top 12 toward the initial position vertically upwardly away from the base 14 and support the key top 12 in this position (see FIG. 18).

When the key top 12 is pushed down by a key-entry operation, the axles 180 of the first link member 172 slidingly move frontward along the bearing slots 30*a* of the slide supports 30 of the base 14 and, simultaneously, the bar 178 shifts toward the front inner edge 14*c* of the base 14. During this operation, the bar 178 assumes a movement different from a movement of the axles 180, because the bar 178 is formed at a position angularly displaced in certain angle relative to the axles 180 about the pivot 184. Then, the plate spring 186 is deformed while exerting biasing or elastic restoring force to the bar 178 (i.e., a loading portion) of the first link member 172 in a direction substantially orthogonal to the pushing-down direction of the key top 12.

When the pushing-down force to the key top 12 is released, the plate spring 186 elastically restores to return the key top 12 to the initial position through the first and second link members 172, 174. In this respect, the plate spring 186 is a linear characteristics spring of a simple structure, and thus exerts the biasing force, assuming a linear relationship with the shifting amount or displacement of the bar 178, onto the bar 178 of the first link member 172.

According to the key switch 170, it is possible to establish key-entry operating properties with non-linear characteristics, similar to that established by a dome-shaped elastic actuating member in the conventional key switch, by using the plate spring 186 with linear characteristics. This is caused by the unique arrangement of the plate spring 186 which applies the biasing force to the first link member 172 in a direction substantially orthogonal to the pushing-down direction of the key top 12. The operational principle of the key switch 170 is substantially the same as that described concerning the first to fifth embodiments with reference to FIGS. 4A to 4C.

Further, it should be noted that the key switch 170 can also provide advantageous effects as described later, because of the angularly displaced arrangement of the bar 178 (the loading portion) of the first link member 172 relative to the axles 180 (the sliding portion) thereof. The operational principle of the first link member 172 and the plate spring 186 is described below with reference to FIGS. 19A to 19C.

Figure 19A:
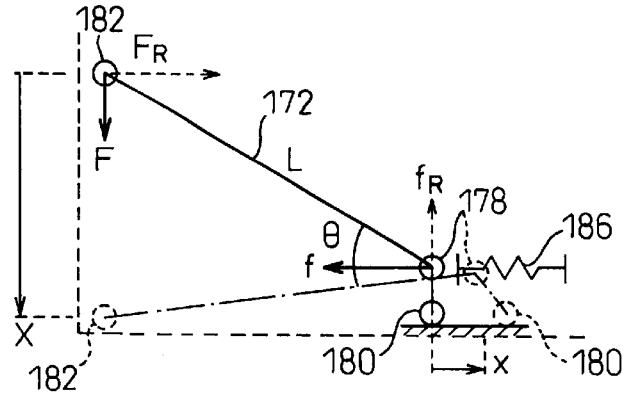
FIGS. 19A to 19C illustrate the principle of the key-entry operation properties of the key switch of FIG. 17.

FIG. 19A diagrammatically shows a constitution in which a link having a length "L" (the first link member 172) is obliquely arranged and a compression spring (the plate spring 186) is joined to a loading portion (the bar 178) near the bottom end of the link, and in which the top end (the axles 182) of the link is pushed down in a vertical downward direction. In this constitution, the reaction force "f" of the compression spring is applied to the loading portion of the link in a horizontal direction, in connection with the pushing-down force "F" applied to the top end of the link in the vertical downward direction. Please note here that:

$F=f\cdot\tan\theta$ ($\theta$ is a link angle);

$f=k\cdot x$ (k is a spring constant, x is a horizontal displacement of link loading portion);

$X=L(\sin\theta_0-\sin\theta)$ (X is a vertical displacement of link top end, $\theta_0$ is a link angle at f=0); and $x=-L\cdot(\cos\theta_0-\cos\theta)$.

In such a constitution of the key switch 170, it is possible to push down the axles 182 of top of the first link member 172 to a position lower than the bar 178 as the loading portion of the first link member 172. Then, the inventors of the present application numerically analyzed the parameter $-50\leqq\theta\leqq40°$ in accordance with the above principles, supposing that $\theta_0-400$, L=5 mm, k=120 gf/mm, so as to substantially equalize the downward stroke of the key top 12 or the axles 182 of top of the first link member 172 in the key switch 170 with the downward stroke of the key top 12 in the key switch 10 shown in FIG. 1, and compared the results thereof to the results of the analysis in relation to FIGS. 4A to 4C. The relationship, thus determined, between the vertical displacement "X" of the link top end and the pushing-down force "F" is shown by a solid line in FIG. 19B in which the curve shown in FIG. 4B is complementarily illustrated by a double dot chain line.

Figure 19B:
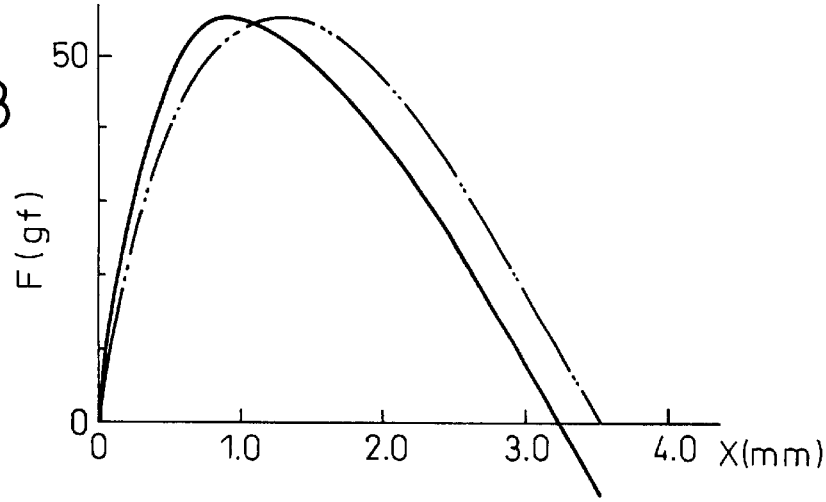

As illustrated, the similar characteristic curve was obtained, wherein, at the instant when the vertical displacement "X" of the link top end exceeds a predetermined value, the pushing-down force "F", which has been gradually increased until that time, is reduced to the contrary. In particular, as shown in FIG. 19B, the pushing-down force "F" applied to the link top end in the key switch 170 reaches a maximum value at the shorter vertical displacement "X" of the link top end than that in the first to fifth embodiments. Also, in an actual operation, the synthetic characteristic curve is obtained, as shown by a solid line in FIG. 19C in the same way as FIG. 4C, since the reaction force "R" due to the compression coil spring 46 acting as the actuating member for the membrane switch 20 is additionally exerted, after the key top 12 passes the predetermined pushed-down position.

In manufacturing the key switch according to the present invention, it is important, for stably and properly actuating the membrane switch, that the pushed-down position of the key top when the actuating member comes into contact with the membrane switch (i.e., upon starting to actuate the latter) is set at a location as high above the physical lowest position of the key top in the vertical stroke thereof (i.e., a location wherein the vertical displacement of the link top end is as short as possible). If, in the characteristic curve of FIG. 4C, the actuation starting position of the key top is set at a location "P" higher than a location shown in FIG. 4C, the variation of the resulted pushing-down force "F" to the link top end, between a first position of the key top wherein the pushing-down force "F" is maximum and the actuation starting position, is decreased (see FIG. 19C). As a result, it may become difficult to establish a key-entry operating properties similar to that established in the conventional key switch using a dome-shaped elastic actuating member.

Figure 19C:
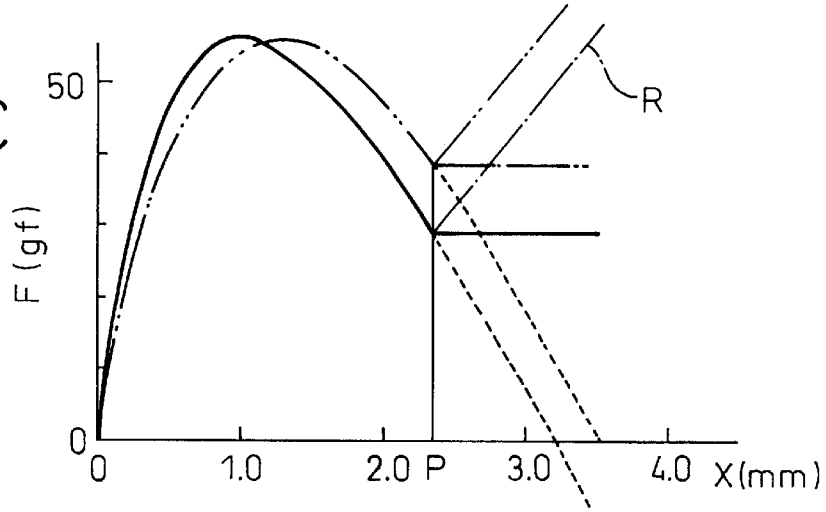

Contrary to this, in the characteristic curve (a solid line) of FIG. 19C, even if the actuation starting position of the key top is set at the above-mentioned location "P", it is possible to obtain the sufficient variation of the resulted pushing-down force "F" between the position wherein the pushing-down force "F" is maximum and the actuation starting position. Consequently, it is possible, in the key switch 170, to establish a key-entry operating properties with non-linear characteristics, similar to that established in the conventional key switch using a dome-shaped elastic actuating member.

Figure 20:
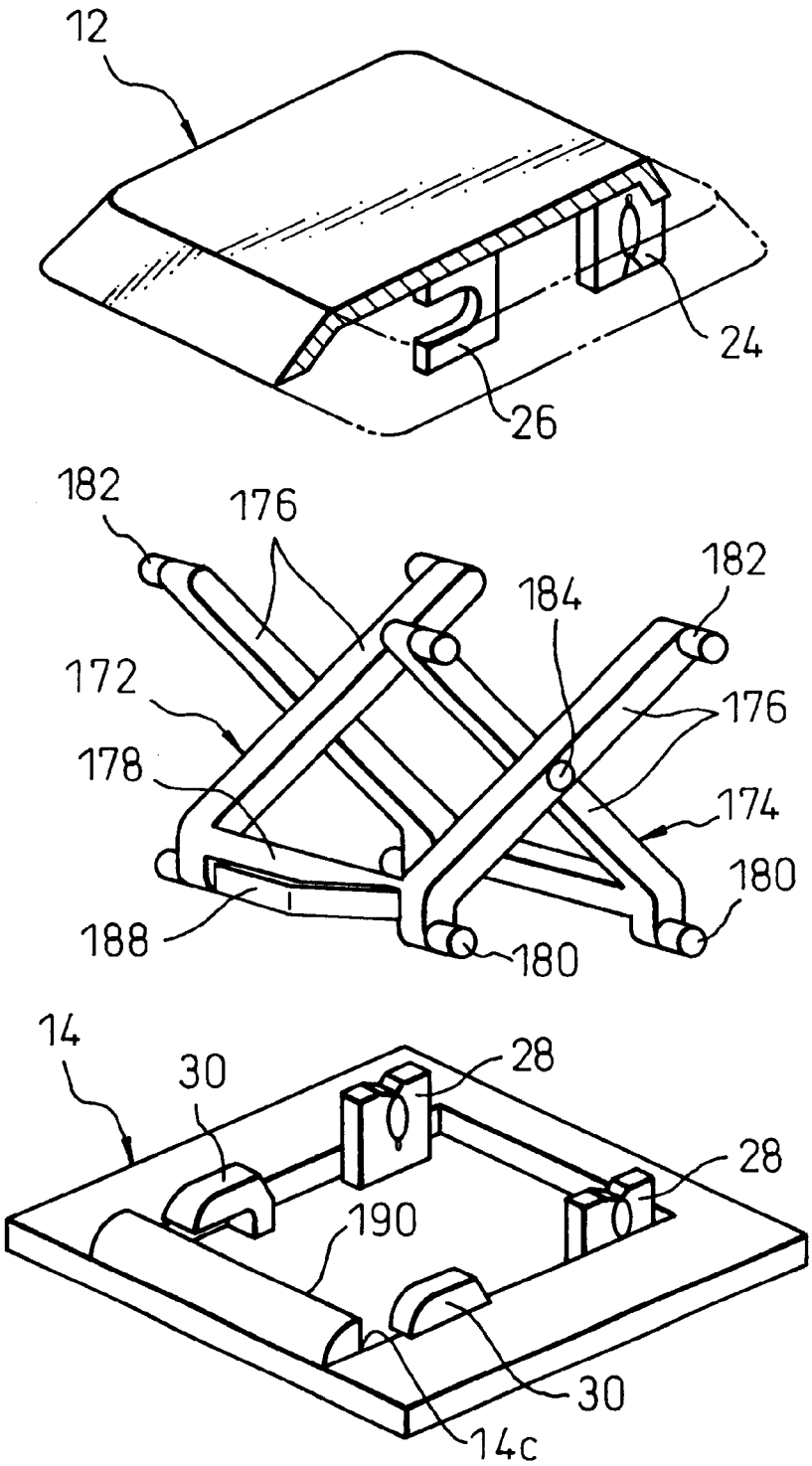
FIG. 20 is an exploded perspective view of a modification of the key switch shown in FIG. 17.

As will be appreciated, the key switch 170 can provide various effects essentially equivalent to those of the key switch 10 of the first embodiment. Also, in this embodiment, the plate spring 186 is integrally joined to the inner edge 14*c* of the base 14 defining the center opening 15, but a plate spring 188 may be used as a modification, which is integrally joined to the first link member 172, as shown in FIG. 20. In this modification, which corresponds to the modification shown in FIG. 5, the plate spring 188 is integrally joined at one end thereof to the neighbourhood of the bar 178 of the first link member 172, and is abutted at the other free end thereof to a wall 190 extending upward from the inner edge 14*c* of the base 14. The material, the manufacturing process, the arrangement, etc. of the plate spring 186, 188 may be variously selected, in the same way as the plate spring 48, 50 of the key switch 10.

Seventh Embodiment

Figure 21:
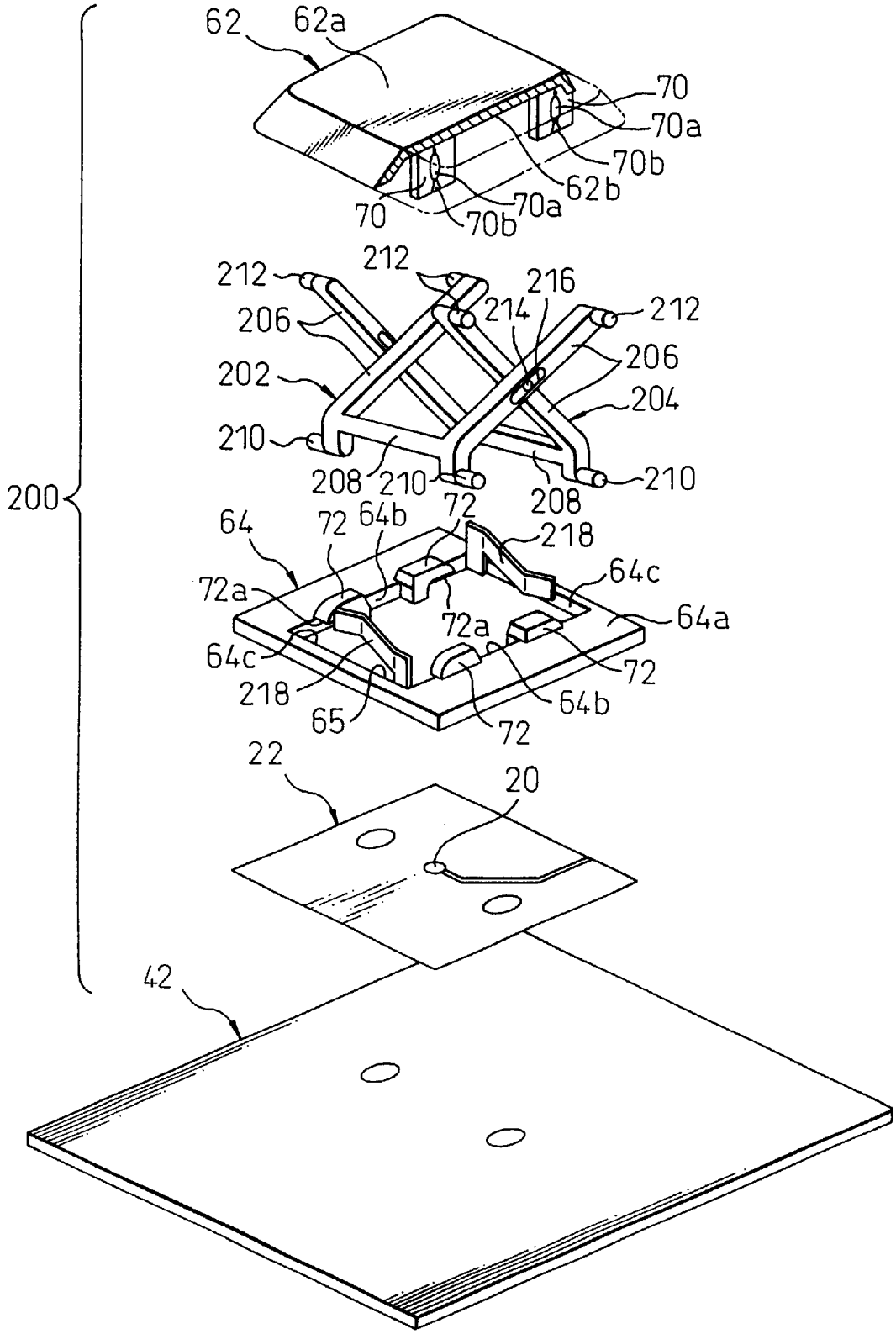
FIG. 21 is an exploded perspective view showing a seventh embodiment of a key switch according to the present invention.

FIG. 21 shows a key switch 200 according to a seventh embodiment of the present invention, which corresponds to the key switch 60 of the second embodiment shown in FIG. 6. The key switch 200 is one which includes the alternative construction concerning the loading portion of a link member, and the remaining structure of the key switch 200 is substantially the same as that of the key switch 60 of the second embodiment. Therefore, the same or similar components are denoted by the common reference numerals, and the detailed description thereof is not repeated.

The key switch 200 includes a key top 62, a base 64 shaped as a rectangular frame and arranged beneath the key top 62, a pair of link members 202, 204 for supporting the key top 62 above a major surface 64*a* of the base 64 and directing or guiding the key top 62 in a vertical or going up and down direction, a membrane sheet 22 provided with a membrane switch 20 and disposed under the base 64, and a support plate 42 for stationarily supporting the membrane sheet 22.

The pair of link members 202, 204 are structured as a first link member 202 and a second link member 204, which have a mutually substantially identical shape, and are assembled together so as to be provided with a generally X-shape in a side view. Each of the link members 202, 204 includes two arms 206 extending parallel to each other, and a bar 208 mutually connecting the arms 206 near one ends of the arms 206. Axles 210 are provided on one ends of the arms 206 to mutually coaxially project on the opposite sides to the bar 208. Axles 212 are provided on the other ends of the arms 206 to mutually coaxially project on the same sides as the axles 210.

The first and second link members 202, 204 are arranged to mutually intersect, and are pivotably and slidably connected relative to each other at an intersection thereof. More particularly, the first and second link members 202, 204 are pivotably and slidably connected with each other by respective interengagements between pivots 214 provided at generally longitudinal centers of one arms 206 of respective link members and elliptic holes 216 provided at generally longitudinal centers of the other arms 206 of respective link members.

The axles 210 formed on the ends of the arms 206 of the first link member 202 are slidably fitted or received in the respective bearing slots 72*a* of the front slide supports 72 on the base 64, and the axles 212 formed on the other ends of the arms 206 of the first link member 202 are pivotably fitted or received in the respective bearing holes 70*a* of the rear pivot supports 70 on the key top 62, whereby the first link member 202 is arranged between the key top 62 and the base 64 in such a manner as to be pivotable about the axles 212 on the key top 62.

The axles 210 formed on the ends of the arms 206 of the second link member 204 are slidably fitted or received in the respective bearing slots 72*a* of the rear slide supports 72 on the base 64, and the axles 212 formed on the other ends of the arms 206 of the second link member 204 are pivotably fitted or received in the respective bearing holes 70*a* of the front pivot supports 70 on the key top 62, whereby the second link member 204 is arranged between the key top 62 and the base 64 in such a manner as to be pivotable about the axles 212 on the key top 62.

The structure of the first and second link members 202, 204 described above substantially corresponds to the structure of the first and second link members 66, 68 of the key switch 60 of the second embodiment, except that, in each link member 202, 204, the bar 208 is formed at a position angularly displaced in certain angle relative to the axles 210 about the pivot 214. Therefore, in this embodiment, the axles 210 of the first link member 202 and the axles 210 of the second link member 204 constitute sliding portions of the respective link members 202, 204. The first and second link members 202, 204 are interlocked to each other through the slidable interengagements between the pivots 214 and the elliptic holes 216 so as to be synchronously pivotable, so that the key top 62 is permitted to be subjected to a parallel displacement in a substantially vertical direction in relation to the major surface 64*a* of the base 64, while keeping a predetermined posture of the key top 62 wherein the operation surface 62*a* thereof is generally parallel to the major surface 64*a*.

The key switch 200 further includes a pair of plate springs 218 or elastic members, disposed between the base 64 and the first and second link members 202, 204, which act as biasing means for elastically urging upward the key top 62 away from the base 64. One plate spring 218 is integrally joined at one end thereof to a front inner edge 64*c* of the base 64 opposite to the bearing slots 72*a* of the front slide supports 72, so as to extend above the major surface 64*a* of the base 64, and is abutted at the other free end thereof to the bar 208 of the first link member 202. The other plate spring 218 is integrally joined at one end thereof to a rear inner edge 64*c* of the base 64 opposite to the bearing slots 72*a* of the rear slide supports 72, so as to extend above the major surface 64*a* of the base 64, and is abutted at the other free end thereof to the bar 208 of the second link member 204. The plate springs 218 act as compression springs between the inner edges 64*c* of the base 64 and the bars 208 of the first and second link members 202, 204, respectively.

When no external force is applied to the key top 62, the plate springs 218 urge or bias the bars 208 of the first and second link members 202, 204 toward backward and forward positions spaced from the front and rear inner edges 64*c* of the base 64, respectively, and support the bars 208 in these positions, as well as, through the mutually interlocked first and second link members 202, 204, urging or biasing the key top 62 toward the initial position vertically upwardly away from the base 64 and supporting the key top 62 in this position.

When the key top 62 is pushed down by a key-entry operation, the axles 210 of the first and second link members 202, 204 slidingly move frontward and rearward along the bearing slots 72*a* of the front and rear slide supports 72 of the base 64, respectively, and, simultaneously, the bars 208 shift toward the front and rear inner edges 64*c* of the base 64. During this operation, the bars 208 assume a movement different from a movement of the axles 210, because the bars 208 are formed at positions angularly displaced at a certain angle relative to the axles 210 about the pivots 214. Then, the plate springs 218 are deformed while exerting biasing or elastic restoring force to the respective bars 208 (i.e., loading portions) of the first and second link members 202, 204 in a direction substantially orthogonal to the pushing-down direction of the key top 62.

When the pushing-down force to the key top 62 is released, the plate springs 218 elastically restore to return the key top 62 to the initial position through the first and second link members 202, 204. In this respect, each of the plate springs 218 is a linear characteristics spring of a simple structure, and thus exerts the biasing force, assuming a linear relationship with the shifting amount or displacement of the bar 208, onto each of the bars 208 of the first and second link members 202, 204. Preferably, the plate springs 218 have shapes and characteristics, both identical to each other.

According to the key switch 200, it is possible to establish key-entry operating properties with non-linear characteristics, similar to that established by a dome-shaped elastic actuating member in the conventional key switch, by using two plate springs 218 with linear characteristics. This is caused by the unique arrangements of these plate springs 218 which apply the biasing force to the first and second link members 202, 204 in a direction substantially orthogonal to the pushing-down direction of the key top 62. The operational principle of the key switch 200 is substantially the same as that described concerning the sixth embodiment.

Particularly, in the key switch 200, because of the angularly displaced arrangement of the bars 208 (the loading portions) of the first and second link members 202, 204 relative to the axles 210 (the sliding portions) thereof, it is possible to set the pushed-down position of the key top 62 upon starting to actuate the membrane switch 20 at a location as high as possible above the physical lowest position of the key top 62 in the vertical stroke thereof, while ensuring a key-entry operating properties with non-linear characteristics, similar to that established in the conventional key switch using a dome-shaped elastic actuating member.

Figure 22:
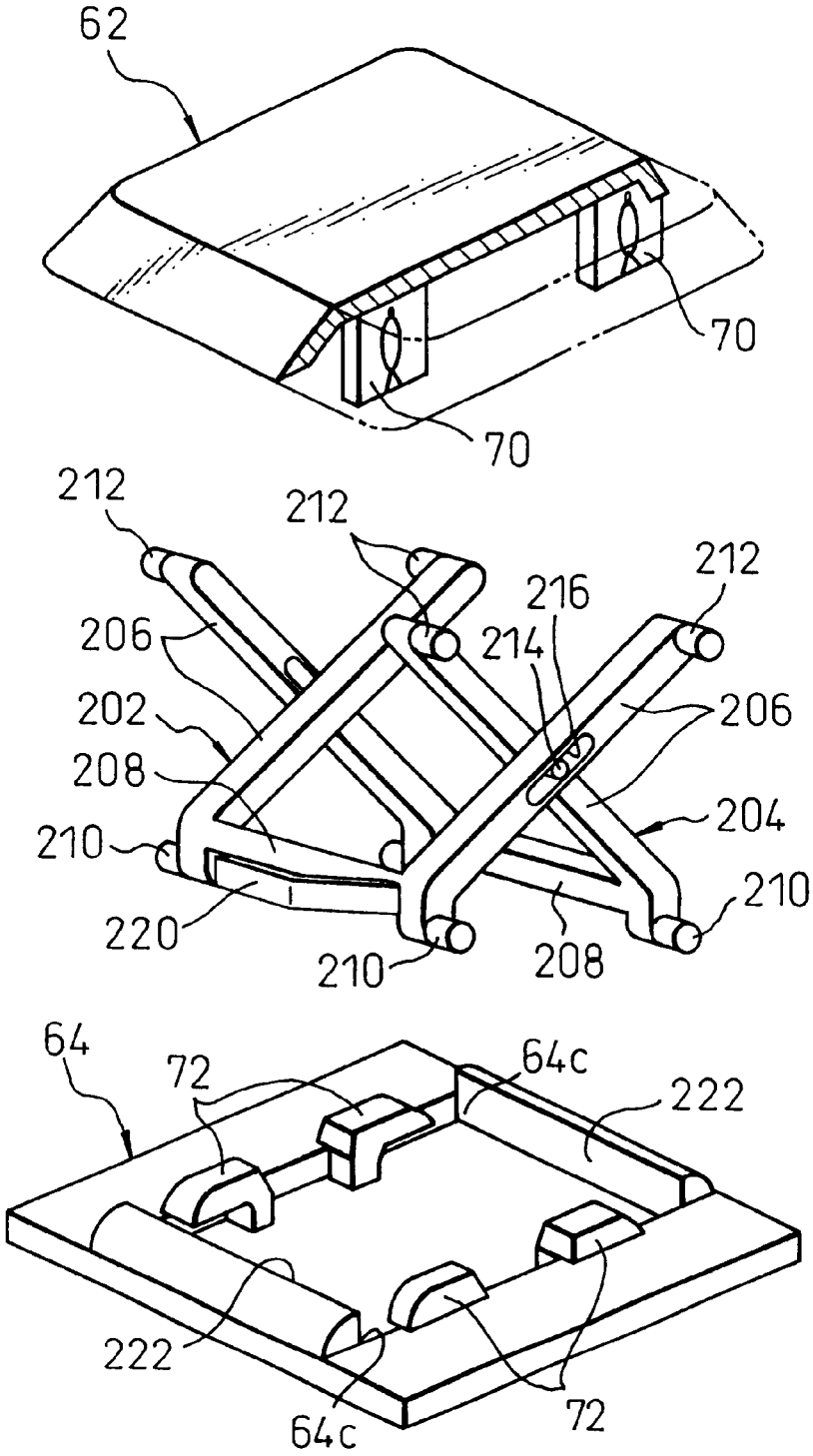
FIG. 22 is an exploded perspective view of a modification of the key switch shown in FIG. 21.

As will be appreciated, the key switch 200 can provide various effects essentially equivalent to those of the key switch 60 of the second embodiment. Also, in this embodiment, the plate springs 218 are integrally joined to the inner edges 64*c* of the base 64 defining the center opening 65, but plate springs 220 may be used as a modification, which are integrally joined to the first and second link members 202, 204, respectively, as shown in FIG. 22. In this modification, which corresponds to the modification shown in FIG. 8, the plate springs 220 are integrally joined at the ends thereof to the neighbourhood of the bars 208 of the first and second link members 202, 204, and are abutted at the other free ends thereof to walls 222 extending upward from the front and rear inner edges 64*c* of the base 64, respectively. The material, the manufacturing process, the arrangement, etc. of each plate spring 218, 220 may be variously selected, in the same way as each plate spring 86, 88 of the key switch 60.

Eighth Embodiment

Figure 23:
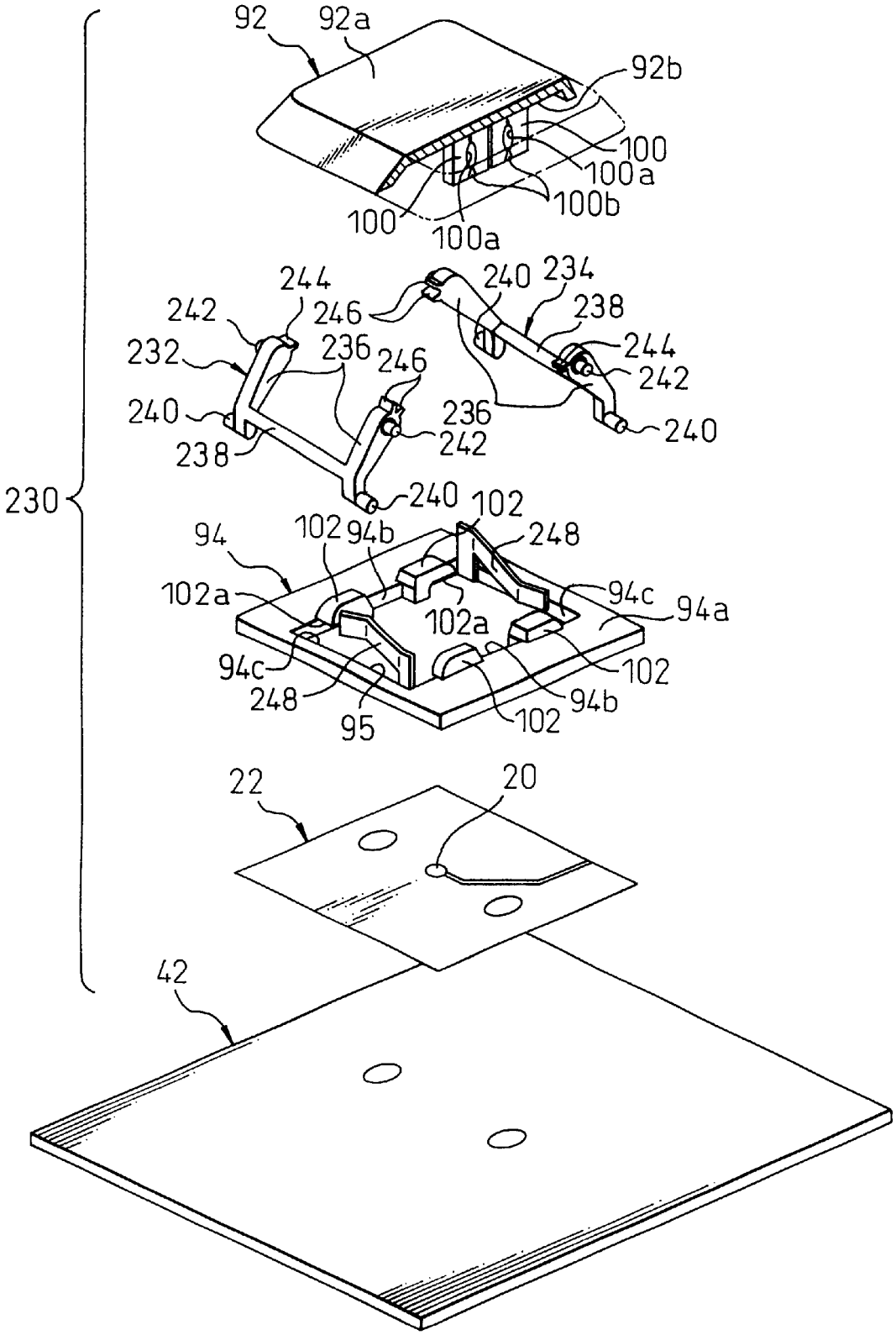
FIG. 23 is an exploded perspective view showing an eighth embodiment of a key switch according to the present invention.

FIG. 23 shows a key switch 230 according to an eighth embodiment of the present invention, which corresponds to the key switch 90 of the third embodiment shown in FIG. 10. The key switch 230 is one which includes the alternative construction concerning the loading portion of a link member, and the remaining structure of the key switch 230 is substantially the same as that of the key switch 90 of the third embodiment. Therefore, the same or similar components are denoted by the common reference numerals, and the detailed description thereof is not repeated.

The key switch 230 includes a key top 92, a base 94 shaped as a rectangular frame and arranged beneath the key top 92, a pair of link members 232, 234 for supporting the key top 92 above a major surface 94*a* of the base 94 and directing or guiding the key top 92 in a vertical or going up and down direction, a membrane sheet 22 provided with a membrane switch 20 and disposed under the base 94, and a support plate 42 for stationary supporting the membrane sheet 22.

The pair of link members 232, 234 are structured as a first link member 232 and a second link member 234, which have a mutually substantially identical shape, and which are assembled together so as to be provided with a generally reverse V-shape in a side view. Each of the link members 232, 234 includes two arms 236 extending parallel to each other, and a bar 238 mutually connecting the arms 236 near one ends of the arms 236. Axles 240 are provided on the ends of the arms 236 to mutually coaxially project on the opposite sides to the bar 238. Axles 242 are provided on the other ends of the arms 236 to mutually coaxially project on the same sides as the axles 240.

The first and second link members 232, 234 are meshed with each other at a toothed end of each link member 232, 234. More particularly, the first and second link members 232, 234 are pivotably connected with each other by intermeshings between respective one tooth 244 projecting from the distal ends, near the axles 242, of one arms 236 of respective link members and respective two teeth 246 projecting from the distal ends, near the axles 242, of the other arms 236 of respective link members.

The axles 240 formed on one ends of the arms 236 of the first link member 232 are slidably fitted or received in the respective bearing slots 102*a* of the front slide supports 102 on the base 94, and the axles 242 formed on the other ends of the arms 236 of the first link member 232 are pivotably fitted or received in the respective bearing holes 100*a* of the front pivot supports 100 on the key top 92, whereby the first link member 232 is arranged between the key top 92 and the base 94 in such a manner as to be pivotable about the axles 242 on the key top 92.

The axles 240 formed on the ends of the arms 236 of the second link member 234 are slidably fitted or received in the respective bearing slots 102*a* of the rear slide supports 102 on the base 94, and the axles 242 formed on the other ends of the arms 236 of the second link member 234 are pivotably fitted or received in the respective bearing holes 100*a* of the rear pivot supports 100 on the key top 92, whereby the second link member 234 is arranged between the key top 92 and the base 94 in such a manner as to be pivotable about the axles 242 on the key top 92.

The structure of the first and second link members 232, 234 described above substantially corresponds to the structure of the first and second link members 96, 98 of the key switch 90 of the third embodiment, except that, in each link member 232, 234, the bar 238 is formed at a position angularly displaced in certain angle relative to the axles 240 about the mutually intermeshed teeth 244, 246. Therefore, in this embodiment, the axles 240 of the first link member 232 and the axles 240 of the second link member 234 constitute sliding portions of the respective link members 232, 234. The first and second link members 232, 234 are interlocked to each other through the intermeshings between the one tooth 112 and the two teeth 114 so as to be synchronously pivotable, so that the key top 92 is permitted to be subjected to a parallel displacement in a substantially vertical direction in relation to the major surface 94*a* of the base 94, while keeping a predetermined posture of the key top 92 wherein the operation surface 92*a* thereof is generally parallel to the major surface 94*a*.

The key switch 230 further includes a pair of plate springs 248 or elastic members, disposed between the base 94 and the first and second link members 232, 234, which act as biasing means for elastically urging upward the key top 92 away from the base 94. One plate spring 248 is integrally joined at one end thereof to a front inner edge 94*c* of the base 94 opposite to the bearing slots 102*a* of the front slide supports 102, so as to extend above the major surface 94*a* of the base 94, and is abutted at the other free end thereof to the bar 238 of the first link member 232. The other plate spring 248 is integrally joined at one end thereof to a rear inner edge 94*c* of the base 94 opposite to the bearing slots 102*a* of the rear slide supports 102, so as to extend above the major surface 94*a* of the base 94, and is abutted at the other free end thereof to the bar 238 of the second link member 234. The plate springs 248 act as compression springs between the inner edges 94*c* of the base 94 and the bars 238 of the first and second link members 232, 234, respectively.

When no external force is applied to the key top 92, the plate springs 248 urge or bias the bars 238 of the first and second link members 232, 234 toward backward and forward positions spaced from the front and rear inner edges 94*c* of the base 94, respectively, and support the bars 238 in these positions, as well as, through the mutually interlocked first and second link members 232, 234, urging or biasing the key top 92 toward the initial position vertically upwardly away from the base 94 and supporting the key top 92 in this position.

When the key top 92 is pushed down by a key-entry operation, the axles 240 of the first and second link members 232, 234 slidingly move frontward and rearward along the bearing slots 102*a* of the front and rear slide supports 102 of the base 94, respectively, and, simultaneously, the bars 238 shift toward the front and rear inner edges 94*c* of the base 94. During this operation, the bars 238 assume a movement different from a movement of the axles 240, because the bars 238 are formed at positions angularly displaced at a certain angle relative to the axles 240 about the mutually intermeshed teeth 244, 246. Then, the plate springs 248 are deformed while exerting biasing or elastic restoring force to the respective bars 238 (i.e., loading portions) of the first and second link members 232, 234 in a direction substantially orthogonal to the pushing-down direction of the key top 92.

When the pushing-down force to the key top 92 is released, the plate springs 248 elastically restore to return the key top 92 to the initial position through the first and second link members 232, 234. In this respect, each of the plate springs 248 is a linear characteristic spring of a simple structure, and thus exerts the biasing force, assuming a linear relationship with the shifting amount or displacement of the bar 238, onto each of the bars 238 of the first and second link members 232, 234. Preferably, the plate springs 248 have shapes and characteristics identical to each other.

According to the key switch 230, it is possible to establish a key-entry operating properties with non-linear characteristics, similar to that established by a dome-shaped elastic actuating member in the conventional key switch, by using two plate springs 248 with linear characteristics. This is caused by the unique arrangements of these plate springs 248 which apply the biasing force to the first and second link members 232, 234 in a direction substantially orthogonal to the pushing-down direction of the key top 92. The operational principle of the key switch 230 is substantially the same as that described concerning the sixth embodiment.

Particularly, in the key switch 230, because of the angularly displaced arrangement of the bars 238 (the loading portions) of the first and second link members 232, 234 relative to the axles 240 (the sliding portions) thereof, it is possible to set the pushed-down position of the key top 92 upon starting to actuate the membrane switch 20 at a location as high as possible above the physical lowest position of the key top 92 in the vertical stroke thereof, while ensuring a key-entry operating properties with non-linear characteristics, similar to that established in the conventional key switch using a dome-shaped elastic actuating member.

Figure 24:
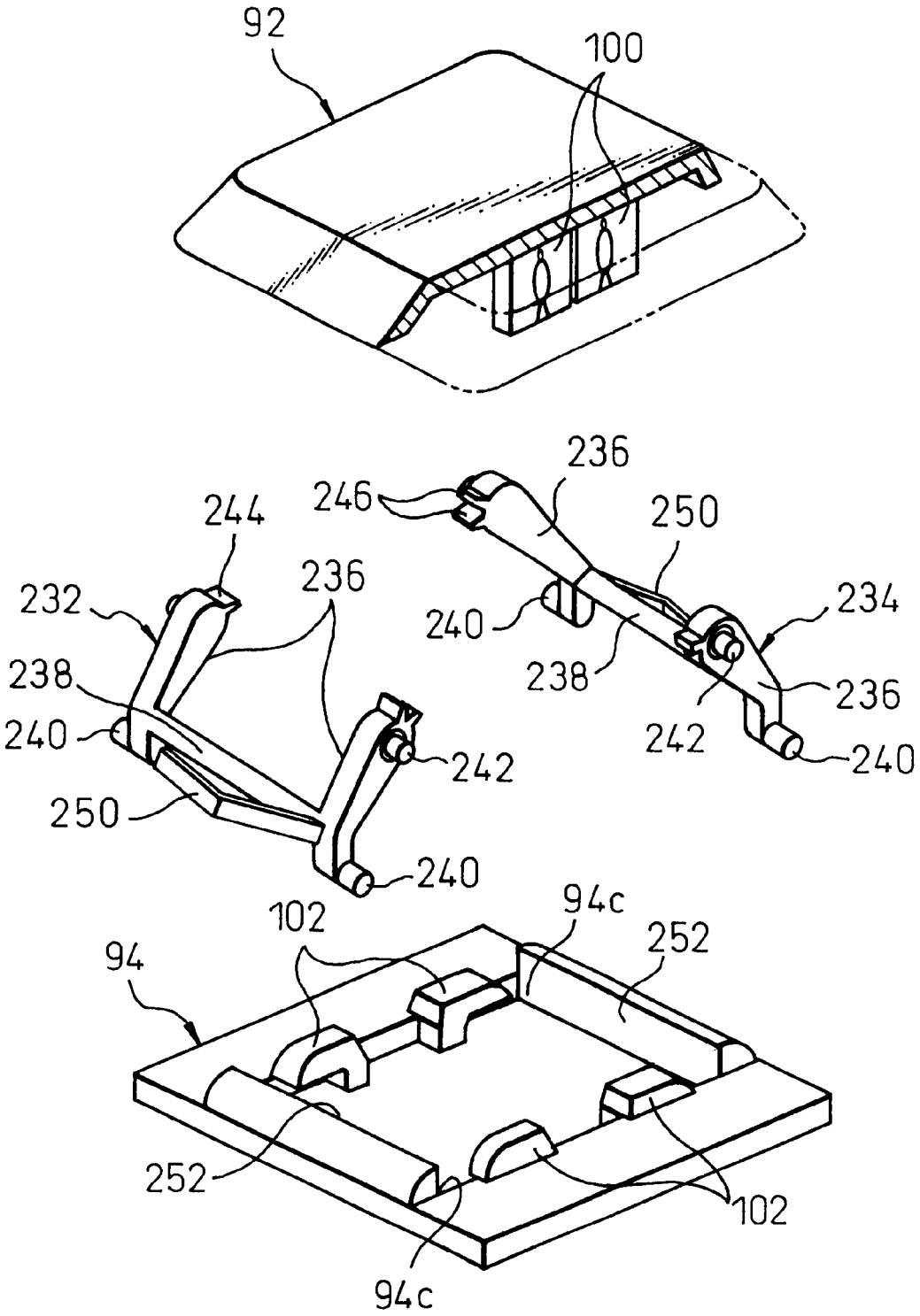
FIG. 24 is an exploded perspective view of a modification of the key switch shown in FIG. 23.

As will be appreciated, the key switch 230 can provide various effects essentially equivalent to those of the key switch 90 of the third embodiment. Also, in this embodiment, the plate springs 248 are integrally joined to the inner edges 94*c* of the base 94 defining the center opening 95, but plate springs 250 may be used as a modification, which are integrally joined to the first and second link members 232, 234, respectively, as shown in FIG. 24. In this modification, which corresponds to the modification shown in FIG. 12, the plate springs 250 are integrally joined at one ends thereof to the neighbourhood of the bars 238 of the first and second link members 232, 234, and are abutted at the other free ends thereof to walls 252 extending upward from the front and rear inner edges 94*c* of the base 94, respectively. The material, the manufacturing process, the arrangement, etc. of each plate spring 248, 250 may be variously selected, in the same way as each plate spring 116, 118 of the key switch 90.

Ninth Embodiment

Figure 25:
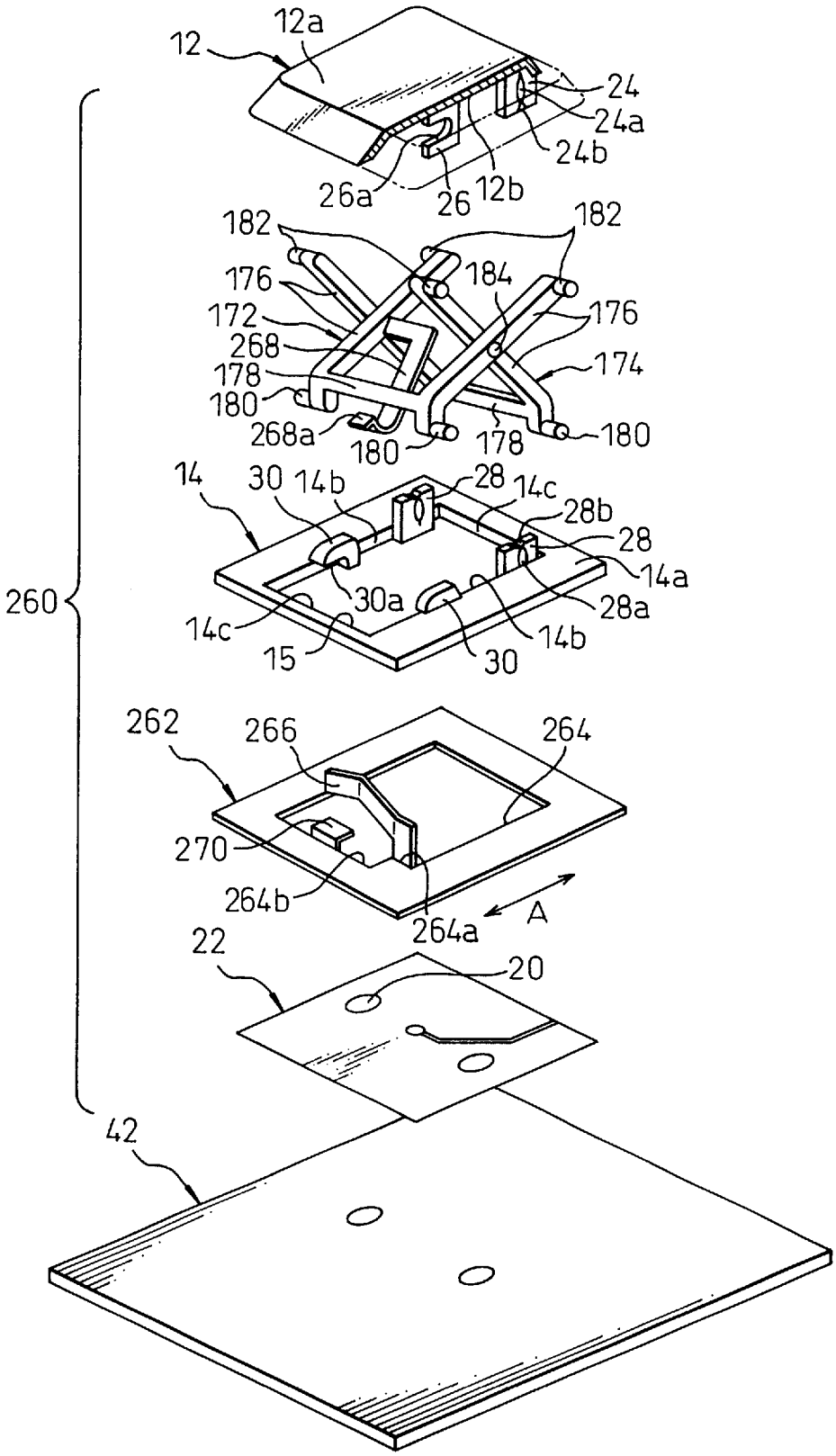
FIG. 25 is an exploded perspective view showing a ninth embodiment of a key switch according to the present invention.

The above alternative construction wherein the loading portion of the link member, onto which the biasing force of the elastic member is exerted, is formed at a position angularly displaced relative to the sliding portion of the link member, may also be applied to the key switch including a movable base element arranged under a fixed base element, as shown in FIGS. 13 to 16. FIG. 25 shows a key switch 260 including such a movable base element, according to a ninth embodiment of the present invention. The key switch 260 is preferably used in a relatively thin keyboard having an improved portability, in which the key top of each key switch is held in an initial projecting position for a key-entry operation during the operating state of the keyboard, while the key top is positively displaced to a retracted position lower than the initial position during the inoperating (or carrying) state of the keyboard.

The key switch 260 includes a key top 12 with an operation surface 12*a* adapted to be keyed by an operator's finger, a fixed base element 14 (hereinafter referred to as a base 14) shaped as a rectangular frame and arranged beneath the key top 12, a pair of link members 172, 174 for supporting the key top 12 above a major surface 14*a* of the base 14 and directing or guiding the key top 12 in a vertical or up-and-down direction, a movable base element 262 shaped as a rectangular frame and arranged under the base 14, a membrane sheet 22 provided with a membrane switch 20 and disposed under the movable base element 262, and a support plate 42 for supporting the membrane sheet 22. The key top 12, the base 14, the link members 172, 174, the membrane switch 20, the membrane sheet 22 and the support plate 42 have substantially the same structures as those in the key switch 170 of the sixth embodiment shown in FIG. 17, and thus the detailed description thereof is not repeated.

The movable base element 262 is a frame-like member having a generally rectangular profile, and includes a generally rectangular center opening 264 substantially corresponding to the center opening 15 of the base 14. The movable base element 262 cooperates with the base 14 (i.e., the fixed base element) to serve as a base of the key switch 260. The movable base element 262 can be shifted in a forward/backward direction (shown by an arrow A) of the key switch 260 between the base 14 and the membrane sheet 22.

The key switch 260 further includes a plate spring 266 or an elastic member, disposed between the movable base element 262 and the first link member 172, which acts as biasing means for elastically urging upward the key top 12 away from the base 14. The plate spring 266 is integrally joined at one end thereof to an inner edge 264*a* defining the center opening 264 of the movable base element 262, so as to be arranged near the front inner edge 14*c* of the base 14 opposite to the bearing slots 30*a* of the slide supports 30, and extends at the other free end thereof through the center opening 15 of the base 14 to project above the major surface 14*a*, so as to be abutted to the bar 178 of the first link member 172.

The plate spring 266 joined to the movable base element 262 is capable of being shifted together with the movable base element 262 in the forward/backward direction in relation to the base 14, and, in connection with the shifted position thereof, optionally acts as a compression spring between the base (i.e., the base 14 and the movable base element 262) and the bar 178 of the first link member 172. Therefore, in the key switch 260, it is possible to change the distance between the plate spring 266 and the rear inner edge 14*c* of the base 14, and thereby to displace the key top 12 between an initial projecting position and a retracted position during inoperating condition, as described below.

When the movable base element 262 is located at the rear limit of movement thereof, the plate spring 266 acts in the same manner as the plate spring 186 shown in FIG. 17 to maintain the key switch 260 in a condition for a key-entry operation. In this respect, the plate spring 266 is a linear characteristics spring of a simple structure, and thus exerts the biasing force, assuming a linear relationship with the shifting amount or displacement of the bar 178, onto the bar 178 of the first link member 172.

Then, the plate spring 266 is shifted frontward, by an actuating mechanism (not shown), together with the movable base element 262 to be located at the front limit of movement thereof. When the plate spring 266, which serves to support the first link member 172, is shifted frontward, the first and second link members 172, 174 are automatically folded-up due to their weight and of key top 12. As a result, the key top 12 is displaced to the retracted position lower than the initial position. In the retracted position, the plate spring 266 is kept free of any substantial elastic deformation.

The height of the key top 12 at the retracted position depends on the location of the front limit of movement of the plate spring 266 or the movable base element 262. Therefore, in order to sufficiently lower the height of the key top 12 at the retracted position, it is preferred that the components of key switch 260 are dimensioned so that a sufficient gap is defined between the plate spring 266 and the front inner edge 14*c* of the base 14 when the movable base element 262 is placed at the rear limit of movement. Alternatively, the part of the base 14 including the front inner edge 14*c* may be removed or cut out, whereby the limit of movement of the movable base element 262 and thus the plate spring 266 can be enlarged frontward.

The key switch 260 further includes an actuating member 268 for actuating the membrane switch 20, which is in the form of a second plate spring integrally provided on the first link member 172, instead of the compression coil spring provided on the inner surface 12*b* of the key top 12 in the key switch 170 of FIG. 17. The actuating member 268 is fixedly joined at one end thereof to the generally longitudinally center of one arm 176 of the first link member 172, and extends at the other free end thereof to close with the bar 178 of the first link member 172 so as to form a bend with a convex surface facing downward. The actuating member 268 is provided at the free end thereof with a generally flat tongue 268*a* extending adjacent to and outwardly bent from the bend.

When the key top 12 is located at the initial highest position in the key-entry operation, the free end of the actuating member 268 is located above the center opening 15 of the base 14. When the key top 12 is pushed down to and located at a predetermined position, the free end of the actuating member 268 enters into the center opening 15 of the base 14, and elastically pushes the membrane switch 20 by the convex surface of the bent of the actuating member 268.

On the other hand, the movable base element 262 is provided integrally with an generally L-shaped assist member 270 arranged along a front inner edge 264*b* of the center opening 264 adjacent to the inner edge 264*a* to which the plate spring 266 is joined, and located in front of the plate spring 266. The assist member 270 is fixedly joined at one end thereof to the front inner edge 264*b* of the movable base element 262, and extends through the center opening 15 of the base 14 to project above the major surface 14*a* and to orient the other end thereof toward the plate spring 266.

The assist member 270 joined to the movable base element 262 can be shifted together with the movable base element 262 and the plate spring 266 in the forward/backward direction relative to the base 14. Consequently, the assist member 270 can be shifted between a first position where the assist member 270 comes into engagement with the tongue 268*a* of the actuating member 268 and a second position where the assist member 270 is away from the tongue 268*a*, during the time when the key top 12 is located at the predetermined pushed-down position.

Figure 26A:
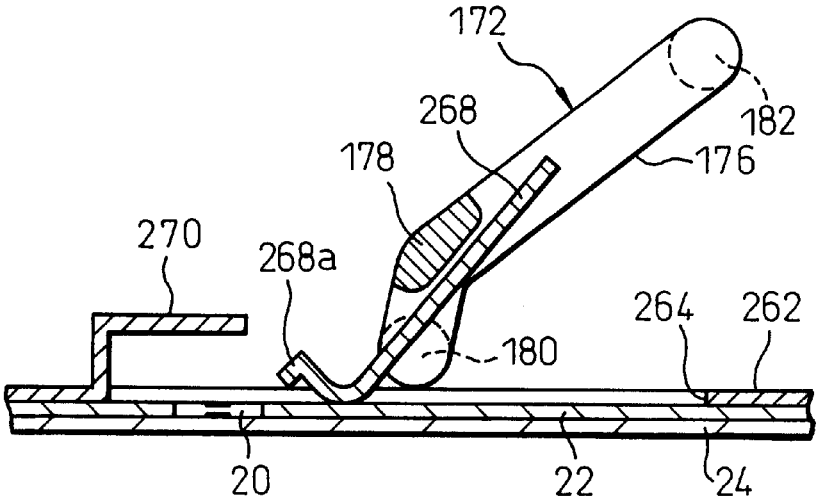
FIGS. 26A to 26C are schematic sectional views illustrating the operational principle of an actuating member in the key switch of FIG. 25.
Figure 26B:
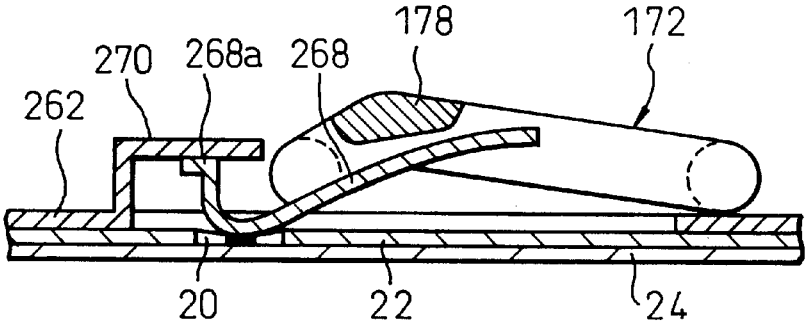

When the key switch 260 is held in the condition for the key-entry operation, i.e., when the movable base element 262 is placed at the rear limit of movement thereof, the assist member 270 is located at the above-described first position. During this condition, if no external force is applied to the key top 12, the plate spring 266 urges or biases the key top 12 toward the initial position vertically upwardly away from the base 14 and supports the key top 12 in this position, through the mutually interlocked first and second link members 172, 174. In this state, the free end of the actuating member 268 is located above the center openings 15, 264 of the base 14 and the movable base element 262, so as not to contact with the membrane sheet 22. Also, the membrane switch 20 is positioned beneath the free end of the assist member 270 joined to the movable base element 262, as shown in FIGS. 26A and 26B.

When the key top 12 is pushed down by the key-entry operation, the plate spring 266 is deformed while exerting biasing or elastic restoring force to the bar 178 (i.e., the loading portion) of the first link member 172 in a direction substantially orthogonal to the pushing-down direction of the key top 12. When the key top 12 reaches the predetermined pushed-down position, the free end of the actuating member 268 enters into the center openings 15, 264 of the base 14 and the movable base element 262, so as to be abutted at the convex surface of the bent of the actuating member 268 onto the surface of the membrane sheet 22 (see FIG. 26A). Then, the key top 12 is further pushed down, whereby the tongue 268*a* of the actuating member 268 comes into engagement with the assist member 270 joined to the movable base element 262 (see FIG. 26B). The key top 12 is subsequently yet further pushed down, whereby the actuating member 268 is elastically deformed between the first link member 172 and the assist member 270, so as to elastically push the membrane switch 20 by the bend of the actuating member 268.

Figure 26C:
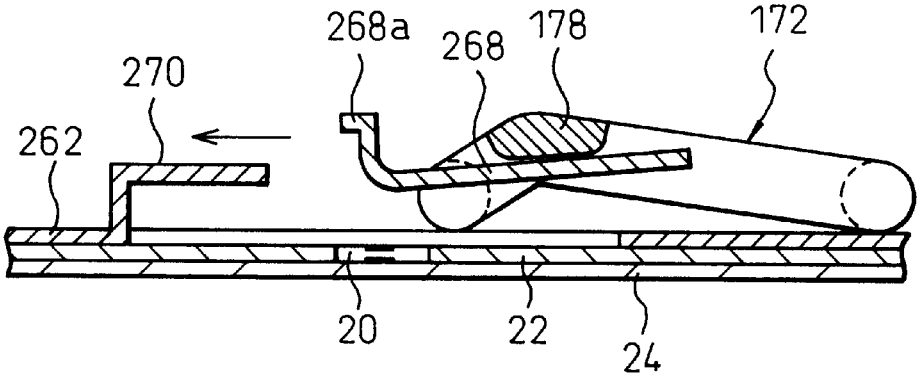

On the other hand, when the movable base element 262 is shifted to and placed at the front limit of movement thereof, the first and second link members 172, 174 are automatically folded-up inside the key top 12, as already described, and the key top 12 is thus displaced to the retracted position where the key-entry operation is impossible. During this operation, the assist member 270 is shifted frontward together with the movable base element 262 and is located at the above-described second position (see FIG. 26C). Accordingly, the assist member 270 cannot be engaged with the tongue 268*a* of the actuating member 268, and thus the actuating member 268 is not elastically deformed even if the key top 12 goes down. Consequently, the key top 12 is smoothly displaced to the retracted position due to the weight thereof while the actuating member 268 does not close the membrane switch 20.

As will be appreciated, the key switch 260 can provide various effects essentially equivalent to those of the key switch 170 of the sixth embodiment. If a keyboard is structured by incorporating therein a plurality of key switches 260, it is possible to hold the key top 12 of each key switch 260 in the initial projecting position for a key-entry operation through the first and second link members 172, 174 when the keyboard is to be used, by shifting the plate spring 266 and the assist member 270 together with the movable base element 262 to the rear limit of movement, and also to smoothly displace the key top 12 of each key switch 260 into the retracted position making the key-entry operation impossible when the keyboard is not to be used, by shifting the plate spring 266 and the assist member 270 together with the movable base element 262 to the front limit of movement.

When the key top 12 is in the retracted position, the link members 172, 174 and the actuating member 268 are folded-up and accommodated inside the key top 12, so that the dimension of the key top 12 can be decreased particularly in the height direction, in comparison with the conventional key switch using the dome-shaped elastic actuating member. Consequently, according to the key switch 260, it is possible to significantly reduce the entire height or thickness of the keyboard and can improve the portability thereof.

In the above ninth embodiment, the plate spring 266 and the assist member 270 may be formed integrally with the movable base element 262 by stamping and bending a sheet metal material. The other elastic members having liner characteristics, such as a compression coil spring, an extension coil spring, etc., may be used instead of the plate spring 266. Also, the actuating member 268 may be formed integrally with the first link member 172, both made from the same resinous material or same metal. Alternatively, the metal actuating member 268 may be formed integrally with the resinous first link member 172 through an insert molding process.

Tenth Embodiment

Figure 27:
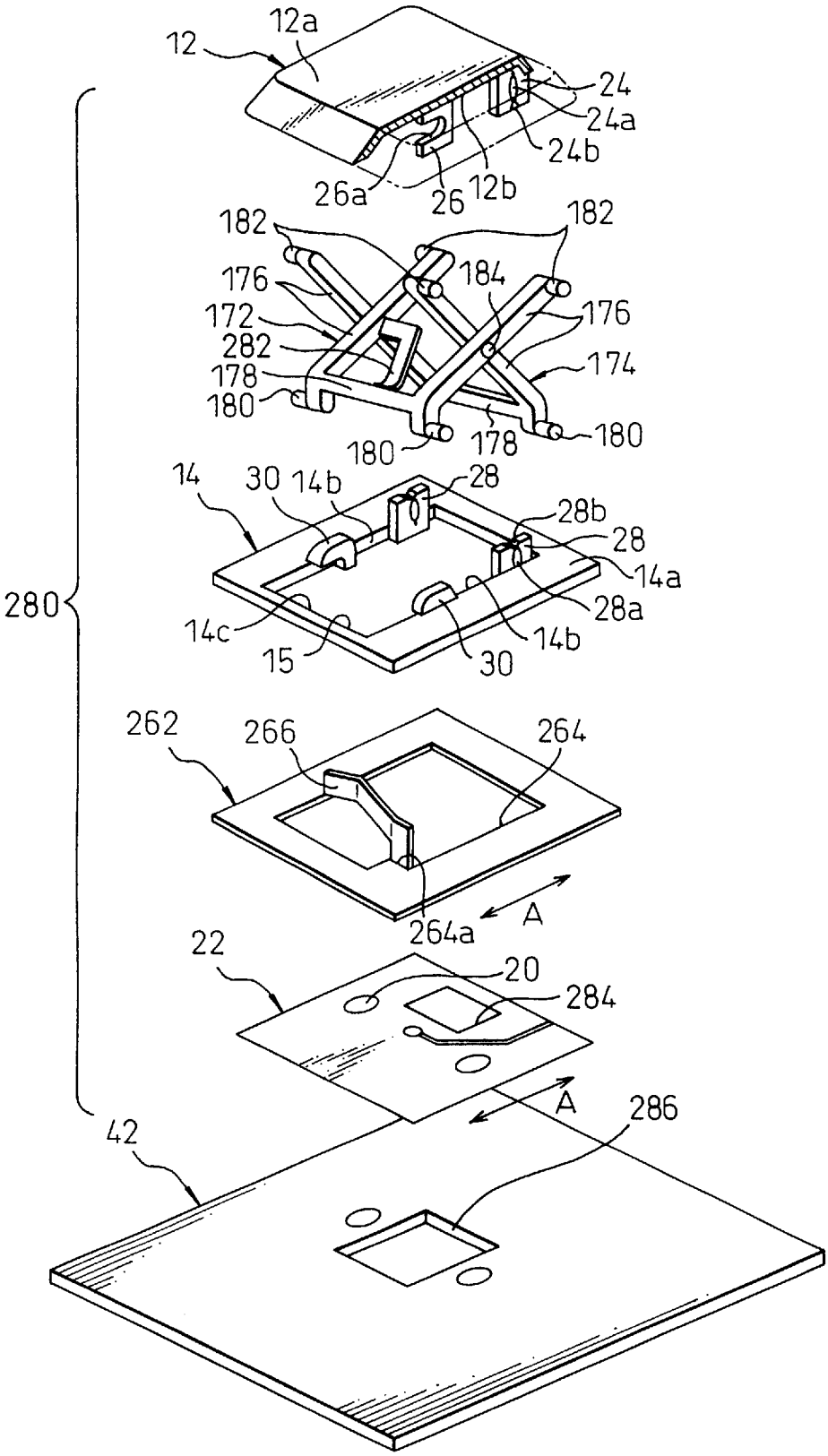
FIG. 27 is an exploded perspective view showing a tenth embodiment of a key switch according to the present invention.

FIG. 27 shows a key switch 280 according to a tenth embodiment of the present invention. The key switch 280 is preferably used in a relatively thin keyboard having an improved portability, in which the key top of each key switch is positively displaced to a retracted position lower during the inoperating (or carrying) state of the keyboard. The key switch 280 includes the alternative constructions of an actuating member for a membrane switch and of means for eliminating the function of the actuating member when the key top is in a retracted position, and the remaining structure of the key switch 280 is substantially the same as that of the key switch 260 of the ninth embodiment. Therefore, the same or similar components are denoted by the common reference numerals, and a detailed description thereof is not repeated.

That is, the key switch 280 includes a key top 12, a fixed base element 14 (hereinafter referred to as a base 14), a pair of link members 172, 174, a movable base element 262, a membrane sheet 22 with a membrane switch 20, and a support plate 42. The movable base element 262 is provided integrally with a plate spring 266 as an elastic member, but does not include the assist member 270 in the key switch 260.

The key switch 280 further includes an actuating member 282 for actuating the membrane switch 20, which is in the form of a second plate spring integrally provided on the first link member 172, in the same manner as the actuating member 268 in the key switch 260. The actuating member 282 is fixedly joined at one end thereof to the generally longitudinally center of one arm 176 of the first link member 172, and extends at the other free end thereof to close with the bar 178 of the first link member 172 so as to form a bend with a convex surface facing downward. However, the extension as the tongue 268*a* of the actuating member 268 in the key switch 260 is not provided to the free end of the actuating member 282.

When the key top 12 is located at the initial highest position in the key-entry operation, the free end of the actuating member 282 is located above the center opening 15 of the base 14. When the key top 12 is pushed down to and located at a predetermined position, the free end of the actuating member 282 enters into the center opening 15 of the base 14, and elastically pushes the membrane switch 20 by the convex surface of the bent of the actuating member 282. The actuating member 282 may be formed integrally with the first link member 172, both made from the same resinous material or same metal. Alternatively, the metal actuating member 282 may be formed integrally with the resinous first link member 172 through an insert molding process.

In the key switch 280, the membrane sheet 22 can be shifted together with the movable base element 262 in a forward/backward direction relative to the base 14 (shown by an arrow A), to eliminate the function of the actuating member 282 when the key top 12 in the retracted position. Therefore, the membrane switch 20 can be shifted between a first position where the membrane switch 20 is pushed by the free end of the actuating member 282 to close an electric circuit and a second position where the membrane switch 20 is frontwardly away from the free end of the actuating member 282 to keep the electric circuit open, during the time when the key top 12 is located at the predetermined pushed-down position.

The membrane sheet 22 is provided in the rear of the membrane switch 20 with an opening 284 penetrating the membrane sheet 22, for receiving the free end of the actuating member 282. Also, the support plate 42 is provided with an opening 286 at a location under the membrane switch 20 located in the first position, for receiving the free end of the actuating member 282.

Figure 28A:
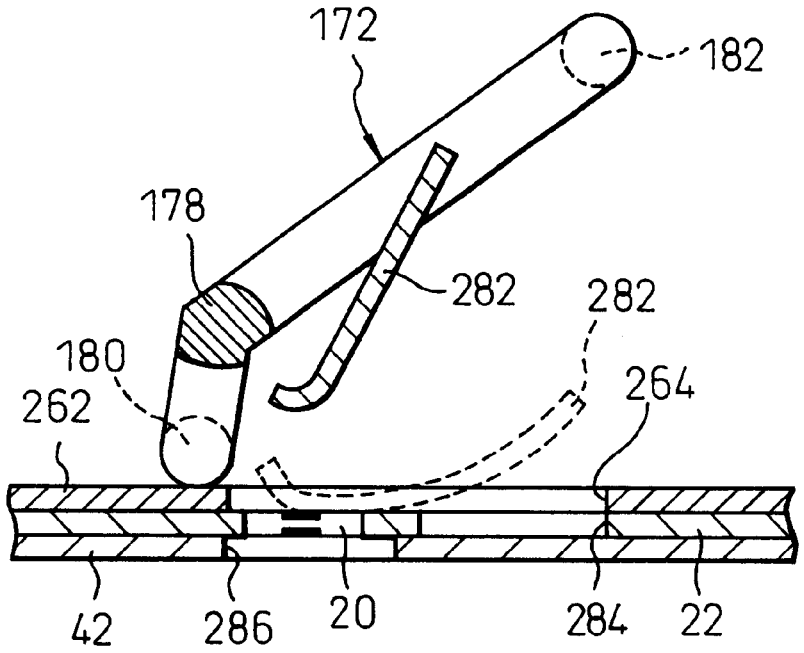
FIGS. 28A and 28B are schematic sectional views illustrating the operational principle of an actuating member in the key switch of FIG. 27.
Figure 28B:
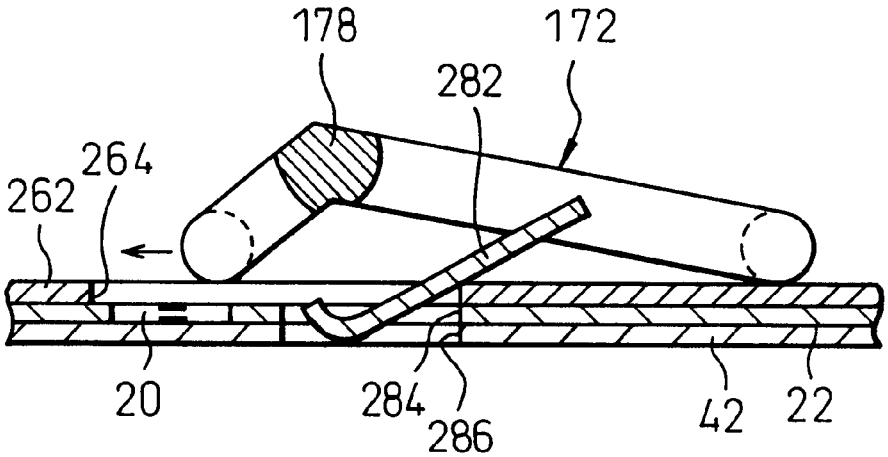

During the time when the key switch 280 is held in the condition for the key-entry operation, i.e., when the movable base element 262 and the membrane sheet 22 are placed at the rear limit of movement thereof, if no external force is applied to the key top 12, the plate spring 266 urges or biases the key top 12 toward the initial position vertically upwardly away from the base 14 and supports the key top 12 in this position, through the mutually interlocked first and second link members 172, 174. In this state, the free end of the actuating member 282 is located above the center openings 15, 264 of the base 14 and the movable base element 262, so as not to contact with the membrane sheet 22, as shown in FIG. 28A. Also, the membrane switch 20 is located in the first position.

When the key top 12 is pushed down by the key-entry operation, the plate spring 266 is deformed while exerting biasing or elastic restoring force to the bar 178 (i.e., the loading portion) of the first link member 172 in a direction substantially orthogonal to the pushing-down direction of the key top 12. When the key top 12 reaches the predetermined pushed-down position, the free end of the actuating member 282 enters into the center openings 15, 264 of the base 14 and the movable base element 262, so as to be abutted, at the convex surface of the bend of the actuating member 282, onto the surface of the membrane sheet 22, and to elastically push the membrane switch 20, as shown by a broken line in FIG. 28A.

When the movable base element 262 and the membrane sheet 22 are shifted to and placed at the front limit of movement thereof, the first and second link members 172, 174 are automatically folded-up inside the key top 12, because the plate spring 266, which serves to support the first link member 172, is also shifted frontward, and the key top 12 is thus displaced to the retracted position where the key-entry operation is impossible. During this operation, the membrane switch 20 is shifted frontward to be located at the above-described second position, and the openings 284, 286 formed respectively in the membrane sheet 22 and the support plate 42 are aligned with each other as well as with the center opening 264 of the movable base element 262. Accordingly, the free end of the actuating member 282 is not abutted onto the membrane switch 20 even if the key top 12 goes down, but is received in the center opening 264 and the openings 284, 286. Consequently, the key top 12 is smoothly displaced to the retracted position due to the weight thereof while the actuating member 282 does not close the membrane switch 20.

As will be appreciated, the key switch 280 can provide various effects essentially equivalent to those of the key switch 170 of the sixth embodiment. If a keyboard is structured by incorporating therein a plurality of key switches 280, it is possible to hold the key top 12 of each key switch 280 in the initial projecting position for a key-entry operation through the first and second link members 172, 174 when the keyboard is to be used, by shifting the plate spring 266 together with the movable base element 262 to the rear limit of movement and shifting the membrane switch 20 into the first position, and also to smoothly displace the key top 12 of each key switch 280 into the retracted position making the key-entry operation impossible when the keyboard is not to be used, by shifting the plate spring 266 together with the movable base element 262 to the front limit of movement and shifting the membrane switch 20 into the second position.

When the key top 12 is in the retracted position, the link members 172, 174 and the actuating member 282 are folded-up and accommodated inside the key top 12, so that the dimension of the key top 12 can be decreased particularly in the height direction, in comparison with the conventional key switch using the dome-shaped elastic actuating member. Consequently, according to the key switch 280, it is possible to significantly reduce the entire height or thickness of the keyboard and can improve the portability thereof.

Eleventh Embodiment

Figure 29:
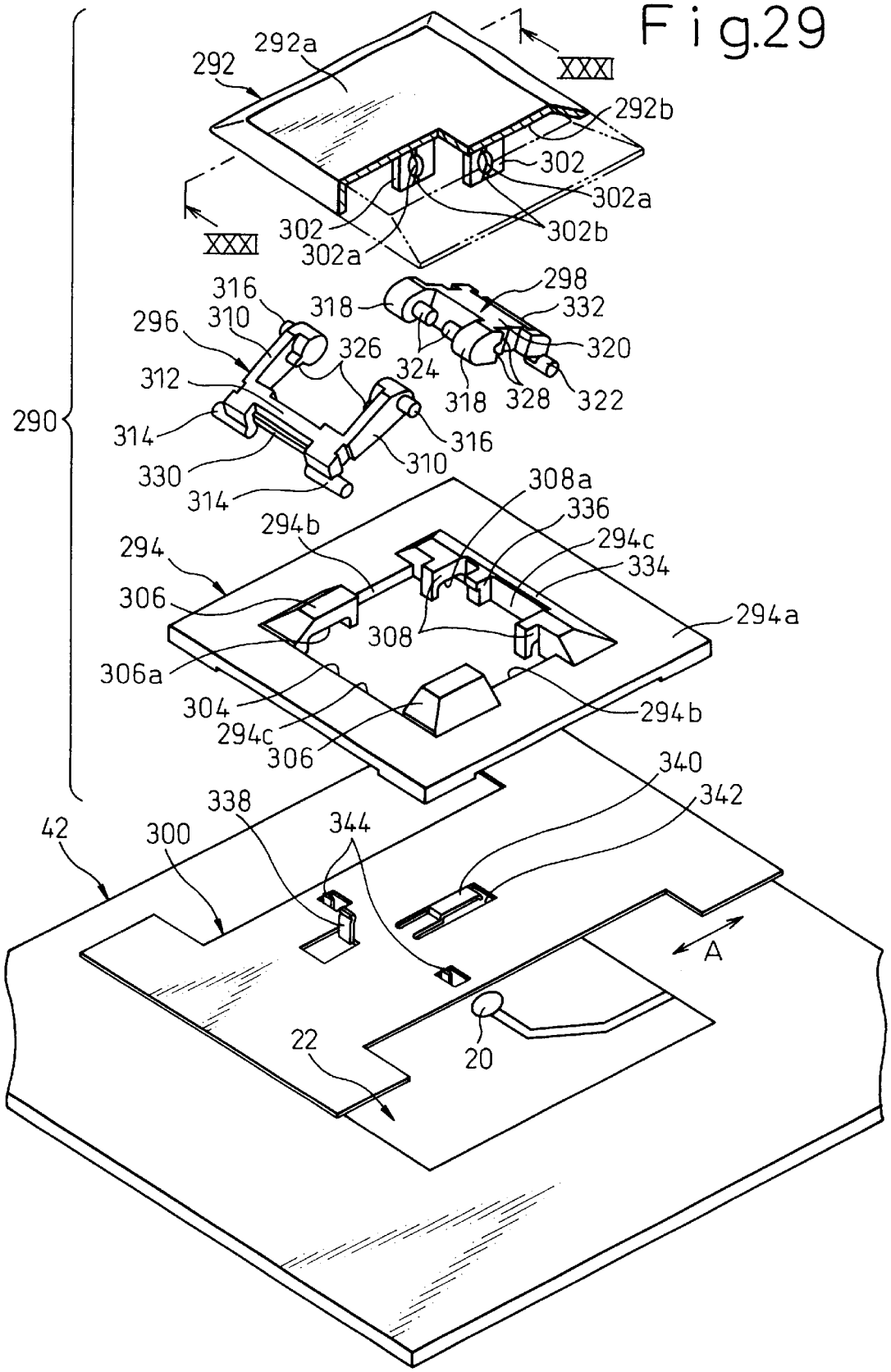
FIG. 29 is an exploded perspective view showing an eleventh embodiment of a key switch according to the present invention.

FIG. 29 shows a key switch 290 according to an eleventh embodiment of the present invention. The key switch 290 is preferably used in a relatively thin keyboard having an improved portability, in which the key top of each key switch is positively displaced to a retracted position during the inoperating (or carrying) state of the keyboard.

The key switch 290 includes a key top 292 with an operation surface 292*a* adapted to be keyed by an operator's finger, a fixed base element 294 (hereinafter referred to as a base 294) shaped as a rectangular frame and arranged beneath the key top 292, a pair of link members 296, 298 for supporting the key top 292 above a major surface 294*a* of the base 294 and directing or guiding the key top 292 in a vertical or up and down direction, a movable base element 300 arranged under the base 294, a membrane sheet 22 provided with a membrane switch 20 and disposed under the movable base element 300, and a support plate 42 for supporting the membrane sheet 22. The movable base element 300 cooperates with the base 294 (i.e., the fixed base element) to serve as a base of the key switch 290. The membrane switch 20, the membrane sheet 22 and the support plate 42 have substantially the same structures as those in the key switch 10 of the first embodiment shown in FIG. 1, and thus the detailed description thereof is not repeated.

The key top 292 is a dish-like member having a generally rectangular profile, and includes two pairs of pivot supports 302, both pairs being disposed adjacent to each other at a generally center of the key top 292 in a forward/backward direction (a leftward/rightward direction in FIG. 31A) on an inner surface 292*b* opposite to the operation surface 292*a* (only two pivot supports 302 are shown). One pair of pivot supports 302 located rearward (rightward in FIG. 31A) are spaced from each other, and the other pair of pivot supports 302 located frontward (leftward in FIG. 31A) are arranged close to each other. Please note that the "front" and the "rear" of the key switch 290 are hereinafter defined in a manner as described above in convenience, but, of course, the "front" and the "rear" in an actual use are not restricted in this definition.

Each of the pivot supports 302 is formed as a small plate uprightly projecting from the inner surface 292*b* of the key top 292, and includes a bearing hole 302*a* penetrating through the thickness of the plate and a slit 302*b* extending generally perpendicularly to the inner surface 292*b* to communicate with the bearing hole 302*a*. Two pivot supports 302 of each pair are positioned on the inner surface 292*b* of the key top 292 in such a manner that the bearing holes 302*a* of these pivot supports 302 are aligned with each other in a penetrating direction thereof.

The base 294 is a frame-like member having a generally rectangular profile, and includes a generally rectangular center opening 304 covered with the key top 292. The base 294 is provided, along opposed inner edges 294*b* thereof defining the center opening 304, with two pairs of slide supports 306, 308, one pair being spaced from the other in a longitudinal or forward/backward direction, and two slide supports 306, 308 in each pair being spaced from each other.

Each of the slide supports 306 disposed adjacent to the front end of the base 294 includes a reverse U-shaped wall part projecting from the major surface 294*a* and the inner edge 294*b* of the base 294 adjacent to the front inner edge 294*c* of the latter, and a bearing slot 306*a* extending generally parallel to the major surface 294*a* is formed inside the wall part. Each of the slide supports 308 disposed adjacent to the rear end of the base 294 includes a reverse U-shaped wall part projecting from the major surface 294*a* and the inner edge 294*b* of the base 294 adjacent to the rear inner edge 294*c* of the latter, and a bearing slot 308*a* extending generally parallel to the major surface 294*a* is formed inside the wall part. These front and rear bearing slots 306*a*, 308*a* open to a bottom side of the base 294. Two slide supports 306, 308 of each pair are positioned on the opposed inner edges 294*b* of the base 294 in such a manner that the bearing slots 306*a*, 308*a* of respective slide supports 306, 308 are aligned and faced with each other.

The pair of link members 296, 298 are structured as a first link member 296 and a second link member 298, which are assembled together so as to be provided with a generally X-shape in a side view. The first link member 296 includes two arms 310 extending parallel to each other, and a connecting part 312 mutually connecting the arms 310 near one ends of the latter. Axles 314 are provided on one ends of the arms 310 to mutually coaxially project on the opposite sides to the connecting part 312. Axles 316 are provided on the other ends of the arms 310 to mutually coaxially project on the same sides as the axles 314. The second link member 298 includes two arms 318 extending parallel to each other, and a connecting part 320 mutually connecting the arms 318. Axles 322 are provided on one ends of the connecting part 320 to mutually coaxially project and face outwardly away from each other. Axles 324 are provided on the other ends of the arms 318 away from the connecting part 320 to mutually coaxially project and face inwardly toward each other.

The first and second link members 296, 298 are meshed with each other at a toothed end of each link members 296, 298. More particularly, each of the arms 310 of the first link member 296 is provided on the inner side opposite to the axle 316 with one teeth 326 extending toward the connecting part 312, and each of the arms 318 of the second link member 298 is provided on the outer side opposite to the axle 324 with two tooth 328 extending toward the axle 322. The first and second link members 296, 298 are pivotably connected with each other by intermeshings between the one tooth 326 and the corresponding two teeth 328 provided on the arms 310, 318, respectively.

The axles 314 formed on one ends of the arms 310 of the first link member 296 are slidably fitted or received in the respective bearing slots 306*a* of the front slide supports 306 on the base 294, and the axles 316 formed on the other ends of the arms 310 of the first link member 296 are pivotably fitted or received in the respective bearing holes 302*a* of the rear pivot supports 302 on the key top 292, whereby the first link member 296 is arranged between the key top 292 and the base 294 in such a manner as to be pivotable about the axles 316 on the key top 292.

The axles 322 formed on one ends of the connecting part 320 of the second link member 298 are slidably fitted or received in the respective bearing slots 308*a* of the rear slide supports 308 on the base 294, and the axles 324 formed on the other ends of the arms 318 of the second link member 298 are pivotably fitted or received in the respective bearing holes 302*a* of the front pivot supports 302 on the key top 292, whereby the second link member 298 is arranged between the key top 292 and the base 294 in such a manner as to be pivotable about the axles 324 on the key top 292.

The above-described structure of the first and second link members 296, 298 substantially corresponds to the structure of the first and second link members 232, 234 in the modification (FIG. 24) of the key switch 230 of the eighth embodiment, except for the generally X-shaped, intersected arrangement of link members 296, 298. Therefore, in this embodiment, the axles 314 of the first link member 296 and the axles 322 of the second link member 298 constitute sliding portions of the respective link members 296, 298. The first and second link members 296, 298 are interlocked to each other through the intermeshings between the respective one tooth 326 and the respective two teeth 328 so as to be synchronously pivotable, so that the key top 292 is permitted to be subjected to a parallel displacement in a substantially vertical direction in relation to the major surface 294*a* of the base 294, while keeping a predetermined posture of the key top 292 wherein the operation surface 292*a* thereof is generally parallel to the major surface 294*a*.

The key switch 290 further includes a pair of plate springs 330, 332 or elastic members, disposed between the base 294 as well as the movable base element 300 and the first and second link members 296, 298, which act as biasing means for elastically urging upward the key top 292 away from the base 294. One plate spring 330 is integrally joined at one end thereof to one end of one arm 310 of the first link member 296 in the vicinity of one axle 314, and is arranged at the other free end thereof close to the connecting part 312 and near the front inner edge 294*c* of the base 294. The other plate spring 332 is integrally joined at one end thereof to one end of the connecting part 320 of the second link member 298 in the vicinity of one axle 322, and is arranged at the other free end thereof close to the connecting part 320 and near the rear inner edge 294*c* of the base 294.

The base 294 is also provided with a wall 334 extending upward from the major surface 294*a* along the rear inner edge 294*c*. A bump 336 is formed on the wall 334 so as to be capable of coming into contact with the free end of the plate spring 332 joined to the second link member 298. The movable base element 300 is also provided with a vertical wall 338 extending through the center opening 304 of the base 294 and projecting above the major surface 294*a*. The wall 338 is fixedly joined at one end thereof to the movable base element 300, so that the other free end thereof is arranged to be capable of coming into contact with the free end of the plate spring 330 joined to the first link member 296.

The movable base element 300 can be shifted in a forward/backward direction (shown by an arrow A) of the key switch 290 between the base 294 and the membrane sheet 22. Therefore, the wall 338 joined to the movable base element 300 can be shifted together with the movable base element 300 in the forward/backward direction in relation to the base 294. The plate spring 330 joined to the first link member 296 optionally acts, in connection with the shifted position of the wall 338, as a compression spring between the first link member 296 and the movable base element 300. Also, the plate spring 332 joined to the second link member 298 optionally acts, in connection with the shifted position of the wall 338, as a compression spring between the second link member 298 and the base 294. Accordingly, in the key switch 290, it is possible to change the distance between the wall 338 arranged at a front side in the center opening 304 of the base 294 and the bump 336 arranged at a rear side in the center opening 304, and thereby to displace the key top 292 between the initial projecting position and the retracted position during inoperating condition, as described below.

Figure 30A:
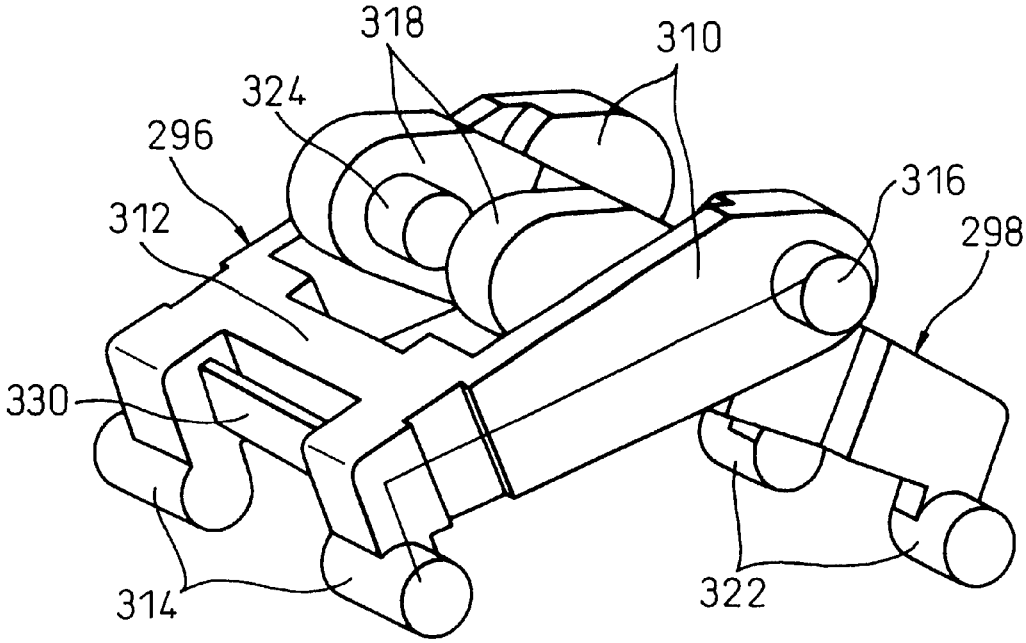
FIGS. 30A and 30B are enlarged perspective views illustrating the operational principle of link members in the key switch of FIG. 29.
Figure 30B:
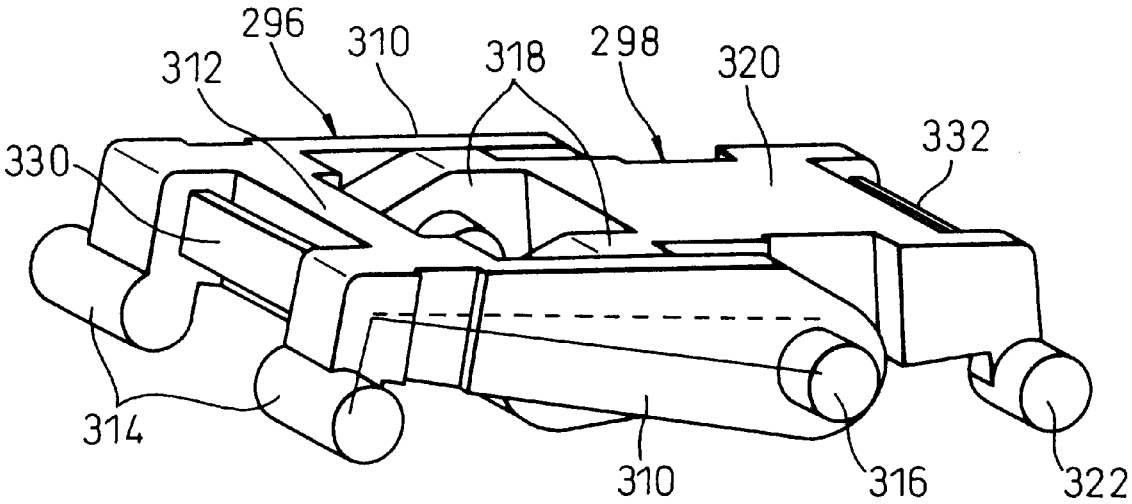

When the movable base element 300 is located at the rear limit of movement thereof, the plate spring 330 and the plate spring 332 cooperate with the wall 338 and the bump 336, respectively, so as to act in the same manner as the plate spring 250 shown in FIG. 24 to maintain the key switch 290 in a condition for a key-entry operation. That is, the first and second link members 296, 298 act in accordance with the operational principle as described with reference to FIG. 19, because the axles 316, 318 to be connected with the key top 292 can go down to a lower level (illustrated by an angle$\phi$ in FIG. 30B) than loading portions of the link members 296, 298, to which the biasing force of the plate springs 330, 332 is applied (see FIGS. 30A and 30B). In this respect, the plate springs 330, 332 are linear characteristics springs of simple structures, and thus exert the biasing force, assuming a linear relationship with the shifting amount or displacement of the connecting parts 312, 320, onto the first and second link members 296, 298, respectively.

When the wall 338 is shifted frontward, by an actuating mechanism (not shown), together with the movable base element 300 to be located at the front limit of movement thereof, the wall 338 and the bump 336 no longer support the first and second link members 296, 298, and thereby the first and second link members 296, 298 are automatically folded-up inside the key top 292 due to their weight and of key top 292. As a result, the key top 292 is displaced to the retracted position lower than the initial position. In the retracted position, the plate springs 330, 332 are kept free of any substantial elastic deformation.

The key switch 290 further includes an actuating member 340 for actuating the membrane switch 20, which is in the form of a second plate spring integrally provided on the movable base element 300, instead of the compression coil spring provided on the inner surface 12*b* of the key top 12 in the key switch 170 of FIG. 17. The actuating member 340 is fixedly joined at one end thereof to a front inner edge of a generally center opening 342 of the movable base element 300 and extends rearward so that the other free end of the actuating member 340 is disposed under the connecting part 320 of the second link member 298. The actuating member 340 is provided at the free end thereof with a tongue 340*a* (FIGS. 31A to 31C) extending toward the membrane switch 20 of the membrane sheet 22. The actuating member 340 can be shifted together with the movable base element 300 in the forward/backward direction of the key switch 290.

Figure 31A:
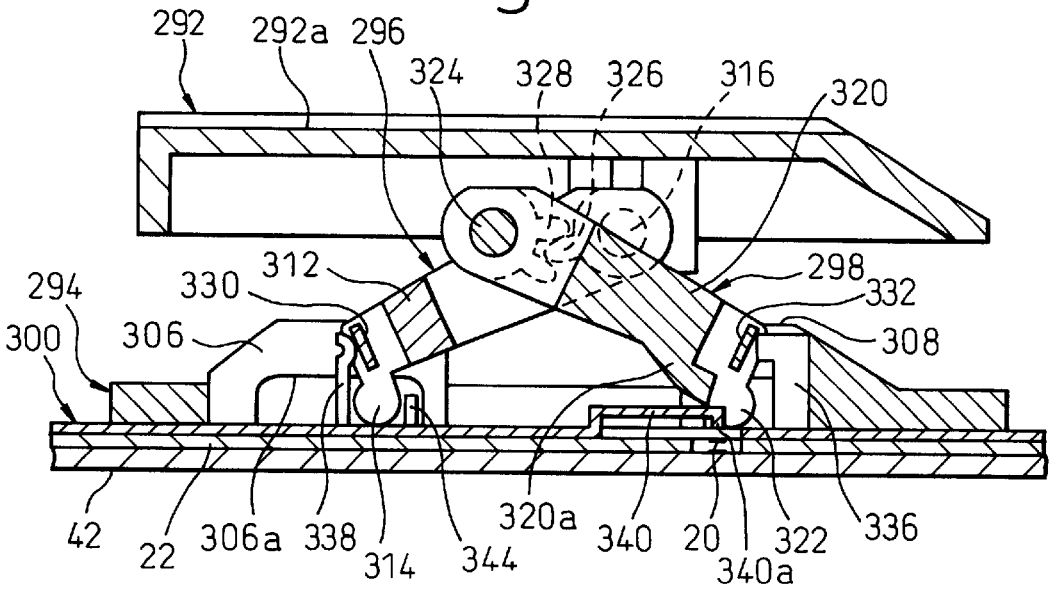
FIGS. 31A to 31C are sectional views illustrating the operational principle of an actuating member in the key switch of FIG. 29, taken along line XXXI—XXXI of FIG. 29.

As shown in FIG. 31A, when the key switch 290 is held in the condition for the key-entry operation, i.e., when the movable base element 300 is placed at the rear limit of movement thereof, the actuating member 340 is located in a first position under a bulge 320*a* formed at a bottom of the connecting part 320 of the second link member 298. During this condition, if no external force is applied to the key top 292, the plate springs 330, 332 urge or bias the key top 292 toward the initial position vertically upwardly away from the base 294 and support the key top 292 in this position, through the mutually interlocked first and second link members 296, 298. In this state, the tongue 340*a* at the free end of the actuating member 340 is located is the center opening 304 of the base 294, so as not to contact with the membrane sheet 22.

When the key top 292 is pushed down by the key-entry operation, the plate spring 330 and the plate spring 332 cooperate with the wall 338 and the bump 336, respectively, to be deformed while exerting biasing or elastic restoring force to the neighborhoods (i.e., the loading portions) of the connecting parts 312, 320 of the first and second link members 296, 298 in a direction substantially orthogonal to the pushing-down direction of the key top 292. When the key top 292 reaches the predetermined pushed-down position, the bulge 320*a* of the connecting portion 320 of the second link member 298 enters into the center opening 304 of the base 294, so as to come into contact with the actuating member 340. Then, the key top 292 is further pushed down, whereby the bulge 320*a* pushes the actuating member 340 to elastically deform the latter, and the tongue 340*a* of the actuating member 340 in turn pushes the membrane switch 20 to close an electric circuit (see FIG. 31B).

Figure 31B:
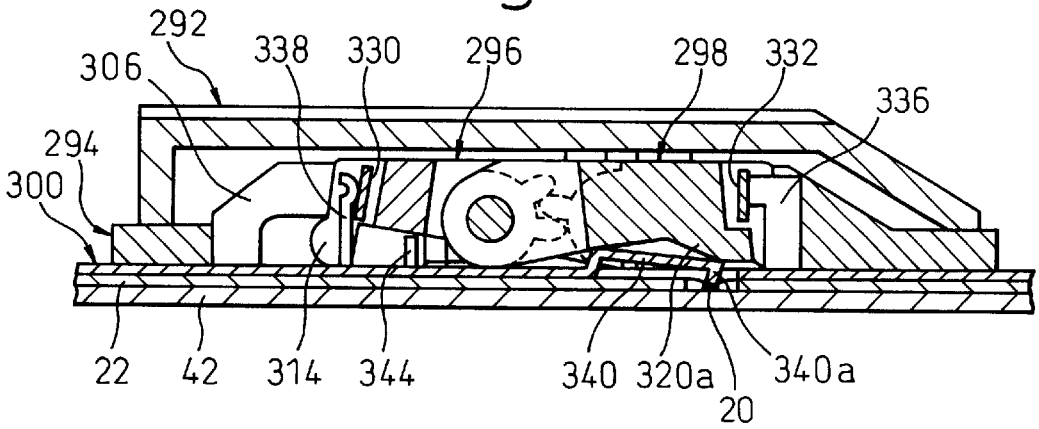
Figure 31C:
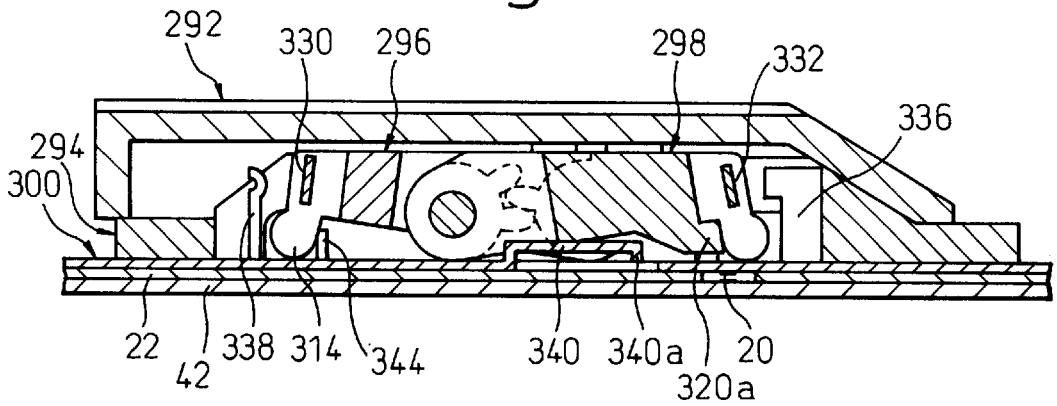

On the other hand, as shown in FIG. 31C, when the wall 338 is shifted together with the movable base element 300 upto the front limit of movement thereof, the first and second link members 296, 298 are automatically folded-up inside the key top 292, as already described, and the key top 292 is thus displaced to the retracted position where the key-entry operation is impossible. During this operation, the actuating member 340 is shifted frontward together with the movable base element 300 and is located at a second position away from the bulge 320*a* of the second link member 320. Accordingly, the actuating member 340 is not elastically deformed even if the key top 292 goes down, and thus the tongue 340*a* is not abutted to the membrane switch 20. Consequently, the key top 292 is smoothly displaced to the retracted position due to the weight thereof while the actuating member 340 does not close the membrane switch 20.

The key switch 290 further includes a pair of detents 344 integrally formed with the movable base element 300, as means for selectively securing the axles 314, 322 (the sliding portions) of at least one of the first and second link members 296, 298 in relation to the base 294 and the movable base element 300. The detents 344 are fixedly joined at one ends thereof to the movable base element 300, and respectively extend into the bearing slots 306*a* of the front slide supports 306 of the base 294, so that the other free ends of the detents 344 are respectively placed in the rear of the axles 314 of the first link member 296. The detents 344 can be shifted together with the movable base element 300 in the forward/backward direction of the key switch 290 inside the respective bearing slots 306*a* of the base 294.

Figure 32:
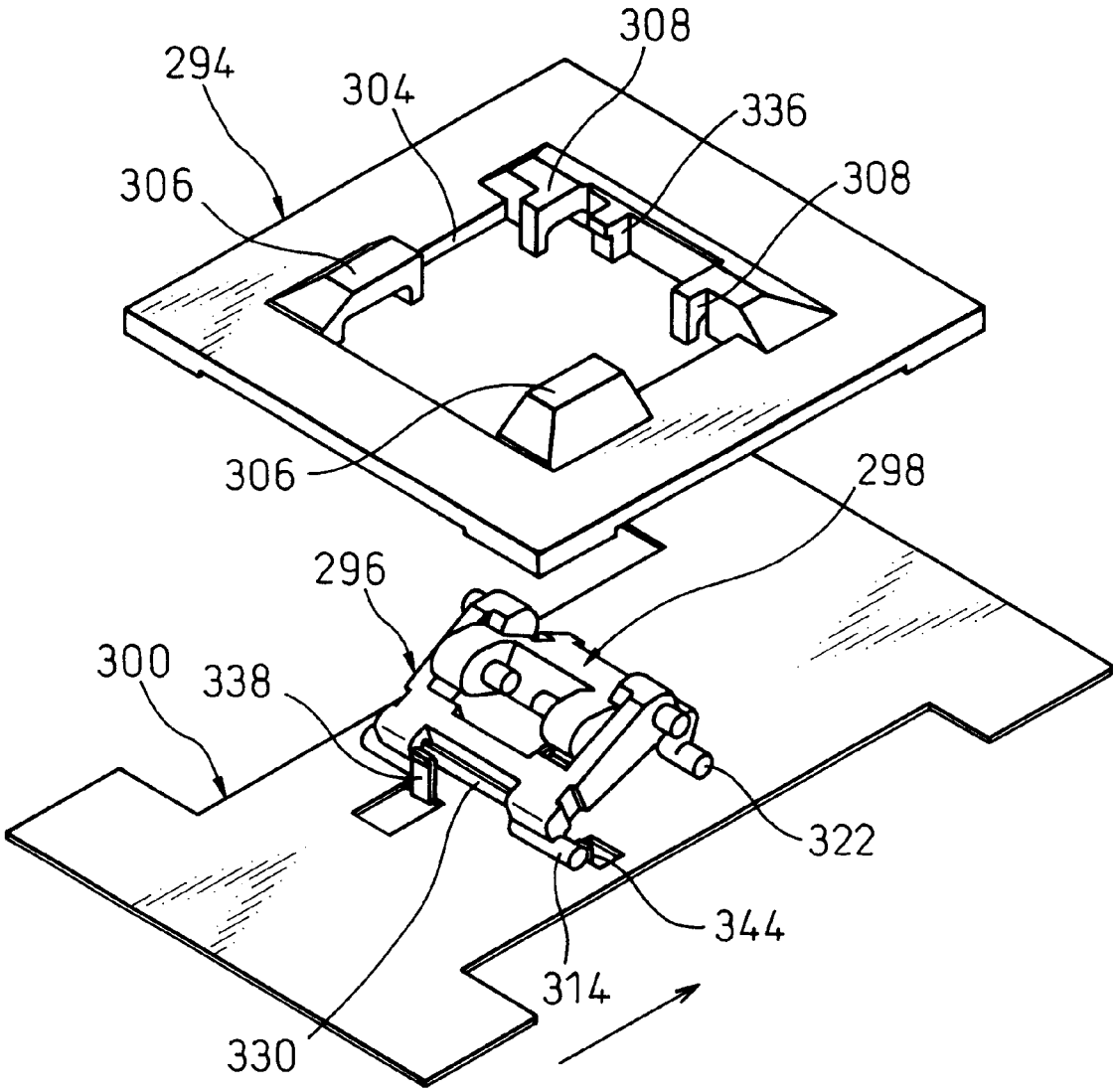
FIGS. 32 and 33 are partially enlarged perspective views illustrating the operational principle of a securing member in the key switch of FIG. 29.
Figure 33:
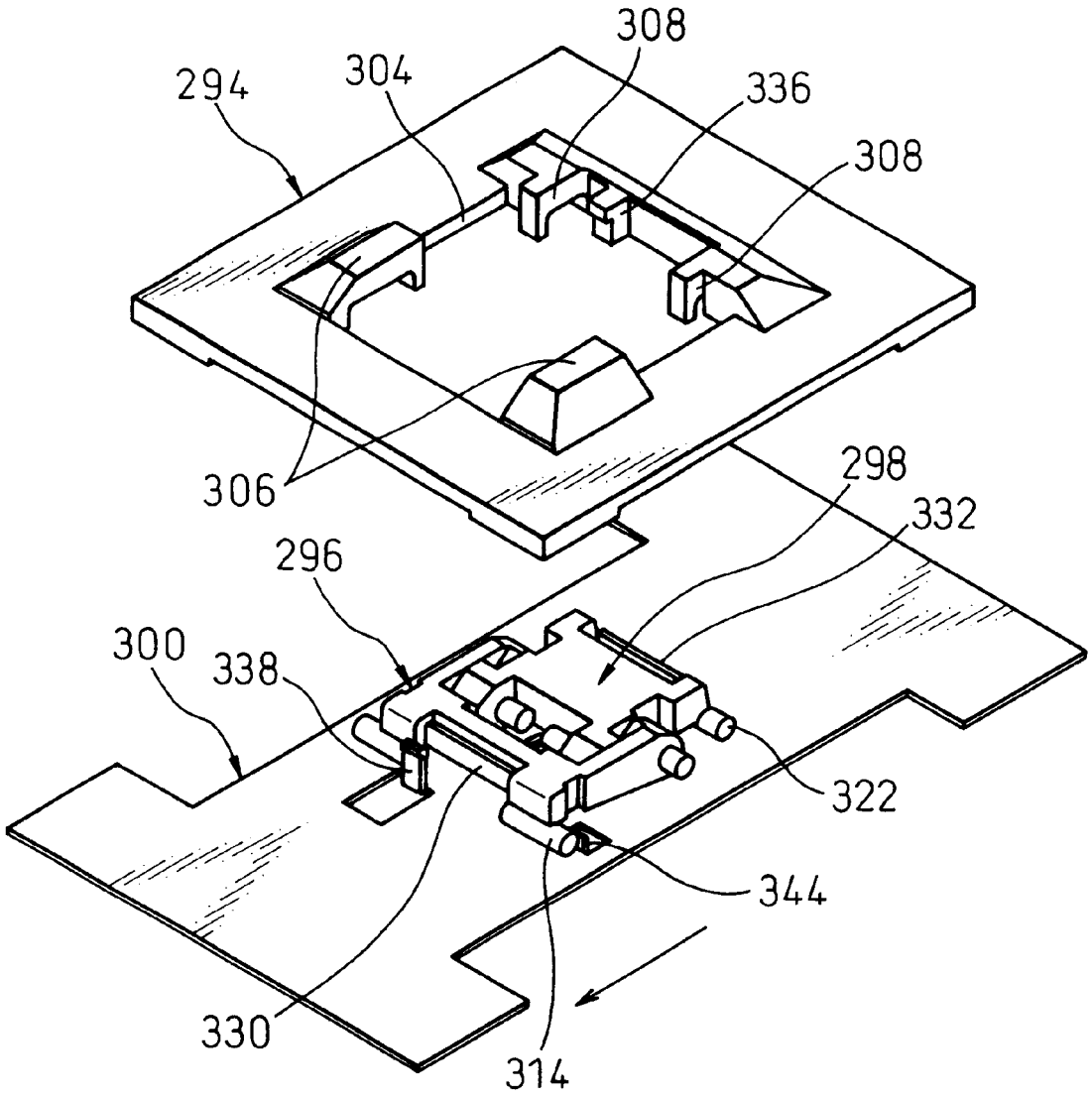

As shown in FIGS. 31A, 31B and 32, when the movable base element 300 is placed at the rear limit of movement thereof, each detent 344 is located at a position where the detent 344 cannot interfere with the shifting motion of each axle 314 of the first link member 296 in each bearing slot 306*a* of the base 294. As shown in FIGS. 31C and 33, when the movable base element 300 is placed at the front limit of movement thereof, each detent 344 is also shifted frontward in each bearing slot 306*a* of the base 294, so as to hold each axle 314 of the first link member 296 between the detent 344 and the wall part of the slide support 306. In this manner, the mutually interlocked first and second link members 296, 298 are fixedly held in a condition where the link members 296, 298 are folded-up inside the key top 292, and thus the key top 292 is secured in the retracted position.

As will be appreciated, the key switch 290 can provide various effects essentially equivalent to those of the key switch 230 of the eighth embodiment. If a keyboard is structured by incorporating therein a plurality of key switches 290, it is possible to hold the key top 292 of each key switch 290 in the condition for a key-entry operation through the first and second link members 296, 298 when the keyboard is to be used, by shifting the wall 338 together with the movable base element 300 to the rear limit of movement and by locating the actuating member 340 at the first position, and also to smoothly displace the key top 292 of each key switch 290 into the retracted position making the key-entry operation impossible when the keyboard is not to be used, by shifting the wall 338 together with the movable base element 300 to the front limit of movement and by locating the actuating member 340 at the second position.

When the key top 292 is in the retracted position, the link members 296, 298 are folded-up and accommodated inside the key top 292, so that the dimension of the key top 292 can be decreased particularly in the height direction, in comparison with the conventional key switch using the dome-shaped elastic actuating member. Consequently, according to the key switch 290, it is possible to significantly reduce the entire height or thickness of the keyboard and can improve the portability thereof. Further, according to the key switch 290, it is possible to effectively eliminate the damage and noise caused by the fluctuation of the key top 292.

While the invention has been particularly shown and described with reference to preferred embodiments thereof, it will be understood by those skilled in the art that various changes and modifications may be made without departing from the spirit and scope of the following claims.

What is claimed is:

1. A key switch comprising:

a base;

a key top arranged above said base;

a pair of link members interlocked to each other and operatively engaged with said base and said key top to support said key top above said base and direct said key top in a vertical direction, each of said link members including a sliding portion slidably and shiftably engaged with either one of said base and said key top;

at least one elastic member disposed between at least one of said link members and either one of said base and said key top with which said sliding portion is engaged, to exert biasing force, relative to a shifting amount of said sliding portion, onto said at least one of said link members in a direction different from said vertical direction; and a switching mechanism for selectively opening and closing an electric circuit in connection with a vertical movement of said key top;

wherein said at least one elastic member is fixedly joined to said at least one of said link members and is abutted against said base.

2. The key switch of claim 1, wherein said at least one elastic member exerts biasing force assuming a linear relationship with said shifting amount of said sliding portion, onto said at least one of said link members.

3. The key switch of claim 1, wherein said at least one elastic member exerts biasing force in a direction substantially orthogonal to said vertical direction, onto said at least one of said link members.

4. The key switch of claim 1, wherein said at least one of said link members is provided with a loading portion separately from said sliding portion, said loading portion being formed at a position angularly displaced from said sliding portion about a mutually connecting point of said pair of link members, said biasing force being applied onto said loading portion.

5. The key switch of claim 4, wherein said loading portion is shifted in a motion different from said sliding portion when said sliding portion is shifted.

6. The key switch of claim 1, wherein said elastic member comprises a compression spring.

7. The key switch of claim 1, wherein said elastic member comprises a plate spring.

8. The key switch of claim 1, wherein said pair of link members are arranged to mutually intersect and are pivotably connected relative to each other at an intersection thereof, wherein a first one of said link members is engaged slidably at one end thereof with said base and rotatably at another end thereof with said key top, said sliding portion being provided on said one end of said first link member, and wherein a second one of said link members is engaged rotatably at one end thereof with said base and slidably at another end thereof with said key top, said sliding portion being provided on said other end of said second link member.

9. The key switch of claim 1, wherein said pair of link members are arranged to mutually intersect and are pivotably and slidably connected relative to each other at an intersection thereof, and wherein each of said link members is engaged slidably at one end thereof with said base and rotatably at another end thereof with said key top, said sliding portion being provided on said one end of said each link member.

10. The key switch of claim 1, wherein said pair of link members are meshed with each other at a toothed end of each of said link members, and wherein each of said link members is engaged slidably at one end thereof with said base and rotatably at another end thereof with said key top, said sliding portion being provided on said one end of said each link member, said toothed end being provided adjacent to said other end of said each link member.

11. The key switch of claim 10, wherein said pair of link members are arranged to intersect with each other.

12. The key switch of claim 1, wherein said switching mechanism comprises a membrane switch arranged in an opening formed in said base beneath said key top, and an actuating member for pushing said membrane switch to close said electric circuit when said key top goes down and is located at a predetermined position above said base.

13. The key switch of claim 12, wherein said actuating member is provided on said key top, and enters into said opening of said base to elastically push said membrane switch when said key top is located at said predetermined position.

14. The key switch of claim 12, wherein said actuating member is provided on at least one of said link members, and enters into said opening of said base to elastically push said membrane switch when said key top is located at said predetermined position.

15. The key switch of claim 14, further comprising an assist member movable between a first position where said assist member comes into engagement with said actuating member and a second position where said assist member is away from said actuating member, during a time when said key top is located at said predetermined position, and wherein said actuating member comes into engagement with said assist member to push said membrane switch.

16. The key switch of claim 12, wherein said actuating member is disposed above said membrane switch, and wherein a part of said link members enters into said opening of said base to push said actuating member when said key top is located at said predetermined position, whereby said actuating member pushes said membrane switch.

17. The key switch of claim 16, wherein said actuating member is movable between a first position where said actuating member is pushed by said part of said link members upon said key top is located at said predetermined position and a second position where said actuating member is away from said part of said link members.

18. The key switch of claim 12, wherein said membrane switch is movable between a first position where said membrane switch is pushed by said actuating member to close said electric circuit and a second position where said membrane switch is away from said actuating member to keep said electric circuit open, during a time when said key top is located at said predetermined position.

19. The key switch of claim 1, further comprises means for selectively securing said sliding portion of said at least one of said link members in relation to either one of said base and said key top with which said sliding portion is engaged, to hold said key top at a desired lowered position.

20. The key switch of claim 1, wherein said base includes a fixed base element engaged with said pair of link members and a movable base element disposed under said fixed base element in such a manner as to be movable with relation to said fixed base element.

21. The key switch of claim 20, wherein said at least one elastic member is fixedly connected to said movable base element and abutted onto said at least one of said link members.

22. The key switch of claim 20, wherein said at least one elastic member is fixedly connected to said at least one of said link members and abutted onto at least one vertical wall fixedly joined to said movable base element.

23. The key switch of claim 20, wherein said movable base element is moved in a direction generally parallel to a shifting direction of said sliding portion of said each link member.

24. The key switch of claim 20, wherein said movable base element is moved in a direction generally orthogonal to a shifting direction of said sliding portion of said each link member.

25. A keyboard comprising a plurality of key switches, each of said key switches being one defined in claim 20, wherein said movable base element of said each key switch is formed as a single large plate extending over said plurality of key switches, said single large plate being movably disposed under a plurality of fixed base elements of said key switches.

26. A keyboard comprising a plurality of key switches, each of said key switches being one defined in claim 1.

27. A key switch comprising:

a base;

a key top arranged above said base;

a guide member operatively engaged with said base and said key top to support said key top above said base and direct said key top in a vertical direction, said guide member including a sliding portion slidably and shiftably engaged with either one of said base and said key top;

an elastic member disposed between said guide member and either one of said base and said key top with which said sliding portion is engaged, to exert biasing force, relative to a shifting amount of said sliding portion, onto said guide member in a direction different from said vertical direction; and a switching mechanism for selectively opening and closing an electric circuit in connection with a vertical movement of said key top;

wherein said elastic member is fixedly joined to said guide member and is abutted against said base.

28. The key switch of claim 27, wherein said guide member is structured from a plurality of link members interlocked to one another, each of said link members being operatively engaged with said base and said key top and including said sliding portion, and wherein at least one of said link members is associated with at least one said elastic member.

29. A key switch comprising:

a base;

a key top arranged above said base;

a pair of link members interlocked to each other and operatively engaged with said base and said key top to support said key top above said base and direct said key top in a vertical direction, each of said link members including a sliding portion slidably and shiftably engaged with either one of said base and said key top;

at least one elastic member disposed between at least one of said link members and either one of said base and said key top with which said sliding portion is engaged, to exert biasing force, relative to a shifting amount of said sliding portion, onto said at least one of said link members in a direction different from said vertical direction; and a switching mechanism for selectively opening and closing an electric circuit in connection with a vertical movement of said key top;

wherein said at least one of said link members is provided with a loading portion separate from said sliding portion, said loading portion being formed at a position angularly displaced from said sliding portion about a mutually connecting point of said pair of link members, said biasing force being applied onto said loading portion.

30. The key switch of claim 29, wherein said loading portion is shifted in a motion different from said sliding portion when said sliding portion is shifted.

31. A key switch comprising:

a base;

a key top arranged above said base;

a pair of link members interlocked to each other and operatively engaged with said base and said key top to support said key top above said base and direct said key top in a vertical direction, each of said link members including a sliding portion slidably and shiftably engaged with either one of said base and said key top;

at least one elastic member disposed between at least one of said link members and either one of said base and said key top with which said sliding portion is engaged, to exert biasing force, relative to a shifting amount of said sliding portion, onto said at least one of said link members in a direction different from said vertical direction; and a switching mechanism for selectively opening and closing an electric circuit in connection with a vertical movement of said key top, wherein said pair of link members are arranged to mutually intersect and are pivotably and slidably connected relative to each other at an intersection thereof, and wherein each of said link members is engaged slidably at one end thereof with said base and rotatably at another end thereof with said key top, said sliding portion being provided on said one end of said each link member.

32. A key switch comprising:

a base;

a key top arranged above said base;

a pair of link members interlocked to each other and operatively engaged with said base and said key top to support said key top above said base and direct said key top in a vertical direction, each of said link members including a sliding portion slidably and shiftably engaged with either one of said base and said key top;

at least one elastic member disposed between at least one of said link members and either one of said base and said key top with which said sliding portion is engaged, to exert biasing force, relative to a shifting amount of said sliding portion, onto said at least one of said link members in a direction different from said vertical direction; and a switching mechanism for selectively opening and closing an electric circuit in connection with a vertical movement of said key top wherein said pair of link members are meshed with each other at a toothed end of each of said link members, and wherein each of said link members is engaged slidably at one end thereof with said base and rotatably at another end thereof with said key top, said sliding portion being provided on said one end of said each link member, said toothed end being provided adjacent to said other end of said each link member.

33. A key switch comprising:

a base;

a key top arranged above said base;

a pair of link members interlocked to each other and operatively engaged with said base and said key top to support said key top above said base and direct said key top in a vertical direction, each of said link members including a sliding portion slidably and shiftably engaged with either one of said base and said key top;

at least one elastic member disposed between at least one of said link members and either one of said base and said key top with which said sliding portion is engaged, to exert biasing force, relative to a shifting amount of said sliding portion, onto said at least one of said link members in a direction different from said vertical direction; and a switching mechanism for selectively opening and closing an electric circuit in connection with a vertical movement of said key top wherein said pair of link members are arranged to intersect with each other at a toothed end of each of said link members, and wherein each of said link members is engaged slidably at one end thereof with said base and rotatably at another end thereof with said key top, said sliding portion being provided on said one end of said each link member, said toothed end being provided adjacent to said other end of said each link member.

34. A key switch comprising:

a base;

a key top arranged above said base;

a pair of link members interlocked to each other and operatively engaged with said base and said key top to support said key top above said base and direct said key top in a vertical direction, each of said link members including a sliding portion slidably and shiftably engaged with either one of said base and said key top;

at least one elastic member disposed between at least one of said link members and either one of said base and said key top with which said sliding portion is engaged, to exert biasing force, relative to a shifting amount of said sliding portion, onto said at least one of said link members in a direction different from said vertical direction; and a switching mechanism for selectively opening and closing an electric circuit in connection with a vertical movement of said key top, said switching mechanism comprised of a membrane switch arranged in an opening formed in said base beneath said key top, and an actuating member for pushing said membrane switch to close said electric circuit when said key top goes down and is located at a predetermined position above said base, said actuating member is provided on at least one of said link members, and enters into said opening of said base to elastically push said membrane switch when said key top is located at said predetermined position.

35. A key switch comprising:

a base;

a key top arranged above said base;

a pair of link members interlocked to each other and operatively engaged with said base and said key top to support said key top above said base and direct said key top in a vertical direction, each of said link members including a sliding portion slidably and shiftably engaged with either one of said base and said key top;

at least one elastic member disposed between at least one of said link members and either one of said base and said key top with which said sliding portion is engaged, to exert biasing force, relative to a shifting amount of said sliding portion, onto said at least one of said link members in a direction different from said vertical direction;

a switching mechanism for selectively opening and closing an electric circuit in connection with a vertical movement of said key top, said switching mechanism comprised of a membrane switch arranged in an opening formed in said base beneath said key top, and an actuating member for pushing said membrane switch to close said electric circuit when said key top goes down and is located at a predetermined position above said base, said actuating member is provided on at least one of said link members, and enters into said opening of said base to elastically push said membrane switch when said key top is located at said predetermined position; and an assist member movable between a first position where said assist member comes into engagement with said actuating member and a second position where said assist member is away from said actuating member, during a time when said key top is located at said predetermined position, and wherein said actuating member comes into engagement with said assist member to push said membrane switch.

36. A key switch comprising:

a base;

a key top arranged above said base;

a pair of link members interlocked to each other and operatively engaged with said base and said key top to support said key top above said base and direct said key top in a vertical direction, each of said link members including a sliding portion slidably and shiftably engaged with either one of said base and said key top;

at least one elastic member disposed between at least one of said link members and either one of said base and said key top with which said sliding portion is engaged, to exert biasing force, relative to a shifting amount of said sliding portion, onto said at least one of said link members in a direction different from said vertical direction; and a switching mechanism for selectively opening and closing an electric circuit in connection with a vertical movement of said key top, said switching mechanism comprised of a membrane switch arranged in an opening formed in said base beneath said key top, and an actuating member, disposed above said membrane switch, for pushing said membrane switch to close said electric circuit when said key top goes down and is located at a predetermined position above said base, wherein a part of said link members enters into said opening of said base to push said actuating member when said key top is located at said predetermined position, whereby said actuating member pushes said membrane switch.

37. A key switch comprising:

a base;

a key top arranged above said base;

a pair of link members interlocked to each other and operatively engaged with said base and said key top to support said key top above said base and direct said key top in a vertical direction, each of said link members including a sliding portion slidably and shiftably engaged with either one of said base and said key top;

at least one elastic member disposed between at least one of said link members and either one of said base and said key top with which said sliding portion is engaged, to exert biasing force, relative to a shifting amount of said sliding portion, onto said at least one of said link members in a direction different from said vertical direction; and a switching mechanism for selectively opening and closing an electric circuit in connection with a vertical movement of said key top, said switching mechanism comprised of a membrane switch arranged in an opening formed in said base beneath said key top, and an actuating member, for pushing said membrane switch to close said electric circuit when said key top goes down and is located at a predetermined position above said base, said actuating member disposed above said membrane switch, and movable between a first position where said actuating member is pushed by said part of said link members upon said key top is located at said predetermined position and a second position where said actuating member is away from said part of said link members, wherein a part of said link members enters into said opening of said base to push said actuating member when said key top is located at said predetermined position, whereby said actuating member pushes said membrane switch.

38. A key switch comprising:

a base;

a key top arranged above said base;

a pair of link members interlocked to each other and operatively engaged with said base and said key top to support said key top above said base and direct said key top in a vertical direction, each of said link members including a sliding portion slidably and shiftably engaged with either one of said base and said key top;

at least one elastic member disposed between at least one of said link members and either one of said base and said key top with which said sliding portion is engaged, to exert biasing force, relative to a shifting amount of said sliding portion, onto said at least one of said link members in a direction different from said vertical direction; and a switching mechanism for selectively opening and closing an electric circuit in connection with a vertical movement of said key top;

wherein said base includes a fixed base element engaged with said pair of link members and a movable base element disposed under said fixed base element in such a manner as to be movable with relation to said fixed base element and said at least one elastic member is fixedly connected to said at least one of said link members and abutted onto at least one vertical wall fixedly joined to said moveable base element.

39. A key switch comprising:

a base;

a key top arranged above said base;

a pair of link members interlocked to each other and operatively engaged with said base and said key top to support said key top above said base and direct said key top in a vertical direction, each of said link members including a sliding portion slidably and shiftably engaged with either one of said base and said key top;

at least one elastic member disposed between at least one of said link members and either one of said base and said key top with which said sliding portion is engaged, to exert biasing force, relative to a shifting amount of said sliding portion, onto said at least one of said link members in a direction different from said vertical direction; and a switching mechanism for selectively opening and closing an electric circuit in connection with a vertical movement of said key top wherein said base includes a fixed base element engaged with said pair of link members and a movable base element disposed under said fixed base element in such a manner as to be movable with relation to said fixed base element, and said at least one elastic member is fixedly connected to said movable base element and abutted onto said at least one of said link members.

40. A key switch comprising:

a base;

a key top arranged above said base;

a pair of link members interlocked to each other to support said key top above said base, each of said link members including a sliding portion slidably and shiftably engaged with either one of said base and said key top; and at least one elastic member disposed between at least one of said link members and either one of said base and said key top with which said sliding portion is engaged, to exert biasing force, relative to a shifting amount of said sliding portion, onto said at least one of said link members in a direction different from said vertical direction, wherein said at least one elastic member is fixedly joined to said at least one of said link members and is abutted against said base.

* * * * *

UNITED STATES PATENT AND TRADEMARK OFFICE

CERTIFICATE OF CORRECTION

PATENT NO. : 6,257,782 B1
DATED : July 10, 2001
INVENTOR(S) : Junichi Maruyama et al.

It is certified that error appears in the above-identified patent and that said Letters Patent is hereby corrected as shown below:

Title page,
Item [54] Title, change "KEY SWITCH WITH SLIDING MECHANISM AND KEYBOARD" to -- KEY SWITCH AND KEYBOARD --.

Item [73] Assignees, change "both of Kawasaki (JP)" to -- Kawasaki (JP) and Tokyo (JP), respectively --.

Signed and Sealed this

Twenty-eighth Day of May, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,257,782 B1
DATED : July 10, 2001
INVENTOR(S) : Junichi Maruyama et al.

It is certified that error appears in the above-identified patent and that said Letters Patent is hereby corrected as shown below:

Title page,
Item [73], Assignees, change "both of Kawasaki (JP)" to -- Kawasaki (JP) and Tokyo (JP), respectively --.

Signed and Sealed this

Twentieth Day of August, 2002

*Attest:*

*Attesting Officer*

JAMES E. ROGAN
*Director of the United States Patent and Trademark Office*